US007758171B2

(12) United States Patent
Brost

(10) Patent No.: US 7,758,171 B2
(45) Date of Patent: Jul. 20, 2010

(54) AERODYNAMIC ERROR REDUCTION FOR LIQUID DROP EMITTERS

(75) Inventor: Randolph C. Brost, Albuquerque, NM (US)

(73) Assignee: Eastman Kodak Company, Rochester, NY (US)

( * ) Notice: Subject to any disclaimer, the term of this patent is extended or adjusted under 35 U.S.C. 154(b) by 788 days.

(21) Appl. No.: 11/687,873

(22) Filed: Mar. 19, 2007

(65) Prior Publication Data

US 2008/0231669 A1 Sep. 25, 2008

(51) Int. Cl.
*B41J 2/02* (2006.01)

(52) U.S. Cl. ..... 347/75

(58) Field of Classification Search ..... 347/74–77
See application file for complete search history.

(56) References Cited

U.S. PATENT DOCUMENTS

| | | | | |
|---|---|---|---|---|
| 3,373,437 | A | 3/1968 | Sweet et al. | 347/74 |
| 3,560,641 | A | 2/1971 | Taylor et al. | 358/296 |
| 3,596,275 | A | 7/1971 | Sweet | 347/74 |
| 3,739,393 | A | 6/1973 | Lyon et al. | 347/75 |
| 3,877,036 | A | 4/1975 | Loeffler et al. | 347/77 |
| 3,878,519 | A | 4/1975 | Eaton | 347/75 |
| 4,220,958 | A | 9/1980 | Crowley | 347/75 |
| 4,638,328 | A | 1/1987 | Drake | 347/75 |
| 5,224,843 | A | 7/1993 | van Lintel | 417/413.2 |
| 6,387,225 | B1 | 5/2002 | Shimada et al. | 204/192.18 |
| 6,474,784 | B1 | 11/2002 | Fujii et al. | 347/54 |
| 6,505,921 | B2 | 1/2003 | Chwalek et al. | 347/77 |
| 6,511,161 | B2 | 1/2003 | Sumi et al. | 347/68 |
| 6,543,107 | B1 | 4/2003 | Miyashita et al. | 29/25.35 |
| 6,554,410 | B2 | 4/2003 | Jeanmaire et al. | 347/77 |
| 6,561,627 | B2 | 5/2003 | Jarrold et al. | 347/54 |
| 6,575,566 | B1 | 6/2003 | Jeanmaire et al. | 347/77 |
| 6,588,888 | B2 | 7/2003 | Jeanmaire et al. | 347/77 |
| 7,651,206 | B2 * | 1/2010 | Hawkins et al. | 347/73 |

FOREIGN PATENT DOCUMENTS

| | | |
|---|---|---|
| EP | 1232863 | 8/2002 |
| EP | 1323531 | 7/2003 |

* cited by examiner

*Primary Examiner*—An H Do
(74) *Attorney, Agent, or Firm*—Stephen Pond Consulting

(57) ABSTRACT

A method is disclosed for forming a liquid pattern including forming non-print drops by applying non-print drop forming energy pulses during a unit time period, $\tau_0$, and forming print drops by applying print drop forming energy pulses during a large drop time period, $\tau_m$, wherein the large drop time period is a multiple, m, of the unit time period, $\tau_m = m\tau_0$, and $m \geqq 2$; and a corresponding plurality of drop forming energy pulses sequences are formed so as to form non-print drops and print drops according to the liquid pattern data. The corresponding drop forming energy pulse sequences applied to adjacent drop forming transducers are substantially shifted in time so that the print drops formed in adjacent streams of drops are not aligned along the nozzle array direction.

20 Claims, 29 Drawing Sheets

43 33

AERODYNAMIC ERROR REDUCTION FOR LIQUID DROP EMITTERS

FIELD OF THE INVENTION

This invention generally relates to digitally controlled printing devices and more particularly relates to a continuous ink jet printhead that integrates multiple nozzles on a single substrate and in which the breakup of a liquid ink stream into printing drops is caused by an imposed disturbance of the liquid ink stream.

BACKGROUND OF THE INVENTION

Ink jet printing has become recognized as a prominent contender in the digitally controlled, electronic printing arena because of its non-impact, low-noise characteristics, its use of plain paper and its avoidance of toner transfer and fixing. Ink jet printing mechanisms can be categorized by technology as either drop-on-demand ink jet or continuous ink jet.

The first technology, "drop-on-demand" ink jet printing, provides ink droplets that impact upon a recording surface by using a pressurization actuator (thermal, piezoelectric, etc.). Many commonly practiced drop-on-demand technologies use thermal actuation to eject ink droplets from a nozzle. A heater, located at or near the nozzle, heats the ink sufficiently to boil, forming a vapor bubble that creates enough internal pressure to eject an ink droplet. This form of ink jet is commonly termed "thermal ink jet (TIJ)." Other known drop-on-demand droplet ejection mechanisms include piezoelectric actuators, such as that disclosed in U.S. Pat. No. 5,224,843, issued to van Lintel, on Jul. 6, 1993; thermo-mechanical actuators, such as those disclosed by Jarrold et al., U.S. Pat. No. 6,561,627, issued May 13, 2003; and electrostatic actuators, as described by Fujii et al., U.S. Pat. No. 6,474,784, issued Nov. 5, 2002.

The second technology, commonly referred to as "continuous" ink jet printing, uses a pressurized ink source that produces a continuous stream of ink droplets from a nozzle. The stream is perturbed in some fashion causing it to break up into substantially uniform sized drops at a nominally constant distance, the break-off length, from the nozzle. A charging electrode structure is positioned at the nominally constant break-off point so as to induce a data-dependent amount of electrical charge on the drop at the moment of break-off. The charged droplets are directed through a fixed electrostatic field region causing each droplet to deflect proportionately to its charge. The charge levels established at the break-off point thereby cause drops to travel to a specific location on a recording medium or to a gutter for collection and recirculation.

Continuous ink jet (CIJ) drop generators rely on the physics of an unconstrained fluid jet, first analyzed in two dimensions by F. R. S. (Lord) Rayleigh, "Instability of jets," Proc. London Math. Soc. 10 (4), published in 1878. Lord Rayleigh's analysis showed that liquid under pressure, $P_r$, will stream out of a hole, the nozzle, forming a jet of diameter, $D_j$, moving at a velocity, $v_d$. The jet diameter, $D_j$, is approximately equal to the effective nozzle diameter, $D_n$, and the jet velocity is proportional to the square root of the reservoir pressure, $P_r$. Rayleigh's analysis showed that the jet will naturally break up into drops of varying sizes based on surface waves that have wavelengths, $\lambda$, longer than $\pi D_j$, i.e. $\lambda \leqq \pi D_j$. Rayleigh's analysis also showed that particular surface wavelengths would become dominant if initiated at a large enough magnitude, thereby "synchronizing" the jet to produce mono-sized drops. Continuous ink jet (CIJ) drop generators employ some periodic physical process, a so-called "perturbation" or "stimulation", which has the effect of establishing a particular, dominant surface wave on the jet. The surface wave grows causing the break-off of the jet into mono-sized drops synchronized to the frequency of the perturbation.

The drop stream that results from applying Rayleigh stimulation will be referred to herein as a stream of drops of predetermined volume as distinguished from the naturally occurring stream of drops of widely varying volume. While in prior art CIJ systems, the drops of interest for printing or patterned layer deposition were invariably of substantially unitary volume, it will be explained that for the present inventions, the stimulation signal may be manipulated to produce drops of predetermined substantial multiples of the unitary volume. Hence the phrase, "streams of drops of predetermined volumes" is inclusive of drop streams that are broken up into drops all having nominally one size or streams broken up into drops of selected (predetermined) different volumes.

In a CIJ system, some drops, usually termed "satellites" much smaller in volume than the predetermined unit volume, may be formed as the stream necks down into a fine ligament of fluid. Such satellites may not be totally predictable or may not always merge with another drop in a predictable fashion, thereby slightly altering the volume of drops intended for printing or patterning. The presence of small, unpredictable satellite drops is, however, inconsequential to the present inventions and is not considered to obviate the fact that the drop sizes have been predetermined by the synchronizing energy signals used in the present inventions. Thus the phrase "predetermined volume" as used to describe the present inventions should be understood to comprehend that some small variation in drop volume about a planned target value may occur due to unpredictable satellite drop formation.

Commercially practiced CIJ printheads use a piezoelectric device, acoustically coupled to the printhead, to initiate a dominant surface wave on the jet. The coupled piezoelectric device superimposes periodic pressure variations on the base reservoir pressure, causing velocity or flow perturbations that in turn launch synchronizing surface waves. A pioneering disclosure of a piezoelectrically-stimulated CIJ apparatus was made by R. Sweet in U.S. Pat. No. 3,596,275, issued Jul. 27, 1971, Sweet '275 hereinafter. The CIJ apparatus disclosed by Sweet '275 consisted of a single jet, i.e. a single drop generation liquid chamber and a single nozzle structure.

Sweet '275 disclosed several approaches to providing the needed periodic perturbation to the jet to synchronize drop break-off to the perturbation frequency. Sweet '275 discloses a magnetostrictive material affixed to a capillary nozzle enclosed by an electrical coil that is electrically driven at the desired drop generation frequency, vibrating the nozzle, thereby introducing a dominant surface wave perturbation to the jet via the jet velocity. Sweet '275 also discloses a thin ring-electrode positioned to surround but not touch the unbroken fluid jet, just downstream of the nozzle. If the jetted fluid is conductive, and a periodic electric field is applied between the fluid filament and the ring-electrode, the fluid jet may be caused to expand periodically, thereby directly introducing a surface wave perturbation that can synchronize the jet break-off. This CIJ technique is commonly called electrohydrodynamic (EHD) stimulation.

Sweet '275 further disclosed several techniques for applying a synchronizing perturbation by superimposing a pressure variation on the base liquid reservoir pressure that forms the jet. Sweet '275 disclosed a pressurized fluid chamber, the drop generator chamber, having a wall that can be vibrated mechanically at the desired stimulation frequency. Mechanical vibration means disclosed included use of magnetostrictive or piezoelectric transducer drivers or an electromagnetic moving coil. Such mechanical vibration methods are often termed "acoustic stimulation" in the CIJ literature.

The several CIJ stimulation approaches disclosed by Sweet '275 may all be practical in the context of a single jet system However, the selection of a practical stimulation mechanism for a CIJ system having many jets is far more complex. A pioneering disclosure of a multi-jet CIJ printhead has been made by Sweet et al. in U.S. Pat. No. 3,373,437, issued Mar. 12, 1968, Sweet '437 hereinafter. Sweet '437 discloses a CIJ printhead having a common drop generator chamber that communicates with a row (an array) of drop emitting nozzles. A rear wall of the common drop generator chamber is vibrated by means of a magnetostrictive device, thereby modulating the chamber pressure and causing a jet velocity perturbation on every jet of the array of jets.

Since the pioneering CIJ disclosures of Sweet '275 and Sweet '437, most disclosed multi-jet CIJ printheads have employed some variation of the jet break-off perturbation means described therein. For example, U.S. Pat. No. 3,560,641 issued Feb. 2, 1971 to Taylor et al. discloses a CIJ printing apparatus having multiple, multi-jet arrays wherein the drop break-off stimulation is introduced by means of a vibration device affixed to a high pressure ink supply line that supplies the multiple CIJ printheads. U.S. Pat. No. 3,739,393 issued Jun. 12, 1973 to Lyon et al. discloses a multi-jet CIJ array wherein the multiple nozzles are formed as orifices in a single thin nozzle plate and the drop break-off perturbation is provided by vibrating the nozzle plate, an approach akin to the single nozzle vibrator disclosed by Sweet '275. U.S. Pat. No. 3,877,036 issued Apr. 8, 1975 to Loeffler et al. discloses a multi-jet CIJ printhead wherein a piezoelectric transducer is bonded to an internal wall of a common drop generator chamber, a combination of the stimulation concepts disclosed by Sweet '437 and '275

Unfortunately, all of the stimulation methods employing a vibration of some component of the printhead structure or a modulation of the common supply pressure result in some amount of non-uniformity of the magnitude of the perturbation applied to each individual jet of a multi-jet CIJ array. Non-uniform stimulation leads to a variability in the break-off length and timing among the jets of the array. This variability in break-off characteristics, in turn, leads to an inability to position a common drop charging assembly or to use a data timing scheme that can serve all of the jets of the array.

In addition to addressing problems of break-off time control among jets of an array, continuous drop emission systems that generate drops of different predetermined volume based on liquid pattern data need a means of stimulating each individual jet in an independent fashion in response to the liquid pattern data. Consequently, in recent years an effort has been made to develop practical "stimulation per jet" apparatus capable of applying individual stimulation signals to individual jets.

The electrohydrodynamic (EHD) jet stimulation concept disclosed by Sweet '275 operates on the emitted liquid jet filament directly, causing minimal acoustic excitation of the printhead structure itself, thereby avoiding the above noted confounding contributions of printhead and mounting structure resonances. U.S. Pat. No. 4,220,958 issued Sep. 2, 1980 to Crowley discloses a CIJ printer wherein the perturbation is accomplished by an EHD exciter composed of pump electrodes of a length equal to about one-half the droplet spacing. The multiple pump electrodes are spaced at intervals of multiples of about one-half the droplet spacing or wavelength downstream from the nozzles. This arrangement greatly reduces the voltage needed to achieve drop break-off over the configuration disclosed by Sweet '275.

While EHD stimulation has been pursued as an alternative to acoustic stimulation, it has not been applied commercially because of the difficulty in fabricating printhead structures having the very close jet-to-electrode spacing and alignment required and, then, operating reliably without electrostatic breakdown occurring. Also, due to the relatively long range of electric field effects, EHD is not amenable to providing individual stimulation signals to individual jets in an array of closely spaced jets.

An alternate jet perturbation concept that overcomes all of the drawbacks of acoustic or EHD stimulation was disclosed for a single jet CIJ system in U.S. Pat. No. 3,878,519 issued Apr. 15, 1975 to J. Eaton (Eaton hereinafter). Eaton discloses the thermal stimulation of a jet fluid filament by means of localized light energy or by means of a resistive heater located at the nozzle, the point of formation of the fluid jet. Eaton explains that the fluid properties, especially the surface tension, of a heated portion of a jet may be sufficiently changed with respect to an unheated portion to cause a localized change in the diameter of the jet, thereby launching a dominant surface wave if applied at an appropriate frequency. U.S. Pat. No. 4,638,328 issued Jan. 20, 1987 to Drake, et al. (Drake hereinafter) discloses a thermally-stimulated multi-jet CIJ drop generator fabricated in an analogous fashion to a thermal ink jet device. That is, Drake discloses the operation of a traditional thermal ink jet (TIJ) edgeshooter or roofshooter device in CIJ mode by supplying high pressure ink and applying energy pulses to the heaters sufficient to cause synchronized break-off but not so as to generate vapor bubbles.

Also recently, microelectromechanical systems (MEMS), have been disclosed that utilize electromechanical and thermomechanical transducers to generate mechanical energy for performing work. For example, thin film piezoelectric, ferroelectric or electrostrictive materials such as lead zirconate titanate (PZT), lead lanthanum zirconate titanate (PLZT), or lead magnesium niobate titanate (PMNT) may be deposited by sputtering or sol gel techniques to serve as a layer that will expand or contract in response to an applied electric field. See, for example Shimada, et al. in U.S. Pat. No. 6,387,225, issued May 14, 2002; Sumi, et al., in U.S. Pat. No. 6,511,161, issued Jan. 28, 2003; and Miyashita, et al., in U.S. Pat. No. 6,543,107, issued Apr. 8, 2003. Thermomechanical devices utilizing electroresistive materials that have large coefficients of thermal expansion, such as titanium aluminide, have been disclosed as thermal actuators constructed on semiconductor substrates. See, for example, Jarrold et al., U.S. Pat. No. 6,561,627, issued May 13, 2003. Therefore electromechanical devices may also be configured and fabricated using microelectronic processes to provide stimulation energy on a jet-by-jet basis.

U.S. Pat. No. 6,505,921 issued to Chwalek, et al. on Jan. 14, 2003, discloses a method and apparatus whereby a plurality of thermally deflected liquid streams is caused to break up into drops of large and small volumes, hence, large and small cross-sectional areas (Chwalek '921 hereinafter). Thermal deflection is used to cause smaller drops to be directed out of the plane of the plurality of streams of drops while large drops are allowed to fly along nominal "straight" pathways. In addition, a uniform gas flow is imposed in a direction having velocity components perpendicular and across the array of streams of drops of cross-sectional areas. The perpendicular gas flow velocity components apply more force per mass to drops having smaller cross-sections than to drops having larger cross-sections, resulting in an amplification of the deflection acceleration of the small drops.

U.S. Pat. No. 6,588,888 entitled "Continuous ink-jet printing method and apparatus," issued to Jeanmaire, et al. (Jeanmaire '888, hereinafter) and U.S. Pat. No. 6,575,566 entitled "Continuous inkjet printhead with selectable printing volumes of ink," issued to Jeanmaire, et al. (Jeanmaire '566 hereinafter) disclose continuous ink jet printing apparatus including a droplet forming mechanism operable in a first state to form droplets having a first volume traveling along a path and in a second state to form droplets having a plurality of other volumes, larger than the first, traveling along the same path. A droplet deflector system applies force to the droplets traveling along the path. The force is applied in a direction such that the droplets having the first volume diverge from the path while the larger droplets having the plurality of other volumes remain traveling substantially along the path or diverge slightly and begin traveling along a gutter path to be collected before reaching a print medium. The droplets having the first volume, print drops, are allowed to strike a receiving print medium whereas the larger droplets having the plurality of other volumes are "non-print" drops and are recycled or disposed of through an ink removal channel formed in the gutter or drop catcher.

In preferred embodiments, the means for variable drop deflection comprises air or other gas flow. The gas flow affects the trajectories of small drops more than it affects the trajectories of large drops. Generally, such types of printing apparatus that cause drops of different sizes to follow different trajectories, can be operated in at least one of two modes, a small drop print mode, as disclosed in Jeanmaire '888 or Jeanmaire '566, and a large drop print mode, as disclosed also in Jeanmaire '566 or in U.S. Pat. No. 6,554,410 entitled "Printhead having gas flow ink droplet separation and method of diverging ink droplets," issued to Jeanmaire, et al. (Jeanmaire '410 hereinafter) depending on whether the large or small drops are the printed drops. The present invention described hereinbelow are methods and apparatus for implementing either large drop or small drop printing modes.

The combination of individual jet stimulation and aerodynamic deflection of differently sized drops yields a continuous liquid drop emitter system that eliminates the difficulties of previous CIJ embodiments that rely on some form of drop charging and electrostatic deflection to form the desired liquid pattern. Instead, the liquid pattern is formed by the pattern of drop volumes created through the application of input liquid pattern dependent drop forming pulse sequences to each jet, and by the subsequent deflection and capture of non-print drops. An additional benefit is that the drops generated are nominally uncharged and therefore do not set up electrostatic interaction forces amongst themselves as they traverse to the receiving medium or capture gutter.

However this configuration of liquid pattern deposition has some remaining difficulties when high speed, high pattern quality printing is undertaken. High speed and high quality liquid pattern formation requires that closely spaced drops of relatively small volumes are directed to the receiving medium. As the pattern of drops traverse from the printhead to the receiving medium, through a gas flow deflection zone, the drops alter the gas flow around neighboring drops in a pattern-dependent fashion. The altered gas flow, in turn, causes the printing drops to have altered, pattern-dependent trajectories and arrival positions at the receiving medium. In other words, the close spacing of print drops as they traverse to the receiving medium leads to aerodynamic interactions and subsequent drop placement errors. These errors have the effect of spreading an intended printed liquid pattern in an outward direction and so are termed "splay" errors herein.

Therefore to gain full advantage of the simplification in continuous liquid drop emitter printhead structure offered by individual jet stimulation and aerodynamic drop deflection, practical and efficient methods of reducing aerodynamic interaction error are needed.

SUMMARY OF THE INVENTION

It is therefore an object of the present invention to provide methods of depositing high quality liquid patterns at high speed with reduced errors due to aerodynamic interactions among print drops.

It is further an object of the present invention to provide an apparatus for depositing high quality liquid patterns at high speed with reduced errors due to aerodynamic interactions among print drops.

It is also an object of the present invention to provide methods of continuous drop emission printing using print and non-print drops of different volumes and with reduced aerodynamic interactions among print drops.

The foregoing and numerous other features, objects and advantages of the present invention will become readily apparent upon a review of the detailed description, claims and drawings set forth herein. These features, objects and advantages are accomplished by a method of forming a liquid pattern of print drops impinging a receiving medium according to liquid pattern data using a liquid drop emitter that emits a plurality of continuous streams of liquid at a stream velocity, $v_d$, from a plurality of nozzles having effective diameters, $D_n$, arrayed at a nozzle spacing, $S_n$, along a nozzle array direction that are broken into a plurality of streams of print and non-print drops by a corresponding plurality of drop forming transducers to which a corresponding plurality of drop forming energy pulse sequences are applied. The method is comprised of forming non-print drops by applying non-print drop forming energy pulses during a unit time period, $\tau_0$, and forming print drops by applying print drop forming energy pulses during a large drop time period, $\tau_m$, wherein the large drop time period is a multiple, m, of the unit time period, $\tau_m=m\tau_0$, and $m\geqq 2$; and a corresponding plurality of drop forming energy pulses sequences are formed so as to form non-print drops and print drops according to the liquid pattern data. The corresponding drop forming energy pulse sequences applied to adjacent drop forming transducers are substantially shifted in time so that the print drops formed in adjacent streams of drops are not aligned along the nozzle array direction.

Additional embodiments of the present invention are realized by forming print drops by applying print drop forming energy pulses during a unit time period, $\tau_0$, and forming non-print drops by applying non-print drop forming energy pulses during a large drop time period, $\tau_m$, wherein the large drop time period is a multiple, m, of the unit time period, $\tau_m=m\tau_0$, and $m\geqq 2$; and forming the corresponding plurality of drop forming energy pulses sequences so as to form non-print drops and print drops according to the liquid pattern data. The corresponding drop forming energy pulse sequences applied to adjacent drop forming transducers are substantially shifted in time by a time shift amount, $t_s$, wherein the time shift amount is a portion, q, of the unit drop time period, $\tau_0$, such that $t_s=q\tau_0$, and $0.2\leqq q\leqq 0.8$.

Further embodiments of the present invention are realized by a drop deposition apparatus for laying down a patterned liquid layer on a receiver substrate comprising a liquid drop emitter that emits a plurality of continuous streams of liquid in a stream direction at a stream velocity, $v_d$, from a plurality of nozzles having effective diameters, $D_n$, arrayed at a nozzle spacing, $S_n$, along a nozzle array direction and a corresponding plurality of drop forming transducers to which a corresponding plurality of drop forming energy pulse sequences are applied to generate non-print drops and print drops having substantially different volumes. The drop deposition apparatus further comprises a relative motion apparatus adapted to move the liquid drop emitter relative to the receiver substrate in a printing direction at a printing velocity, $v_{PM}$; a controller adapted to generate drop forming energy pulse sequences comprised of non-print drop forming energy pulses within non-print drop time periods, $\tau_{np}$, and print drop forming energy pulses within print drop time periods, $\tau_p$, according to the liquid pattern data and wherein the non-print drop time periods are substantially different from the print drop time periods causing non-print drop volumes to be substantially different from print drop volumes; drop deflection apparatus adapted to deflect print and non-print drops to follow different flight paths according to the substantially different volumes of the print and non-print drops; and wherein the controller is further adapted to substantially shift in time the corresponding drop forming energy pulse sequences applied to adjacent drop forming transducers so that the print drops formed in adjacent streams of drops are not aligned along the nozzle array direction.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description is directed in particular to elements forming part of, or cooperating more directly with, apparatus in accordance with the invention. Functional elements and features have been given the same numerical labels in the figures if they are the same element or perform the same function for purposes of understanding the present invention. It is to be understood that elements not specifically shown or described may take various forms well known to those skilled in the art.

Figure 1:
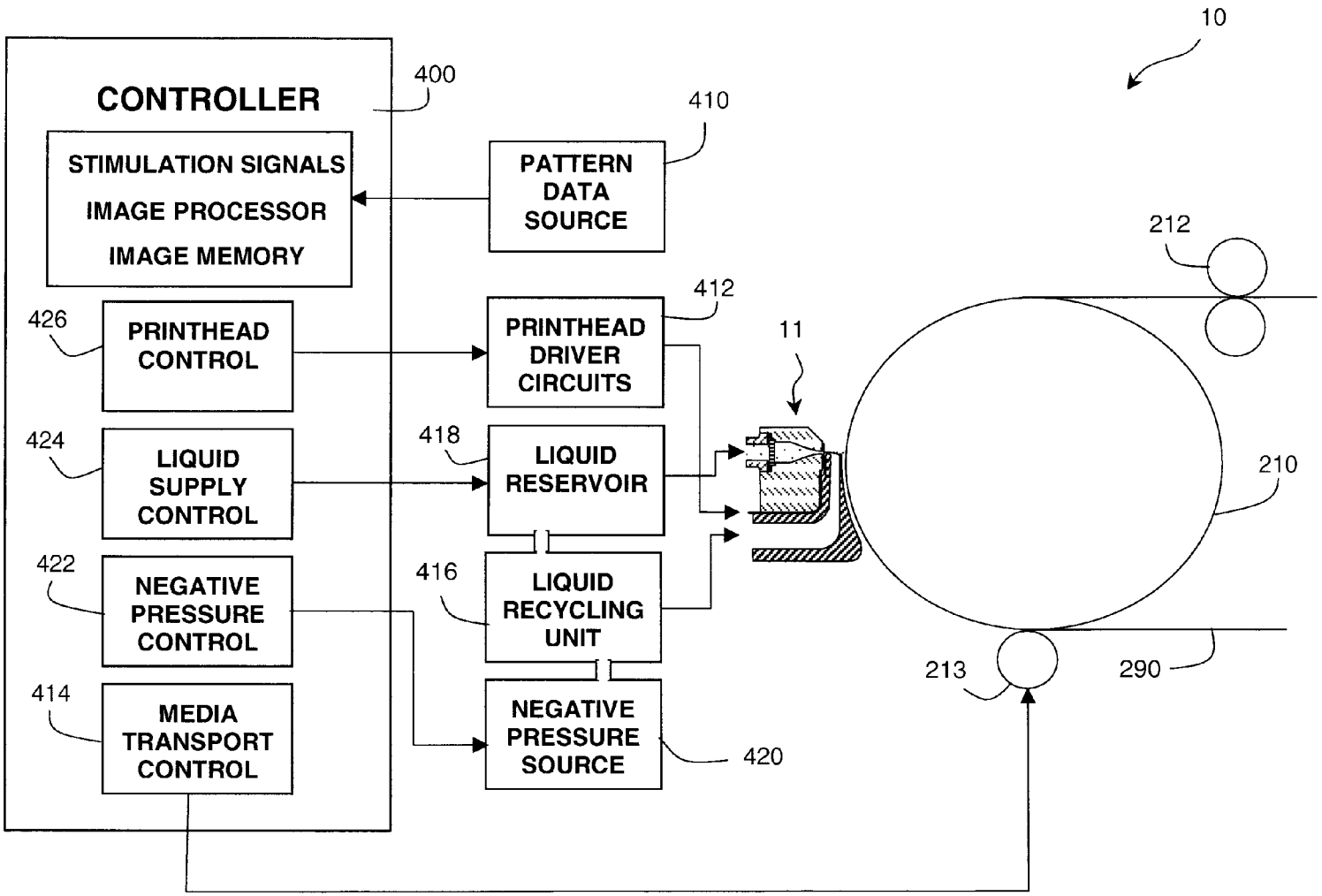
FIG. 1 shows a simplified block schematic diagram of one exemplary liquid pattern deposition apparatus made in accordance with the present invention.
Figure 2:
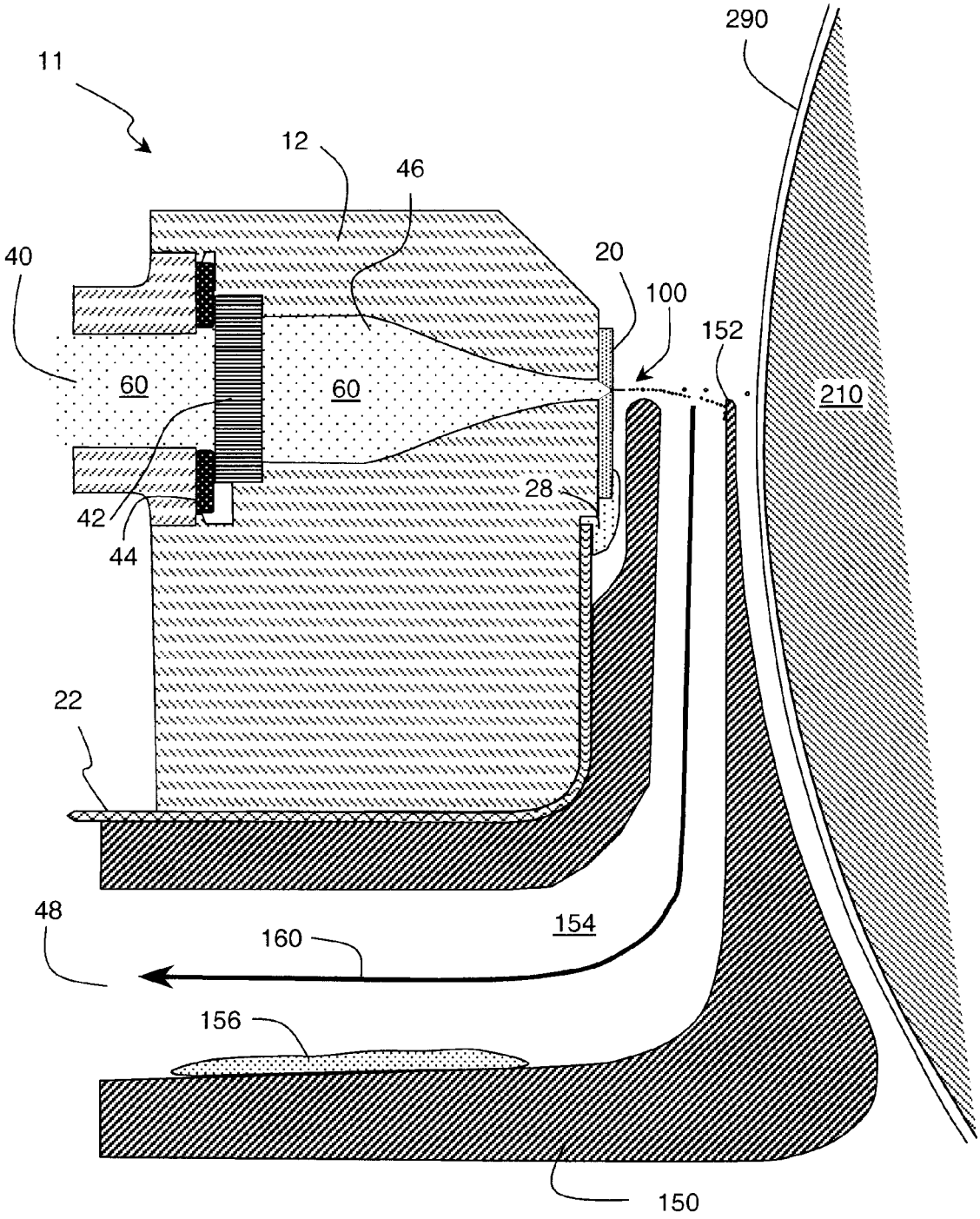
FIG. 2 shows in schematic cross sectional side view a continuous liquid drop emitter with gas flow drop deflection according to a preferred embodiment of the present invention.

Referring to FIGS. 1 and 2, a continuous drop deposition apparatus 10 for depositing a liquid pattern is illustrated. Typically such systems are ink jet printers and the liquid pattern is an image printed on a receiver sheet or web. However, other liquid patterns may be deposited by the system illustrated including, for example, masking and chemical initiator layers for manufacturing processes. For the purposes of understanding the present invention the terms "liquid" and "ink" will be used interchangeably, recognizing that inks are typically associated with image printing, a subset of the potential applications of the present invention. The liquid pattern deposition system is controlled by a process controller 400 that interfaces with various input and output components, computes necessary translations of data and executes needed programs and algorithms.

The liquid pattern deposition system 10 further includes a source of the image or liquid pattern data 410 which provides raster image data, outline image data in the form of a page description language, or other forms of digital image data. This image data is converted to bitmap image data by controller 400 and stored for transfer to a multi-jet drop emission printhead 11 via a plurality of printhead transducer driver circuits 412 connected to printhead electrical interface 22. The bit map image data specifies the deposition of individual drops onto the picture elements (pixels) of a two dimensional matrix of positions, equally spaced a pattern raster distance, determined by the desired pattern resolution, i.e. the pattern "dots per inch" or the like. The raster distance or spacing may be equal or may be different in the two dimensions of the pattern.

Controller 400 also creates drop synchronization or formation signals in a printhead controller 426 that are applied to printhead transducer drive circuits 412 that are subsequently applied to printhead 11 to cause the break-up of the plurality of fluid streams emitted into drops of predetermined volume and with a predictable timing. Some portion or all of the printhead control and transducer drive circuitry may be integrated into the printhead 11. Printhead 11 is illustrated in FIGS. 1 and 2 as a "page wide" printhead in that it contains a plurality of jets sufficient to print all scanlines across the medium 290 without need for movement of the printhead 11.

Recording medium 290 is moved relative to printhead 11 by a recording medium transport system, which is electronically controlled by a media transport controller 414, and which in turn is controlled by controller 400. The recording medium transport system shown in FIG. 1 is a schematic representation only; many different mechanical configurations are possible. For example, transfer rollers 213, transfer rollers 212 and media support drum 210 could be used in a recording medium transport system to facilitate transfer of the liquid drops to recording medium 290. Such media transport technology is well known in the art. In the case of page width printheads as illustrated in FIG. 1, it is most convenient to move recording medium 290 past a stationary printhead. Recording medium 290 is transported at a velocity, $v_{PM}$. In the case of scanning printhead print systems, it is usually most convenient to move the printhead along one axis (the main scanning direction) and the recording medium along an orthogonal axis (the sub-scanning direction) in a relative raster motion.

Pattern liquid is contained in a liquid reservoir 418 under pressure and controlled by a liquid supply controller 424 which is, in turn, controlled by controller 400. The positive pattern liquid pressure suitable for optimal operation will depend on a number of factors, including geometry and thermal properties of the nozzles and several properties of the liquid.

In the non-printing state, continuous drop streams are unable to reach recording medium 18 due to a liquid gutter portion of printhead 11 that captures the stream and which may allow a portion of the liquid to be recycled by a liquid recycling unit 416. The liquid recycling unit 416 receives the un-printed liquid via printhead liquid recovery outlet 48, stores the liquid or reconditions it and feeds it back to reservoir 418. The liquid recycling unit may also be configured to apply a negative pressure to liquid recovery outlet 48 to assist in liquid recovery and to affect the gas flow through printhead 11 for the purpose of drop deflection. Negative pressure source 420 interfaces via the liquid recycling pathway. A negative pressure controller 422, which is in turn controlled by system controller 400, manages the negative pressure. Liquid recycling units are well known in the art.

Some of the elements of printhead 11 are more clearly seen in the side view illustration of FIG. 2. The pattern liquid 60 is introduced via a liquid supply line entering printhead 11 at liquid inlet port 40 in a drop generator body 12. A continuous, multi-jet drop emitter device 20 is affixed to the drop generator body 12. The liquid preferably flows through an inlet filter 42 sealed to a common supply reservoir 46 by a gasket seal 44, and then into the drop emitter device 20, preferably a semiconductor device containing a high density of individual jets and drop forming transducers.

The cross-sectional side view of printhead 11 illustrated in FIG. 2 is taken through one jet of an array of jets and shows one stream of drops of predetermined volume 100. Some of the drops of stream 100, non-print drops, are deflected downward in FIG. 2 and strike deflected drop capture lip 152. Other drops, print drops, are deflected substantially less, pass over capture lip 152, and strike the receiving medium 290 to form the desired liquid pattern. The captured non-print drop liquid 156 is returned to the liquid recycling subsystem via plenum 154 in the drop deflection gas and liquid recovery manifold 150. Non-print drops are deflected towards the drop capture lip by an airflow 160 caused by applying a negative pressure at the liquid recovery inlet 48.

The multi-jet drop generator device 20 is fabricated with individual drop forming stimulation means which are, in turn, interfaced to the printhead control electronics via a printhead flexible electrical connection member 22. A protective encapsulant 28 covers the interconnection of liquid emitter device 20 to the flexible connector 22. In some preferred embodiments of the present invention the jet stimulation transducers are resistive heaters. In other embodiments, more than one transducer per jet may be provided including some combination of resistive heaters, electric field electrodes and micro-electromechanical flow valves. When drop generator device 20 is at least partially fabricated from silicon, it is possible to integrate some portion of the printhead transducer control circuits 412 with the printhead, simplifying printhead electrical connector 22.

Figure 3A:
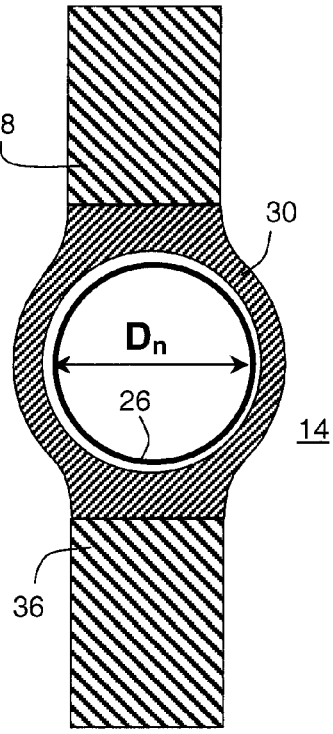
FIGS. 3(*a*) and 3(*b*) show schematic plan views illustrating a single liquid drop emitter nozzle with surrounding thermal stimulation heater and a portion of an array of such nozzles and stimulators according to a preferred embodiment of the present invention.
Figure 3B:
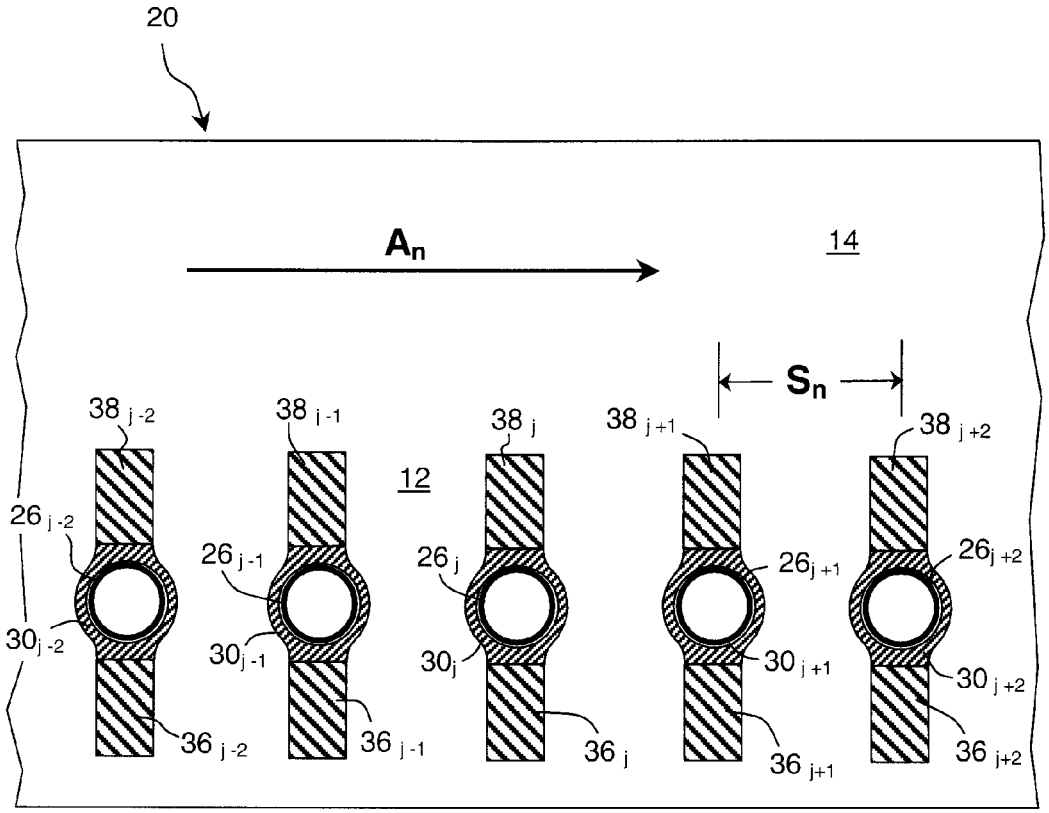

A front face view of a single nozzle 26 of a preferred printhead embodiment is illustrated in FIG. 3(*a*). A portion, five nozzles, of an extended array of such nozzles is illustrated in FIG. 3(*b*). For simplicity of understanding, when multiple jets and component elements are illustrated, suffixes "j", "j+1", et cetera, are used to denote the same functional elements, in order, along a large array of such elements.

FIGS. 3(*a*) and 3(*b*) show nozzles 26 of a drop generator device 20 portion of printhead 11 having a circular shape with a diameter, $D_n$, equally spaced at a drop nozzle spacing, $S_n$, along a nozzle array direction or axis, $A_n$, and formed in a nozzle front face layer 14. While a circular nozzle is depicted, other shapes for the liquid emission orifice may be used and an effective diameter utilized, i.e. the circular diameter that specifies an equivalent open area. Typically, the nozzle diameter will be formed in the range of 6 microns to 35 microns, depending on the size of drops that are appropriate for the liquid pattern being deposited. Typically, the drop nozzle spacing, $S_n$, will be in the range 84 to 21 microns corresponding to a pattern raster resolution in the nozzle axis direction of 300 pixels/inch to 1200 pixels/inch.

An encompassing resistive heater 30 is formed in a front face layer surrounding the nozzle bore. Resistive heater 30 is addressed by electrode leads 38 and 36. One of the electrodes, for example electrode 36 may be shared in common with the resistors surrounding other jets. However, at least one resistor electrode lead, for example electrode 38, provides electrical pulses to the jet individually so as to cause the independent stimulation of that jet. Alternatively a matrix addressing arrangement may be employed in which the two address leads 38, 36 are used in conjunction to selectively apply stimulation pulses to a given jet. These resistive heaters may be utilized to launch surface waves of the proper wavelength to synchronize the jet of liquid to break-up into drops of substantially uniform diameter, $D_{d0}$, volume, $V_0$, and spacing $\lambda_0$. Resistive heater pulsing may also be devised to cause the break-up of the stream into larger segments of fluid that coalesce into drops having volumes, $V_m$, that are multiples of $V_0$, i.e. into drops of volume ~$mV_0$, where m is a number greater than 1, i.e., $m \geqq 2$.

For the purposes of understanding the present invention, drops having the smallest predetermined volume, $V_0$, will be called "small" drops or "nominal" or "fundamental" volume drops and coalesced drops having volumes approximately $mV_0$ will be called "large" drops. The desired liquid output pattern or image may be formed on the receiving medium from either small or large drops. The system depicted in FIG. 2 is being operated to form the liquid pattern with large drops. The small or nominal size drops are being deflected downward to strike the drop capture lip 152. As will be explained hereinbelow, the present inventions may be usefully applied to either a small drop or large drop print mode configuration.

Figure 4A:
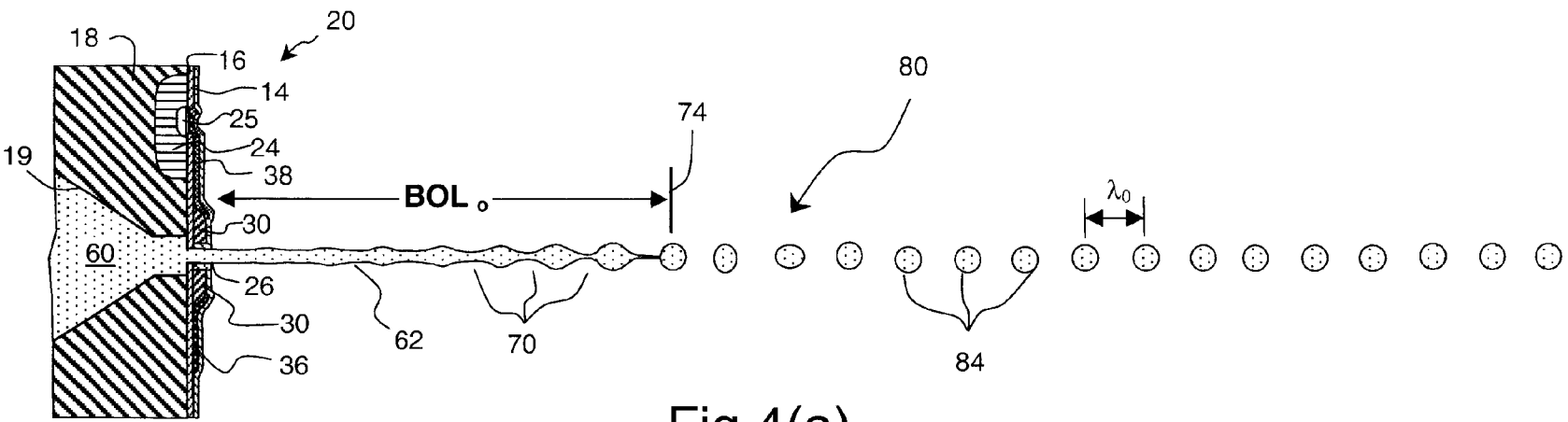
FIGS. 4(*a*) and 4(*b*) illustrate in side cross-sectional view liquid drop emitters operating with a single drop size and with large and small drop sizes, respectively, according to the present invention.
Figure 4B:
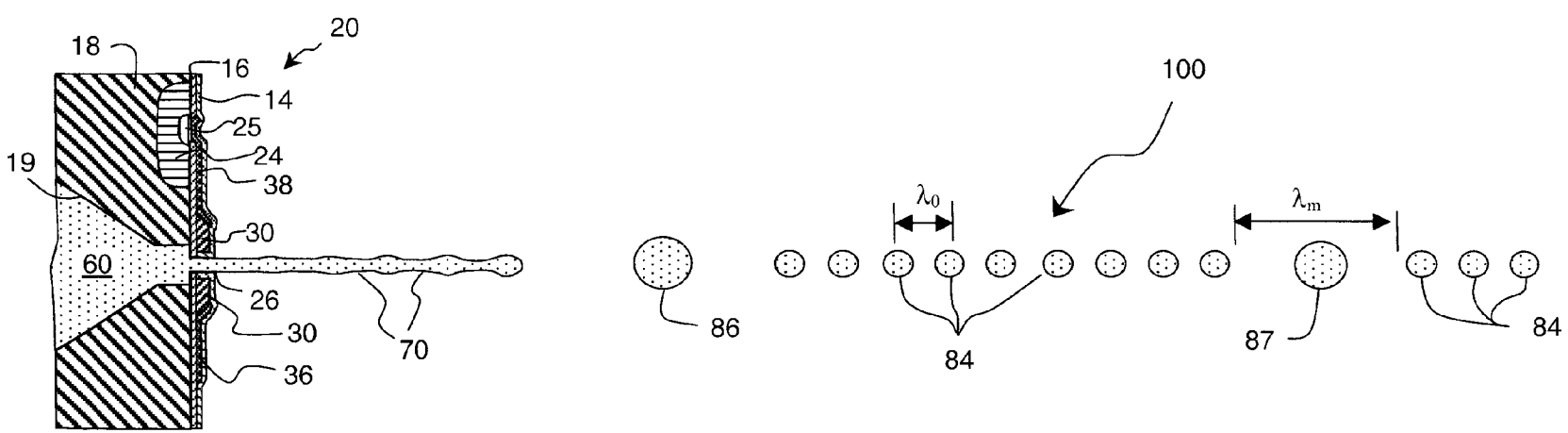

One effect of pulsing jet stimulation heater 30 on a continuous stream of fluid 62 is illustrated in a side view in FIGS. 4(*a*) and 4(*b*). FIGS. 4(*a*) and 4(*b*) illustrate in side cross section view a portion of a drop generator device substrate 18 around one nozzle 26 of the plurality of nozzles. Pressurized working liquid 60 is supplied to nozzle 26 via internal drop generator device liquid supply chamber 19. Nozzle 26 is formed in drop nozzle front face layer 14, and possibly in thermal and electrical isolation layer 16 and other layers utilized in the fabrication of the drop generator device. Also illustrated in FIGS. 4(*a*) and 4(*b*) is an integrated power transistor 24 associated with each jet and connected to lead 38 by via contact 25.

In FIG. 4(*a*) nozzle heater 30 is pulsed with energy pulses sufficient to launch a dominant surface wave causing dominant surface sinuate necking 70 on the fluid column 62, leading to the synchronization of break-up into a stream 80 of drops 84 of substantially uniform diameter, $D_{d0}$, and spacing, $\lambda_0$, and at a stable operating break-off point 74 located an operating distance, $BOL_o$, from the nozzle plane. The fluid stream and individual drops 84 travel along a nominal flight path at a velocity of $v_d$, based on the fluid supply reservoir pressure, $P_r$, nozzle geometry and fluid properties.

Figure 5A:
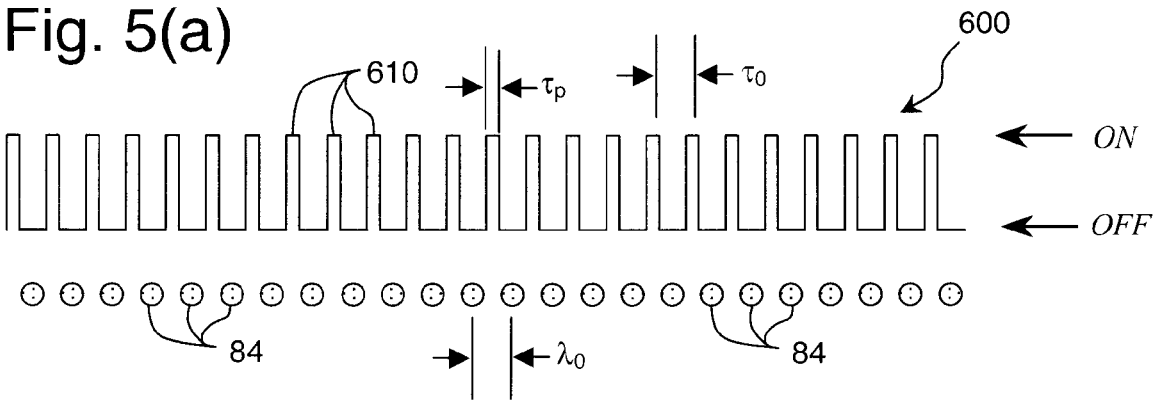
FIGS. 5(*a*), 5(*b*) and 5(*c*) show representations of energy pulse sequences for stimulating break-up of a fluid jet by stream stimulation heater resistors resulting in drops of different predetermined volumes according to a preferred embodiment of the present invention.
Figure 5B:
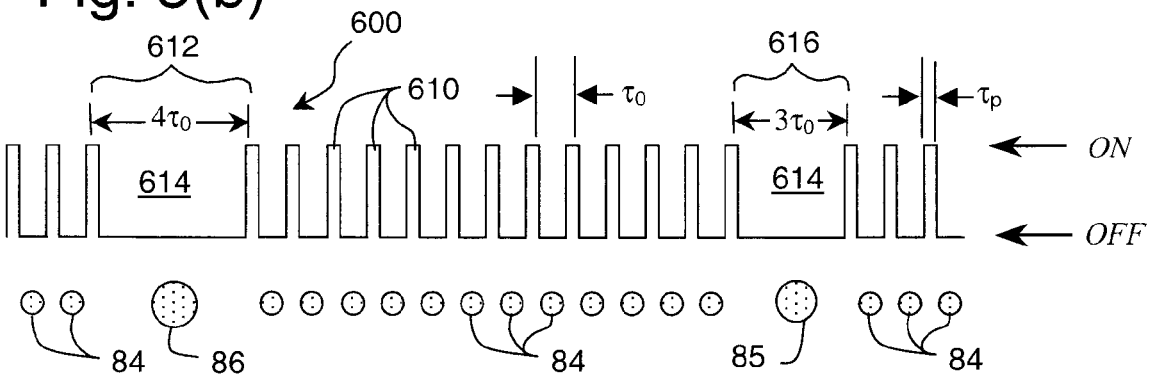
Figure 5C:
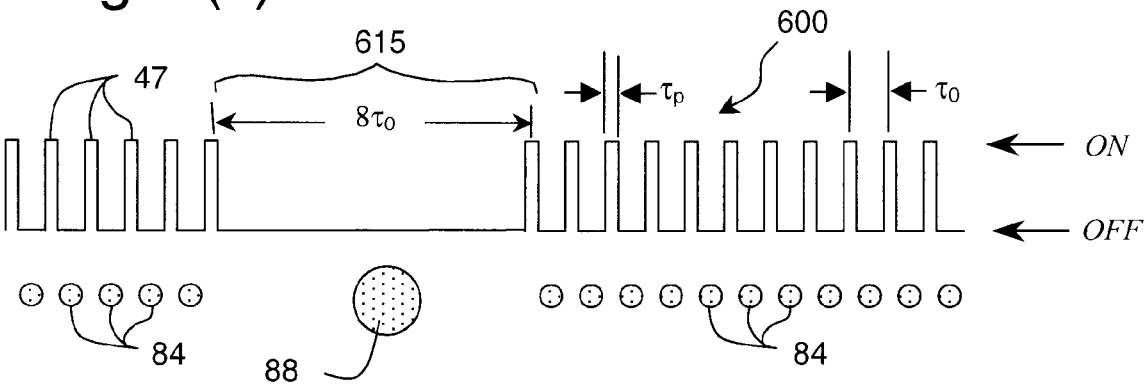

Thermal pulse synchronization of the break-up of continuous liquid jets is also known to provide the capability of generating streams of drops of predetermined volumes wherein some drops may be formed having multiple volumes, $mV_0$, of a unit volume, $V_0$. See for example U.S. Pat. No. 6,588,888 to Jeanmaire, et al. and assigned to the assignee of the present inventions. FIGS. 5(*a*)-5(*c*) illustrate thermal stimulation of a continuous stream by several different sequences 600 of electrical energy pulses. The energy pulse sequences 600 are represented schematically as turning a heater resistor "on" and "off" to create stimulation energy pulses of duration $\tau_p$. The drop pattern that is formed by the drop forming pulse sequence is schematically depicted beneath the pulse sequences.

In FIG. 5(*a*) the stimulation pulse sequence consists of a train of unit period pulses 610. A continuous jet stream stimulated by this pulse train is caused to break up into drops 84 all of volume $V_0$, spaced in time by $\tau_0$ and spaced along their flight path by $\lambda_0$. The energy pulse train illustrated in FIG. 5(*b*) consists of unit period pulses 610 as well as the deletion of some pulses creating a $4\tau_0$ time period for sub-sequence 612 and a $3\tau_0$ time period for sub-sequence 616. The deletion of stimulation pulses causes the fluid in the jet to collect (coalesce) into drops of volumes consistent with these longer-than-unit time periods. That is, sub-sequence 612 results in the formation of a drop 86 having coalesced volume of approximately $4V_0$ and sub-sequence 616 results in a drop 87 of coalesced volume of approximately $3V_0$. FIG. 5(*c*) illustrates a pulse train having a sub-sequence of period $8\tau_0$ generating a drop 88 of coalesced volume of approximately $8V_0$. Coalescence of the multiple units of fluid into a single drop requires some travel distance and time from the break-off point. The coalesced drop tends to be located near the center of the space that would have been occupied had the fluid been broken into multiple individual drops of nominal volume $V_0$.

FIG. 4(*b*) illustrates a continuous drop emitter operated to form a stream of drops 100 of both large and small predetermined volumes, such as would be formed by the drop formation pulse sequence illustrated in FIG. 5(*b*). Note that the drop formation sequence in FIG. 4(*b*) corresponds to the drop formation pulse sequence in FIG. 5(*b*) when time increases from right to left in FIG. 5(*b*). Coalescence of the fluid into a single large drop may require some travel distance and time from the break-off point. The coalesced large drop tends to be located near the center of the space that would have been occupied had the fluid been broken into multiple individual drops of nominal volume $V_0$. FIG. 4(*b*) should be understood to be an illustrative representation of how the stream of drops of multiple predetermined volumes would appear if coalescence were immediate.

The capability of producing both large and small drops by manipulating the drop forming pulse sequence may be used to advantage in differentiating between print and non-printing drops. Drops may be deflected by entraining them in a cross gas flow field. Larger drops have a smaller drag to mass ratio and so are deflected less than smaller volume drops in a gas flow field. Thus a gas deflection zone may be used to disperse drops of different volumes to different flight paths. A liquid pattern deposition system may be configured to print with large volume drops and to gutter small drops, or vice versa. The present invention is applicable to either configuration.

Figure 6:
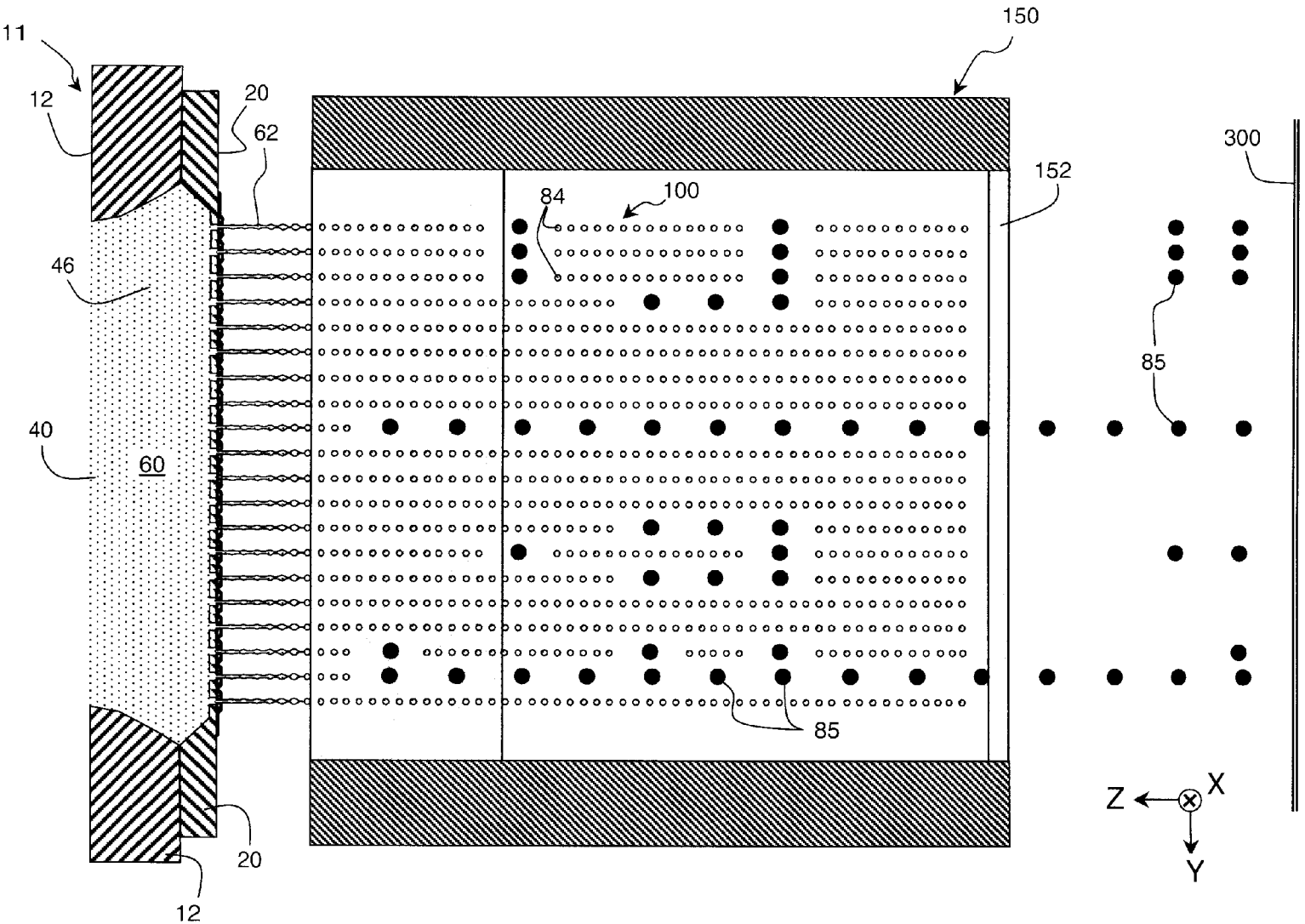
FIG. 6 shows in schematic cross sectional top view a continuous liquid drop emitter with gas flow drop deflection according to a preferred embodiment of the present invention.

FIG. 6 illustrates in plan cross-sectional view a liquid drop pattern deposition system configured to print with large volume drops 85, $V_m$=5 $V_0$, and to gutter small volume drops 84, $V_0$, that are subject to deflection air flow in the x-direction, set up by air flow plenum 150. A multiple jet array printhead 11 is comprised of a semiconductor drop emitter device 20 formed with a plurality of jets and jet stimulation transducers attached to a drop generator body 12. Patterning liquid 60 is supplied via a liquid supply inlet 40 and common supply reservoir 46, a slit running the length of the array of jets. Note that the large drops 85 in FIG. 6 are shown as "coalesced" throughout, whereas, in actual practice, the fluid forming the large drops 85 may not coalesce until some distance from the fluid stream break-off point.

The mass of drops emitted by the array of jets may be viewed as forming a "curtain" of liquid traversing the space between the nozzle face of the liquid drop emitter and the receiving media. The initial liquid curtain is separated into a non-print drop curtain and a print drop curtain by the combined effects of forming print and non-print drops to have substantially different volumes according to the input liquid pattern data, and then subjecting the liquid to a cross gas flow that differentially deflects drops of different diameters (volumes). Aerodynamic interactions among drops within the print drop curtain are a primary focus of the present invention.

The terms "air" flow and "gas" flow will be used interchangeably in the explanations of the present invention herein. The configuration of the deflection system illustrated in FIGS. 1 and 6 is conducive to the use of ambient air, drawn in by a vacuum source, as the flowing gas used to deflect print and non-print drops. However, other configurations may be used with the present inventions wherein the deflection flow field is formed of a conditioned gas, i.e. one that includes components in concentrations and properties that are different from the ambient air that surrounds the printhead. The phrase "gas flow" is intended to convey that the present inventions are applicable regardless of the specific composition of the gas being used to differentially deflect large and small volume drops in the continuous liquid drop emission system.

Figure 7A:
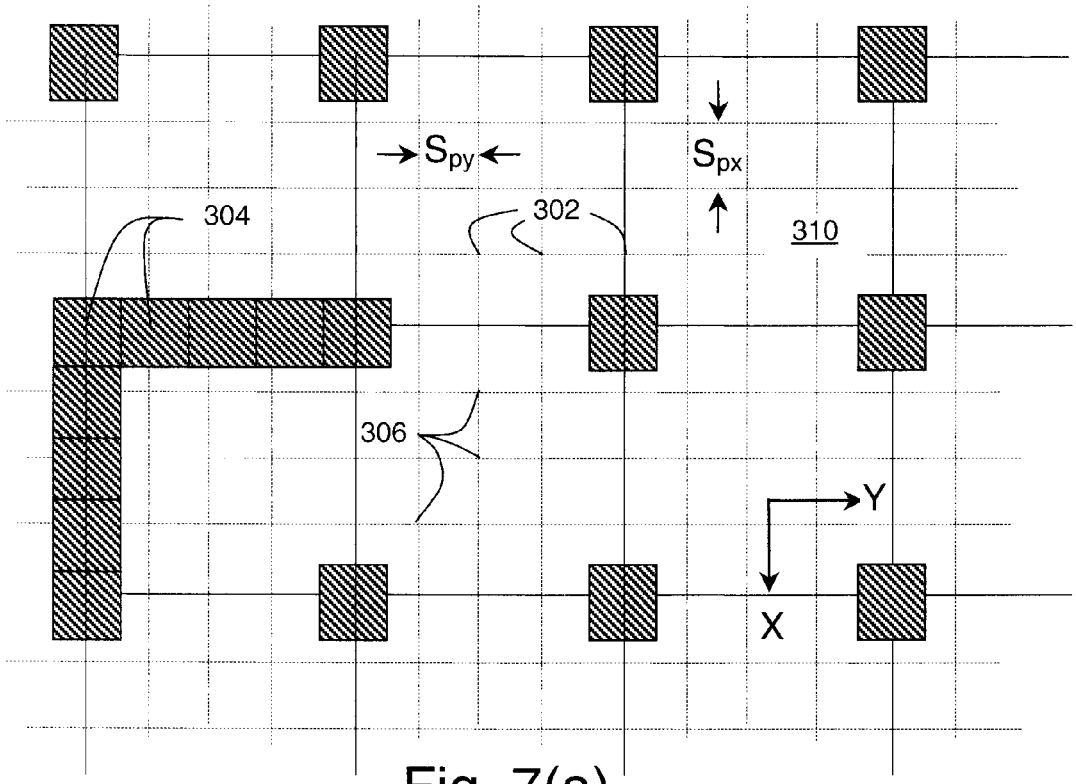
FIGS. 7(*a*) and 7(*b*) illustrate input liquid pattern data and the corresponding output liquid pattern, respectively.
Figure 7B:
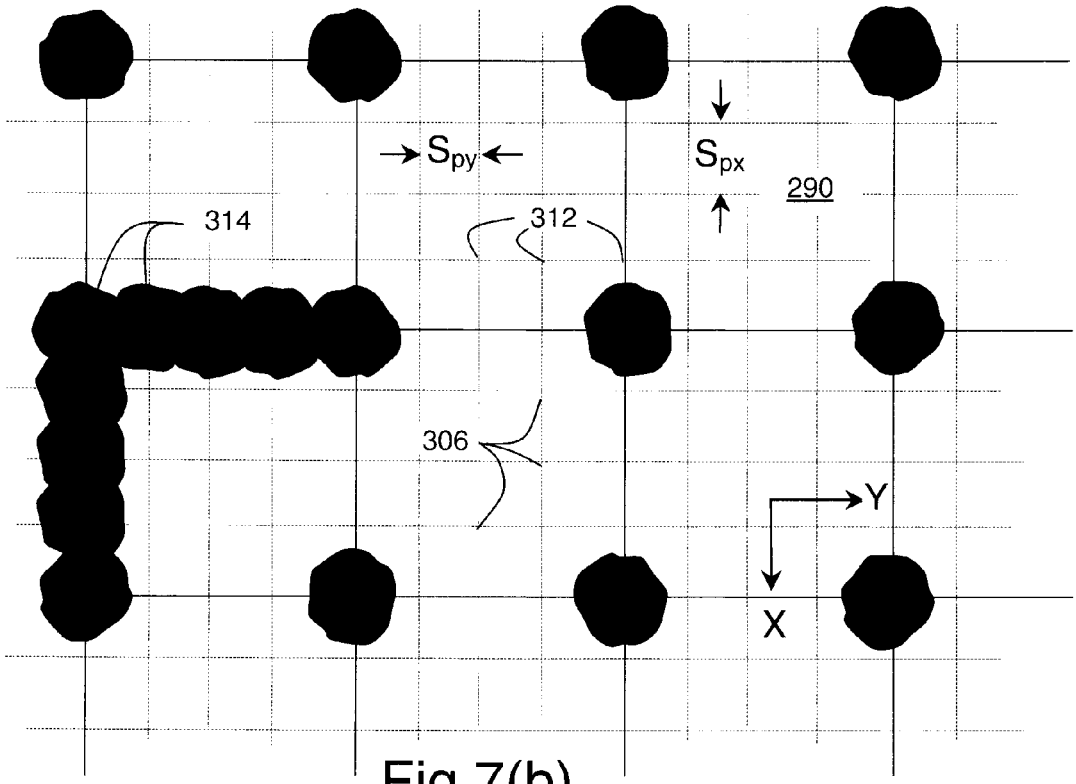
Figure 8A:
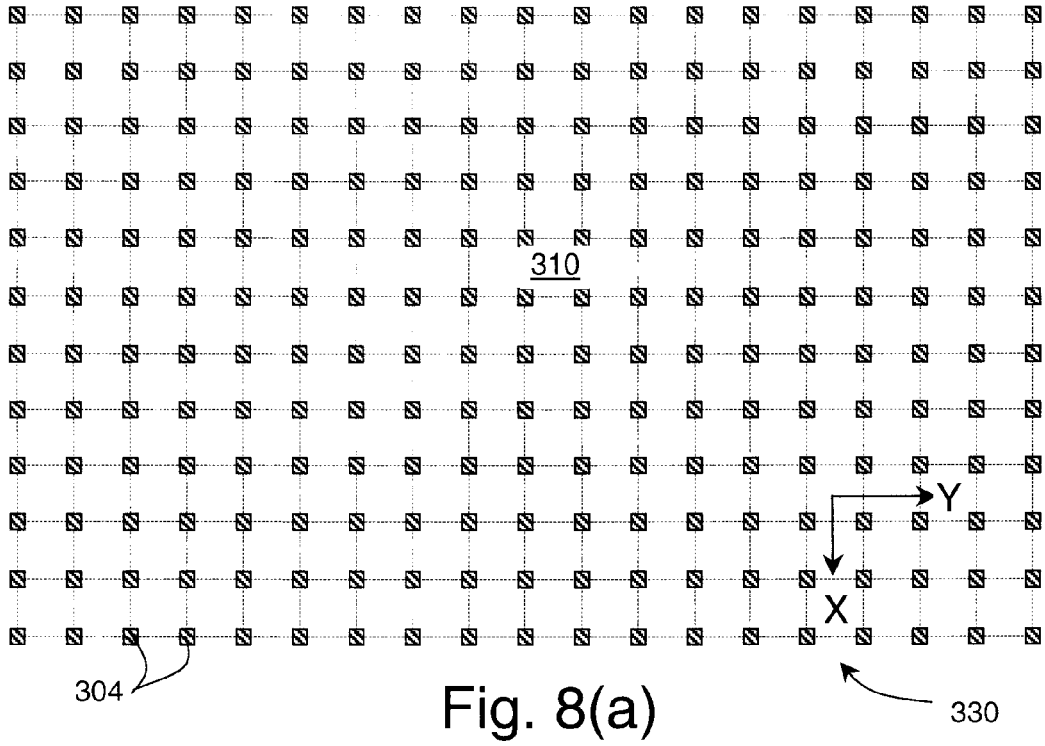
FIGS. 8(*a*) and 8(*b*) illustrate input liquid pattern data and the corresponding output liquid pattern, respectively for a grid pattern of every fourth pixel location being printed.
Figure 8B:
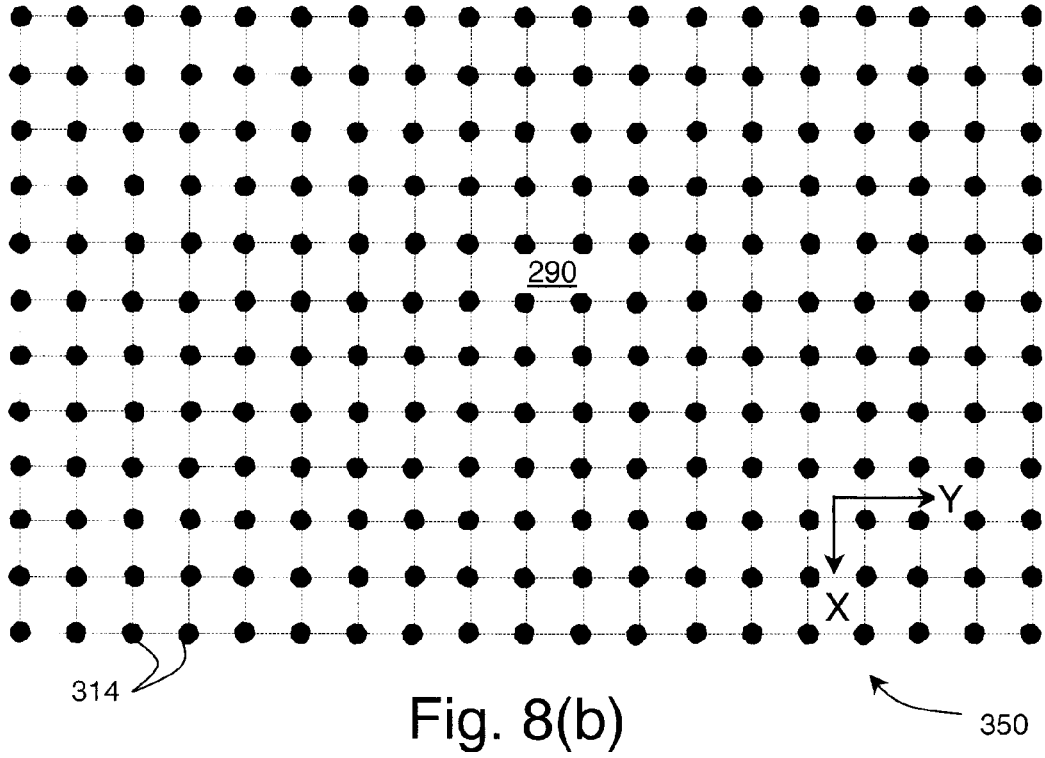
Figure 14A:
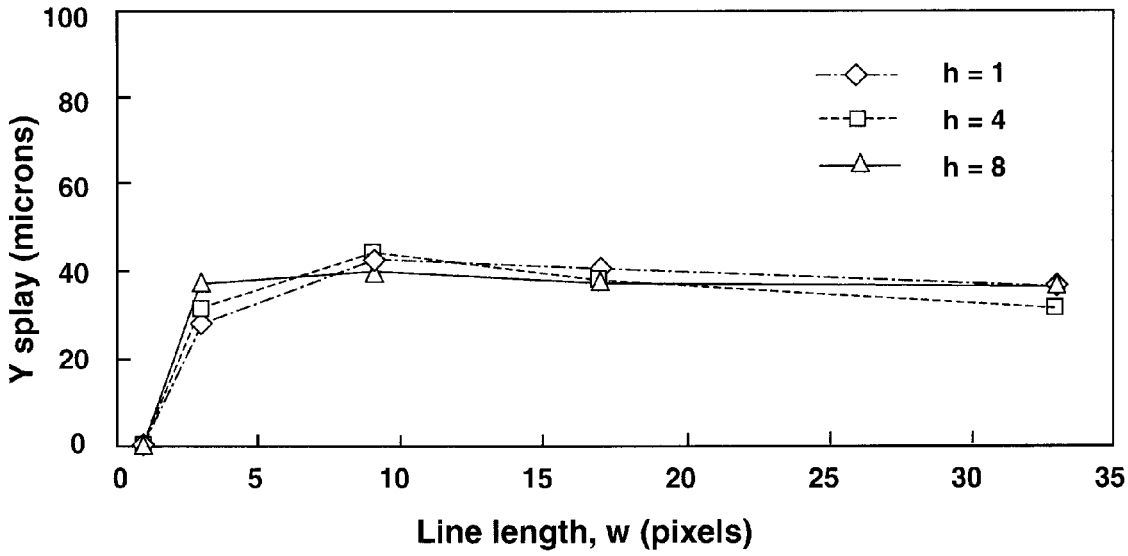
FIGS. 14(*a*) and 14(*b*) show plots of measured y-direction and x-direction splay errors, respectively, for various isolated lines in printed liquid patterns.
Figure 14B:
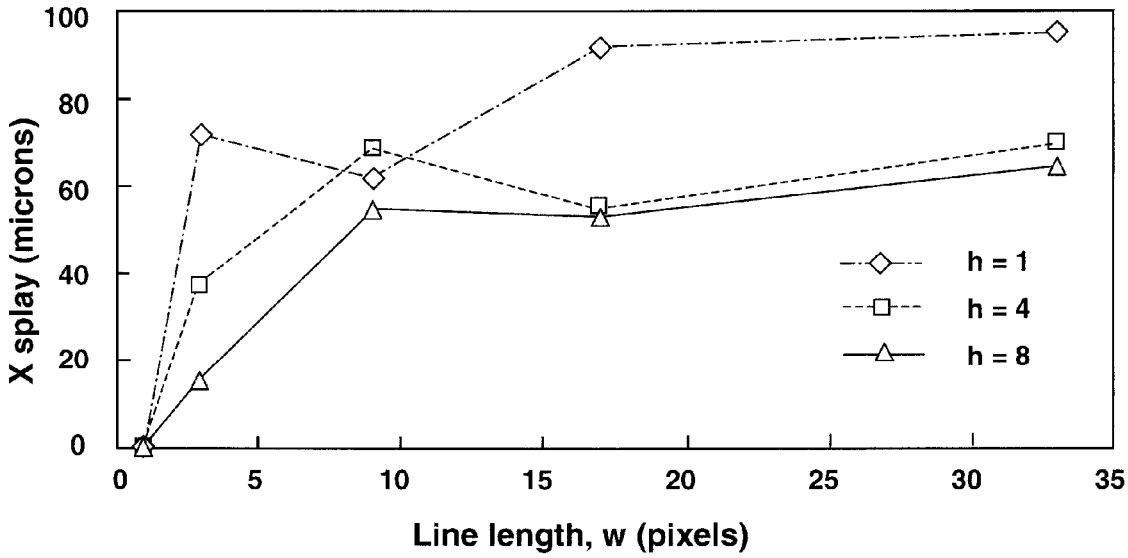

FIGS. 7(*a*) through 14 will now be used to explain a primary aerodynamic interaction effect among drops in the print drop curtain, called "splay" hereinafter. FIGS. 8(*a*) through FIG. 14 are based on print drop experiments wherein the parameters given in Table 1 were the same for all of the experimental results depicted.

FIGS. 7(*a*) and 7(*b*) illustrate input liquid pattern data and a non-experimental, error-free output liquid pattern, respectively. In FIG. 7(*a*) the desired liquid data pattern is represented by darkened pixel areas 304 on an input image plane marked off into an xy-raster grid of possible input pixel positions 302. The pixels have an equal spacing of $S_{px}$ and $S_{py}$ along the x- and y-directions, respectively. Pixels not to be printed with liquid 306 are blank. FIG. 7(*b*) illustrates an error-free liquid pattern printed on a receiver medium 290, also marked off in an xy-raster grid of possible output pixel locations 312 corresponding to the input liquid pattern data pixel positions 302 illustrated in FIG. 7(*a*). The liquid pattern in FIG. 7(*b*) is a representation of a "perfect" liquid pattern, and does not depict the result of an actually printed pattern. Dots of pattern liquid 314 are illustrated as deposited on the receiver medium 290 in perfect xy-correspondence to the input liquid pattern data.

It has been found by the inventor of the present invention that many input liquid patterns are deposited on the output medium with substantial errors in the location of many of the print drops due to aerodynamic interactions among drops as they traverse to the receiver medium. In order to study aerodynamic drop placement effects, it is useful to construct special test patterns that facilitate careful measurements of deviations of deposited drops from the intended xy-locations. FIGS. 8(*a*) and 8(*b*) illustrate a test pattern construct wherein every fourth pixel along the x and y directions are written. FIG. 8(*a*) is the input liquid pattern data 330 and FIG. 8(*b*) depicts the corresponding output liquid pattern 350 printed in an experiment using parameters according to Table 1.

Element number labels in all Figures have the same meaning, as conveyed in the parts and parameters list hereinbelow. It has been found by the inventor of the present invention that a uniform pattern that prints every fourth pixel in two dimensions 330 will be printed substantially free of drop-to-drop aerodynamic interaction errors, as depicted in the undistorted liquid output pattern of the grid 350 in FIG. 8(*b*). The print drop curtain associated with output pattern 350 will traverse to the receiving medium with very small and balanced (in both the x- and y-directions) drop-to-drop aerodynamic interactions.

Figure 9A:
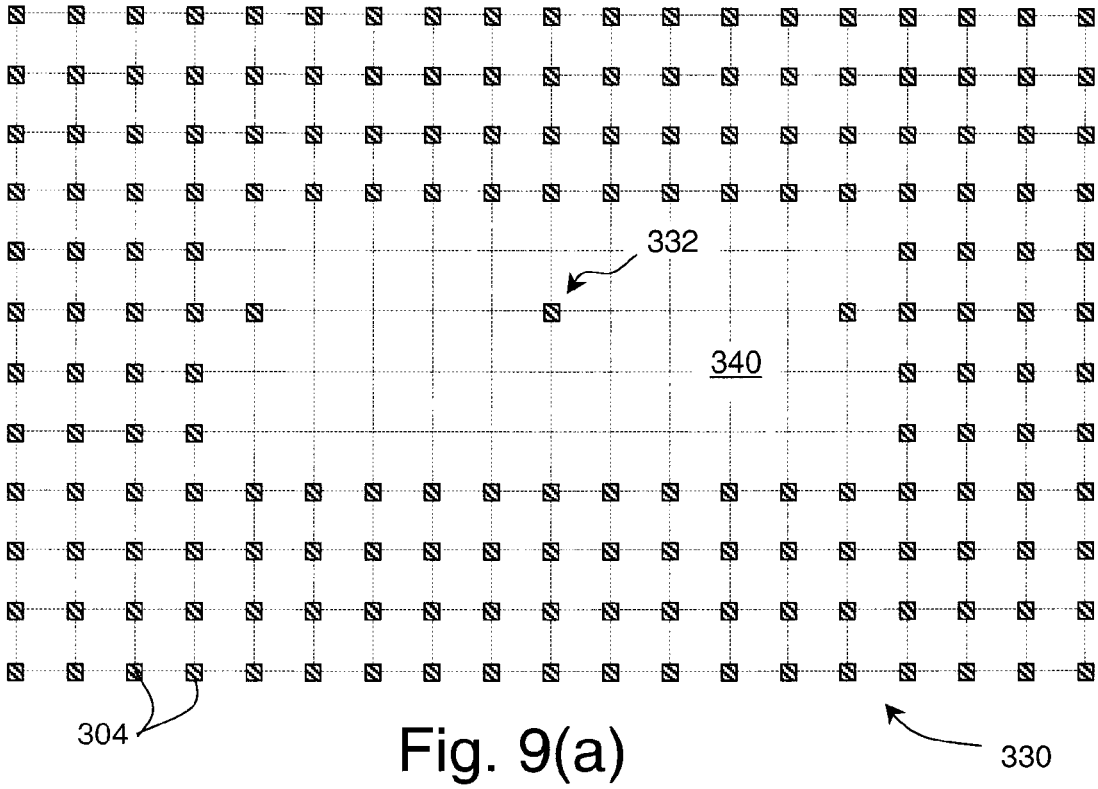
FIGS. 9(*a*) and 9(*b*) illustrate input liquid pattern data and the corresponding output liquid pattern, respectively for a test grid pattern with an isolated test pixel being printed.
Figure 9B:
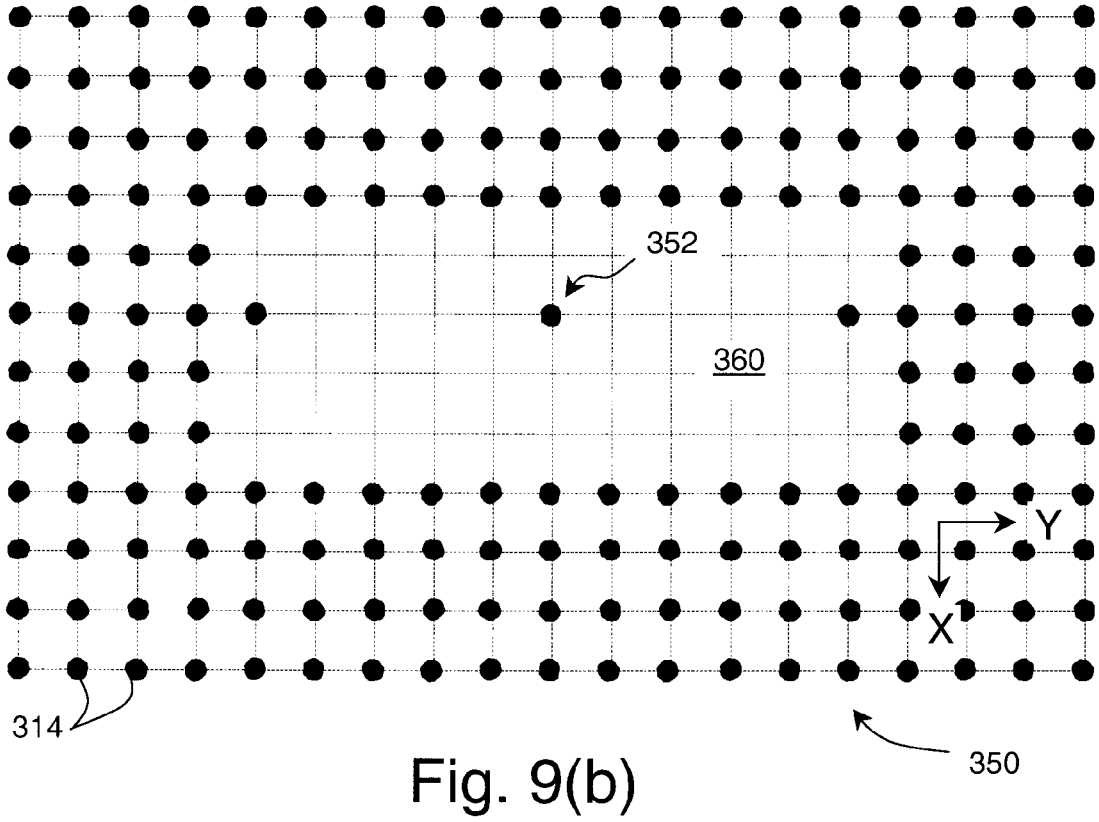

FIGS. 9(*a*) and 9(*b*) depict input and output patterns wherein a central portion of the 4×4 grid pattern previously illustrated is removed to create a voided test area 340 wherein isolated print pixels and print drops in the print drop curtain may be inserted. The portion of the grid pattern that remains in the input pattern will serve to define the location of intended pixel positions in the evacuated central portion through extrapolation of grid lines shown as phantom lines in FIG. 9(*b*). Within the voided central portion 340 a single input pixel 332 has been specified in the input pattern which is printed as isolated print dot 352 in the output pattern void area 360. Isolated print pixel 332 is found to print accurately in a corresponding location 352 in the output liquid pattern image, FIG. 9(*b*).

TABLE 1

Printing Experiment Parameters

| Parameter | Exp. Value | Parameter Description |
|---|---|---|
| $f_0$ | 480 KHz | small drop formation frequency |
| $V_0$ | 2.75 pL | small drop volume |
| $\lambda_0$ | 41.7 μm | small drop separation distance |
| $D_n$ | 10.4 μm | nozzle diameter |
| L | 4.0 | small drop generation ratio |
| m | 4.0 | number of small drops in a print drop |
| $V_m$ | 11.0 pL | large print drop volume |
| $\lambda_m$ | 166.8 μm | large drop separation distance |
| $D_{dm}$ | 27.6 μm | large print drop diameter |
| $S_{px}$ | 42.3 μm | liquid pattern pixel spacing in the x-direction |
| $S_{py}$ | 42.3 μm | liquid pattern pixel spacing in the y-direction |
| $S_n$ | 42.3 μm | nozzle spacing |
| $V_{rel}$ | 27.5 m/sec | net relative velocity of deflecting airflow, +X direction |
| $V_d$ | 20.0 m/sec | drop stream velocity |
| $V_{PM}$ | 5.1 m/sec | media transport velocity, −X direction |

The inventor of the present invention has found that the drop curtain created by the input image depicted in FIG. 9(*a*)

creates sufficient aerodynamic isolation for all drops in the pattern that they print in a substantially undistorted fashion. The isolated drop that prints pixel 352 is traveling no closer than eight times the print drop separation distance, i.e. 8λm, from the next nearest drop. As will be explained further below, the aerodynamic interaction forces are very sensitive to inter-drop separation distances, falling off more than an order of magnitude for separations from 1λm to 8λm.

Figure 10A:
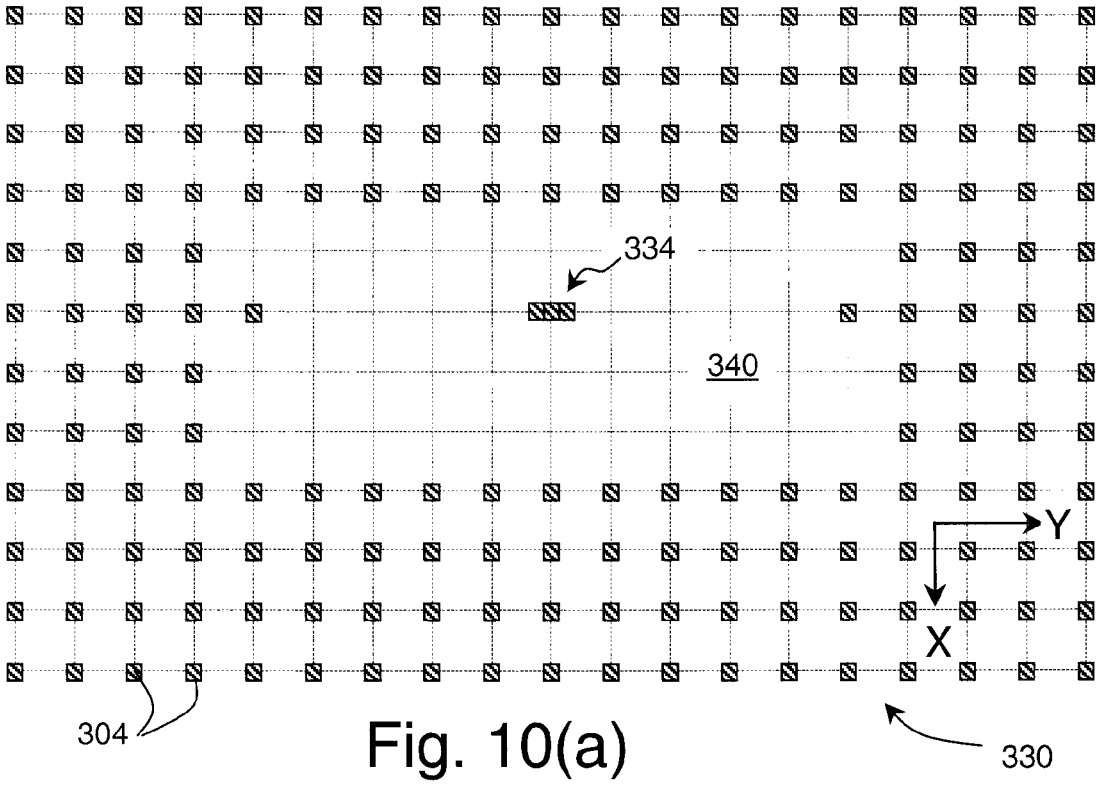
FIGS. 10(*a*) and 10(*b*) illustrate input liquid pattern data and the corresponding output liquid pattern, respectively for a test grid pattern with an row of three isolated test pixels being printed.
Figure 10B:
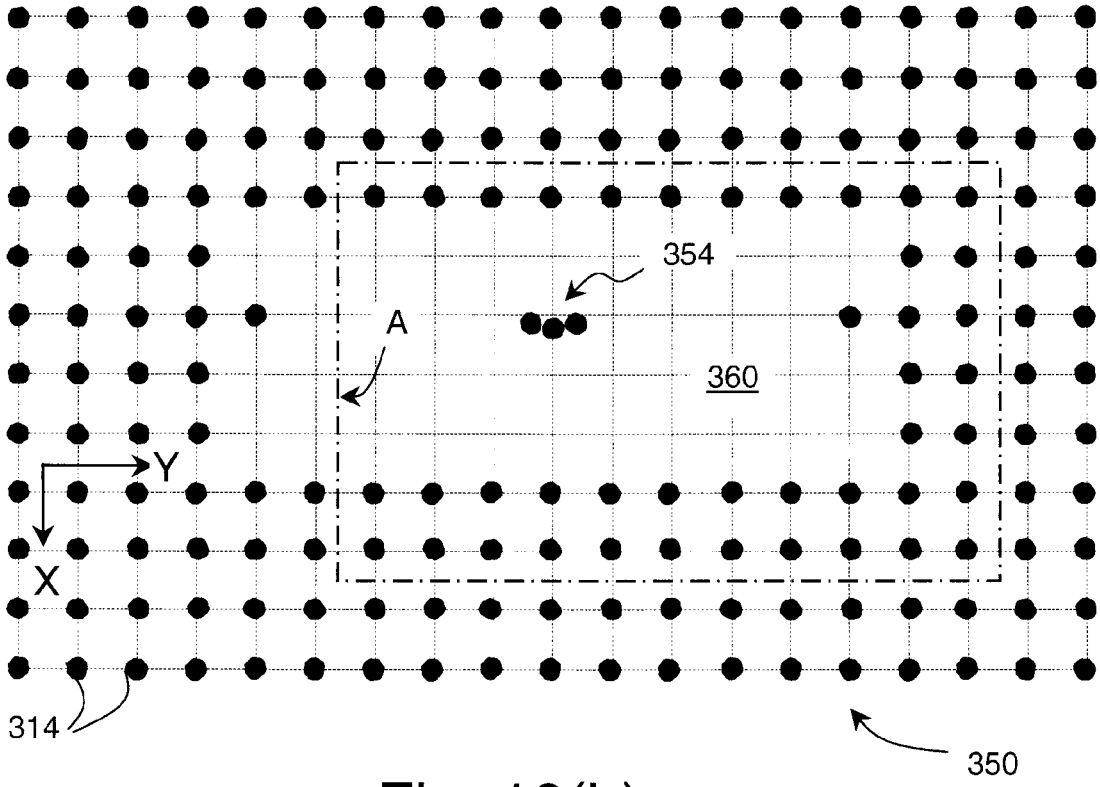

FIG. 10(*a*) shows input liquid pattern data wherein a row of three print pixels 334 is inserted into the central void area 340. The corresponding printed liquid pattern is depicted in FIG. 10(*b*). The row of three printed liquid drops 354 may be seen to be distorted from a straight line. The printed three drop pattern 354 is spread apart from an ideal replication of the input pattern 334. This spreading of the printed drops is termed herein "splay" error and arises because aerodynamic interactions among the three drops as they traverse from their respective printhead nozzles to the receiver medium cause asymmetric forces on the drops because the gas flow fields encountered by each of the three drops are not uniform and symmetric.

Figure 11:
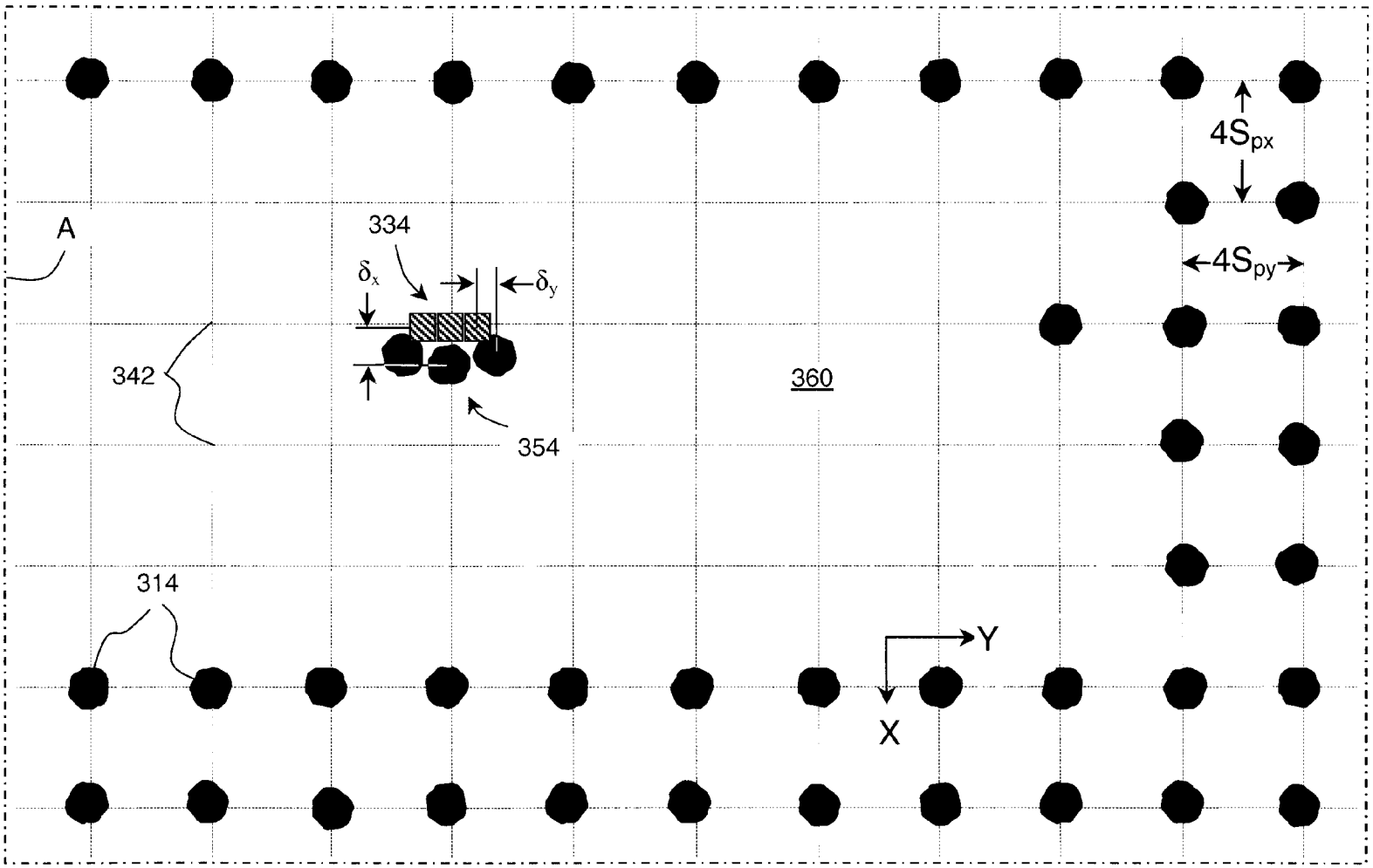
FIG. 11 illustrates the aerodynamic drop placement errors, splay, arising in the liquid pattern of a row of three isolated printed pixels.

An enlargement of the region "A" in FIG. 10(*b*) is illustrated in FIG. 11. An overlay of the three-pixel input pattern 334 has been added to FIG. 11 to show where the print drops would have landed if aerodynamic interaction effects had not caused the splay errors observed. The positions of the grid dots 314 that were omitted in the void area 360 are indicated by the intersections 342 of the phantom grid lines. Maximum splay errors in the x-direction, $\delta_x$, and in the y-direction, $\delta_y$, are indicated as the maximum deviations of the printed drops 354 from the ideal positions 334. The maximum y-splay error measured in the three pixel line was $\delta_y$ ~28 μm; and the maximum x-splay error measured was $\delta_x$ ~72 μm. That is, for an isolated three drop line, maximum splay errors in the y-direction were more than one-half a pixel spacing ($S_{py}$=42.3 μm) in magnitude; and maximum splay errors in the x-direction were more than a pixel spacing ($S_{px}$=42.3 μm). Errors of this magnitude may be visible to an observer if they occur in an image wherein the pattern is expected and recognizable, such as in text printing with fine font features. For example, FIG. 24(*a*) discussed hereinbelow illustrates the distortion of test characters that may arise when aerodynamic splay mechanisms of this magnitude are present.

Figure 12:
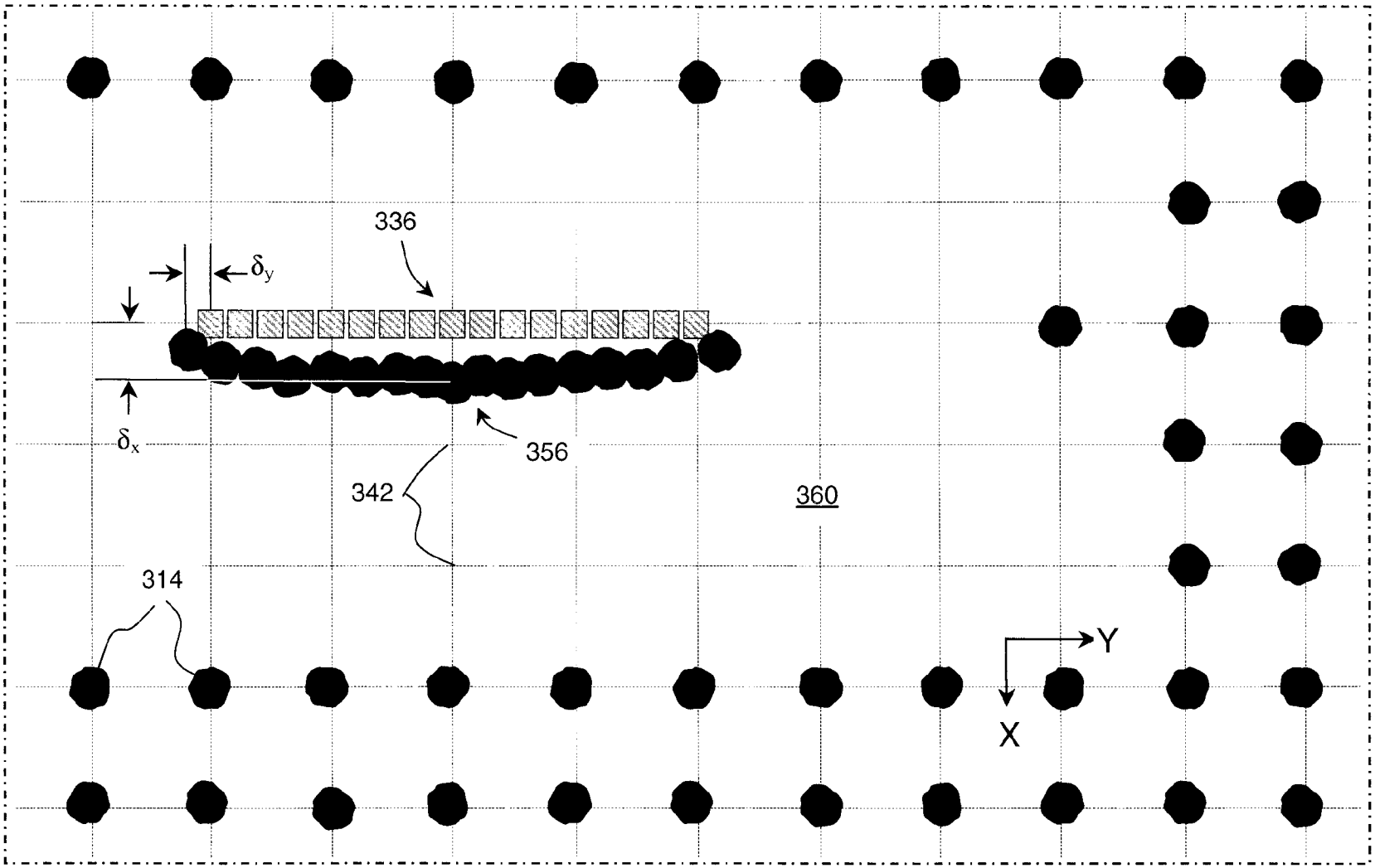
FIG. 12 illustrates the aerodynamic drop placement splay errors arising in the liquid pattern of a row of seventeen isolated printed pixels.

FIG. 12 depicts a similar portion of an output printed image area as in FIG. 11. The input liquid pattern data included a line 336, w pixels long, w=17 pixels, which printed as liquid drop pattern 356 in voided test pattern area 360. As for FIG. 11, the x- and y-direction maximum splay errors are indicated. For this longer line of drops traversing to the receiving medium, the maximum y-splay error has grown to $\delta_y$ ~41 μm, nearly a full pixel-spacing of error. The maximum x-splay error has grown to $\delta_x$ ~92 μm, more than twice the pixel spacing.

Figure 13:
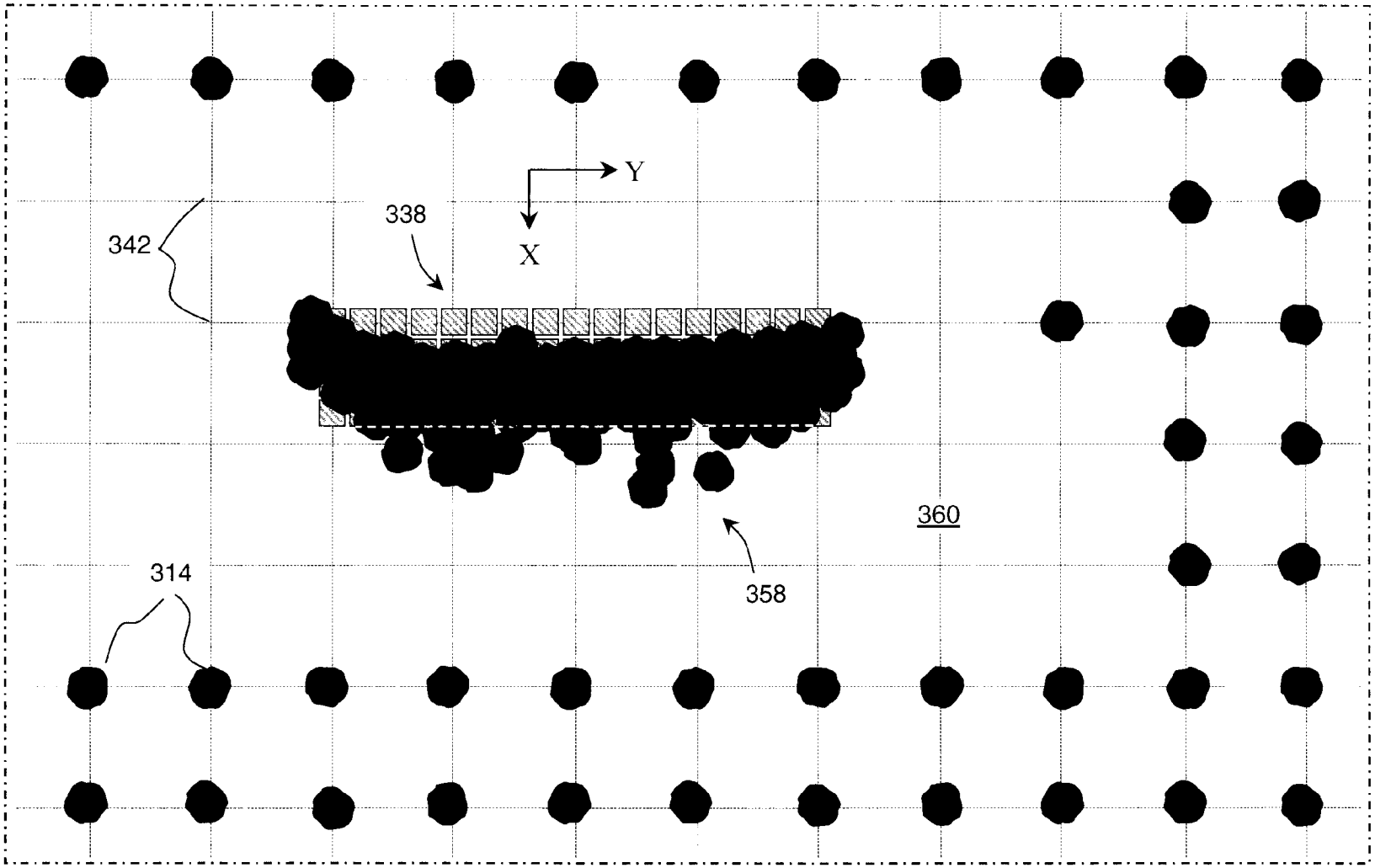
FIG. 13 illustrates the aerodynamic drop placement splay errors arising in the liquid pattern of a group of four by seventeen isolated printed pixels.

FIG. 13 also depicts a similar portion of an output printed image area as in FIG. 11. The input liquid pattern data included a broader input line pattern 338, having a width, h, in pixels, h=4, and a length, w, in pixels, w=17, which printed as liquid drop pattern 358 in voided test pattern area 360. Severe distortion of the 4×17 pixel line is observed. It may appreciated from the experimental results depicted in FIGS. 11-13, that aerodynamic splay errors may cause drop misplacements of one or more pixel spacing's in magnitude and be highly variable depending on the input image pattern. Such errors may severely degrade output image or liquid pattern quality.

FIGS. 14(*a*) and 14(*b*) shows plots of compilations of the maximum measured y- and x-splay errors, respectively, for input line patterns of widths h=1, 4 or 8 pixels and lengths of w=1, 3, 9, 17 and 33 pixels. The maximum y-splay error was always found to be in the placement of the end drops of the various drop line patterns tested. The $\delta_y$ and $\delta_x$ errors for this set (Table 1) of experimental system parameters were zero for all of the lines of single pixel length (w=1). That is, even the line that was 8 pixels high (h=8) and one pixel long (w=1) printed without appreciable x- or y-direction splay error.

Examining FIG. 14(*a*), it may be seen that when three pixel long lines were printed, the y-direction splay error jumps from zero to 28 μm-38 μm, depending on line width. Increasing the line length further only modestly increases y-splay error, which appears to decline to or saturate around 38 μm for lines 33 pixels in length. The width of the line does not strongly influence the y-splay magnitude. Examining FIG. 14(*b*), it may be seen that the x-direction splay error jumps up from zero at a one pixel line length to a substantial amount for a three pixel long line. In addition, the amount of x-splay error is strongly influenced by the line width in the range illustrated, h=1 to 8.

The maximum y-direction splay plotted in FIG. 14(*a*) always occurred for drops at the ends of the test line patterns. It is apparent that inter-drop aerodynamic forces have the effect of spreading the drop line out, but that this effect saturates quickly. The indication is that the y-direction forces generated are very "short range" in terms of pixel distances. That is, the asymmetric forces on the drops at the ends of drop line patterns are fully developed by the time the line is nine drops long. Further lengthening of the line does not significantly change the asymmetric y-direction forces experienced by the end drops.

The maximum x-direction splay errors occur for drops in the central region of the printed drop line. It may be appreciated from the data plotted in FIG. 14(*b*) that x-direction splay errors may range up to distances of more than twice the pixel spacing, $S_{px}$=42.3 μm, for the 600 spot/inch system tested.

The aerodynamic interactions among print drops traversing the space between the nozzle array where they are generated and the receiver medium where their relative trajectories are finally "terminated" is exceedingly complex. The aerodynamic interactions were included and analyzed by the use of standard three-dimensional computation fluid dynamic (CFD) modeling techniques. However, before describing the three-dimensional CFD model results, it is helpful to examine a closed-form analysis of a two-dimensional model of the inter-drop aerodynamic interactions.

Figure 15:
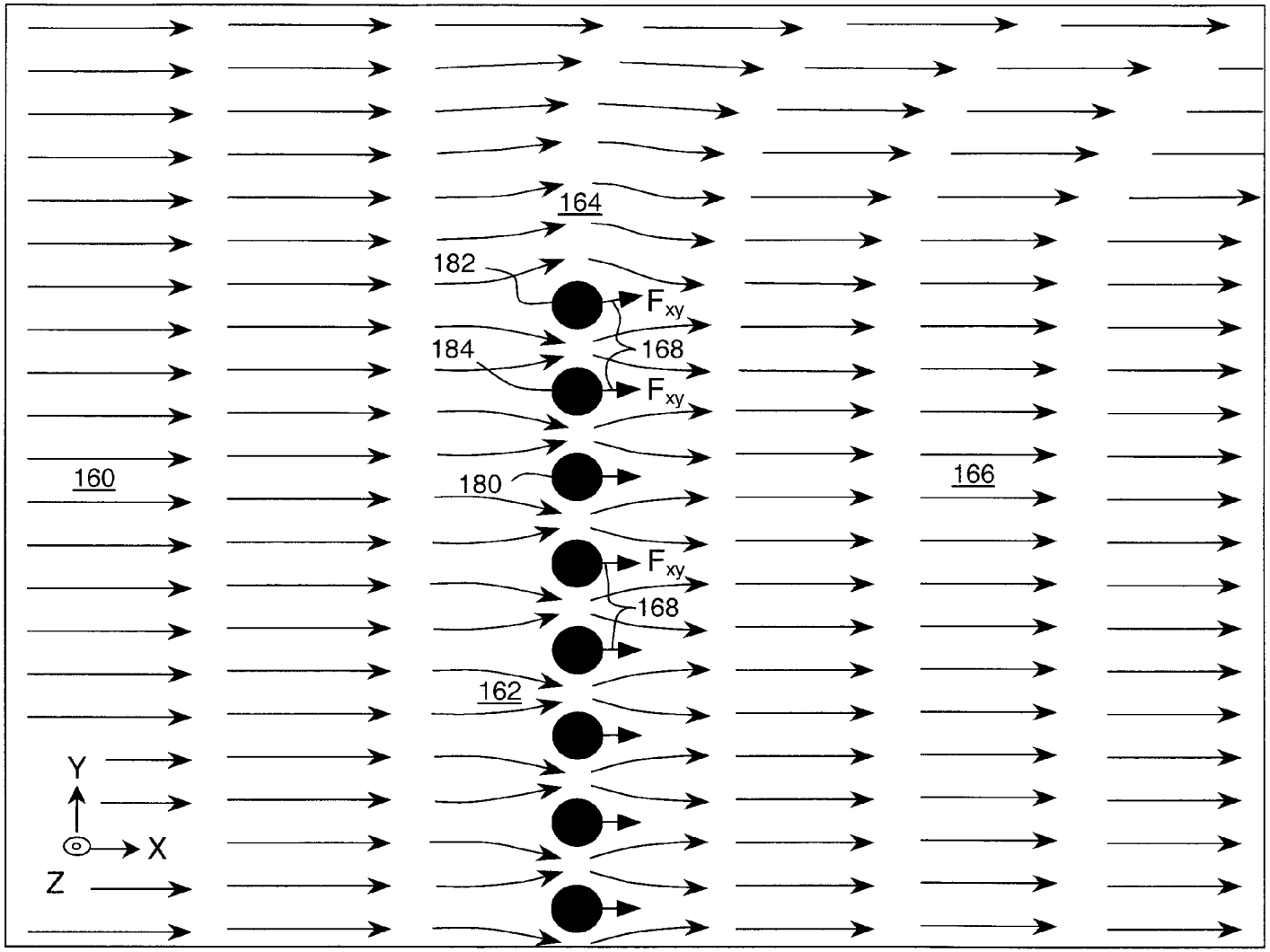
FIG. 15 illustrates the gas flow environment of a line of print drops in transit to the receiving medium.

FIG. 15 illustrates an idealized representation of the geometrical configuration and aerodynamic effects experienced by a line of print drops traversing the central portion of the gas deflection zone of a continuous drop printhead according to the present invention. FIG. 15 shows a cross-sectional view in the xy-plane of the end eight drops of a line print drops wherein w=16 and h=1, in the xy-plane. For this example analysis, the deflection gas flow 160, represented by arrows, is aligned with the x-direction (as in FIG. 6), and has a magnitude of $v_x$. The drop line is extended along the y-direction, i.e. the flying drop line illustrated has been generated simultaneously as print drops from a group of adjacent jets in a nozzle array aligned along the y-direction. The drop line velocity is primarily in the negative z-direction, magnitude $v_d$, which is perpendicularly into the "paper plane" of FIG. 15.

As the drops traverse the deflection gas flow field, they will all be accelerated in the x-direction somewhat by the aerodynamic drag effects of the deflection field gas flow. Stepping back to FIG. 6, it may be appreciated that the non-print drops, the small drops in this analysis example, are accelerated substantially more in the x-direction than are the large print drops. The small, non-print drops are accelerated so greatly in the x-direction that they follow trajectories that strike the drop capture lip 152 as illustrated in FIG. 6. The analysis herein assumes that the non-print drop curtain has been sufficiently separated from the print drop curtain that any aerodynamic effects of the small drops on the print drops may be ignored.

The curved gas flow arrows in FIG. 15 depict the asymmetrical gas flow 164 around the outer drop 182 of the drop line. Also depicted by converging curved arrows is the gas flow 162 that crowds between drops such as interior drops 180 of the drop line. The gas flow 166 downstream of the drop line may be slightly diminished in velocity over the initial magnitude. This is conveyed in exaggerated fashion by depicting shorter arrows on the downstream side of the central portions of the drop line. The net aerodynamic deflection force on a drop in the xy-plane, $F_{xy}$, is also illustrated by a force vector 168 beginning at each drop. The directions of the force vectors 168 are drawn to illustrate that the end drop 182 experiences a deflection force with a significant y-component. The next-to-the-end drop 184 in the drop line experiences a deflection force having a very slight y-component. Interior drops 180 are deflected with little or no y-component force.

Figure 16:
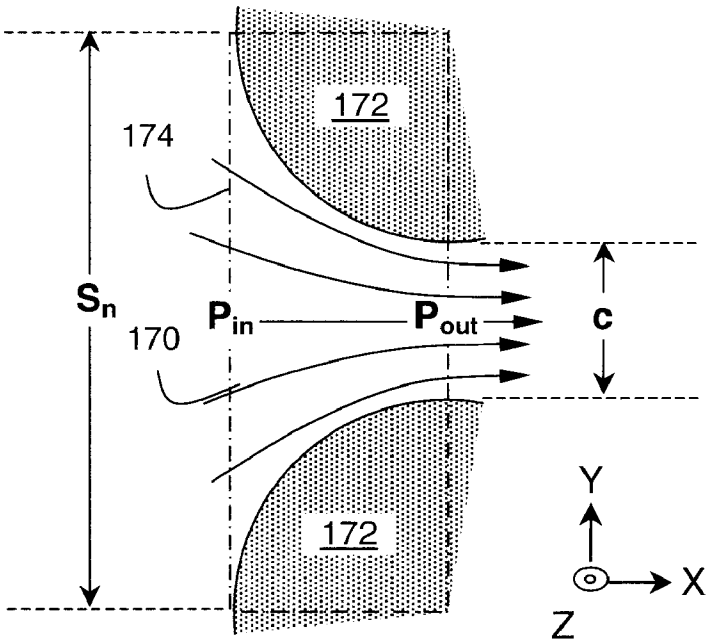
FIGS. 16(*a*) and 16(*b*) illustrate the configuration used to apply a two-dimensional model of the airflow around print drops, viewed as a line of cylinders between and around which the gas must flow.
Figure 16A:
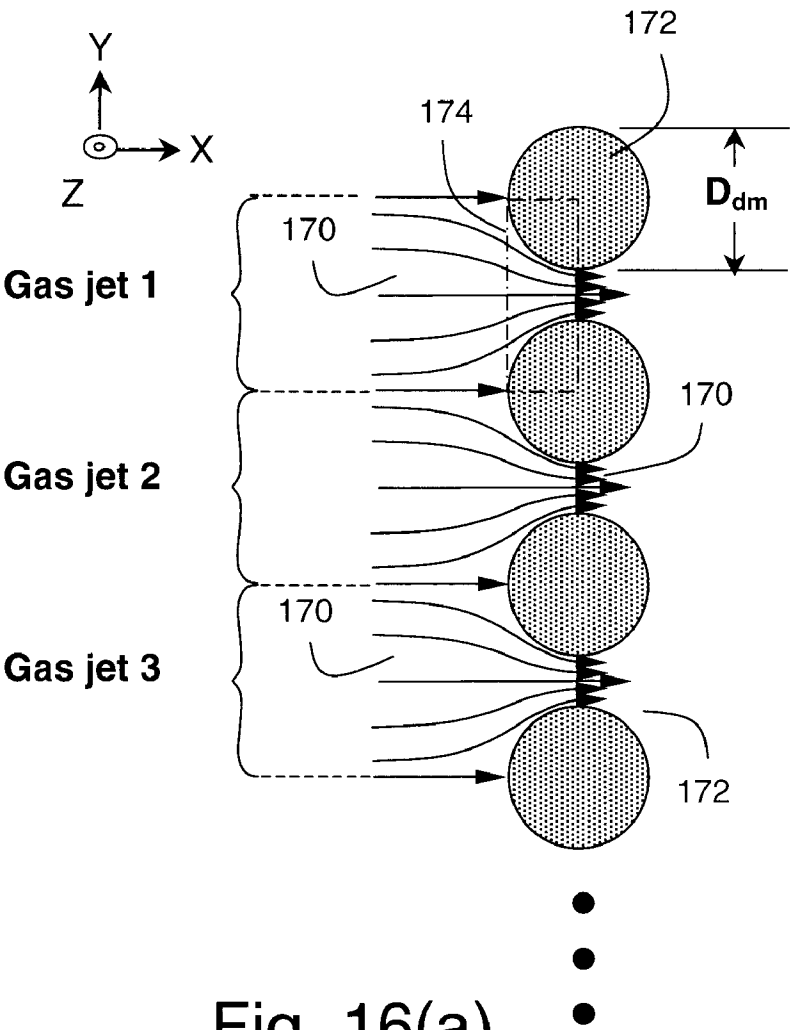

A two-dimensional approximation of the gas flow around drops in a drop line such as that in FIG. 15 may be constructed by examining the gas flow around a line of infinitely long spaced apart cylinders. This geometry is illustrated in FIGS. 16(*a*) and 16(*b*). The Figures depict the xy-plane and the cylinders extend infinitely in the z-direction. FIG. 16(*b*) illustrates enlargement of the area 174 of FIG. 16(*a*) wherein the two-dimensional computation will be performed to model the gas flow around the cylinders 172. Cylinders 172 represent drops in flight in a drop line arrayed along the y-direction, and are given a diameter of $D_{dm}$, the print drop diameter, separated by a distance $S_n$, the drop emitter nozzle spacing. The deflection gas flow of magnitude $v_{in}$ is initially aligned in the x-direction and is modeled as dividing and traversing between cylinders in the form of two-dimensional gas jets 170. The pressure drop, $\Delta P=P_{in}-P_{out}$, of the gas flow through the drop line is modeled as a gas flow nozzle having the shape of two half cylinders having an open separation or spacing therebetween, c, wherein $c=S_n-D_{dm}$.

A continuity of mass flow equation and Bernoulli's equation are used to calculate the pressure drop, ΔP, for the gas flow passing between cylinders. Making the simplifying assumptions that the gas flow is steady, inviscid, incompressible, along a streamline, unaffected by gravity and is uniform at the entrance and exit of the gas flow jets, then continuity of mass flow gives the following relationship:

$$v_{in}S_n=v_{out}c, \tag{1}$$

where $v_{in}$ is the initial net x-direction deflection gas flow velocity and $v_{out}$ is the net x-direction gas flow velocity in the gap between cylinders. And, further, Bernoulli's equation leads to the following relationships for the change in pressure, ΔP, as gas flows between the cylinders:

$$P_{in}+\frac{1}{2}\rho v_{in}^2=P_{out}+\frac{1}{2}\rho v_{out}^2, \tag{2}$$

$$\Delta P=\frac{1}{2}\rho(v_{out}^2-v_{in}^2), \tag{3}$$

$$\Delta P=\frac{1}{2}\rho v_{in}^2\left(\frac{S_n^2}{c^2}-1\right), \tag{4}$$

$$\Delta P=\frac{1}{2}\rho v_{in}^2\left(\frac{2}{c*}+\frac{1}{c*^2}\right), \text{ and} \tag{5}$$

-continued $$\overline{\Delta P}=2\Delta P/\rho v_{in}^2, \tag{6}$$

where $c^*=c/D_{dm}=(S_n/D_{dm}-1)$ and ρ is the mass density of the deflection gas (air). c* is the normalized value of the open clearance separation, c, i.e. normalized by the drop diameter, $D_{dm}$. $\overline{\Delta P}$ is the normalized pressure change, the pressure change ΔP expressed in units of $(\frac{1}{2}\rho v_{in}^2)$. The normalized clearance separation distance, c*, has been found by the present inventor to be a useful parameter to calculate in order to model the magnitude of inter-drop aerodynamic interactions for a range of drop sizes and separation distances of interest for high quality, high speed liquid pattern printing and deposition.

Figure 17:
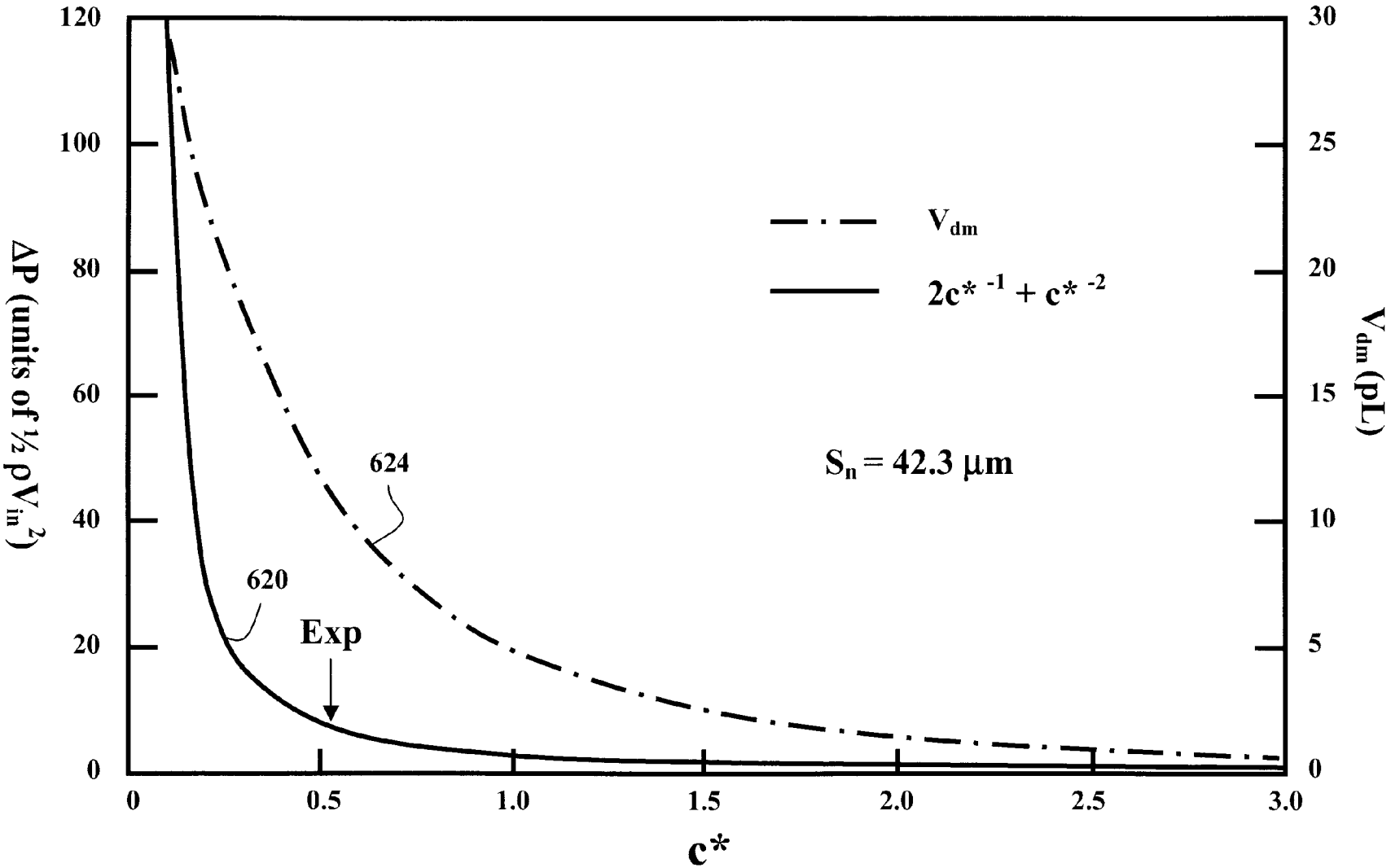
FIG. 17 shows a plot of the results of two-dimensional modeling of the pressure drop of gas flow passing between drops in a drop line.

The normalized pressure change, $\overline{\Delta P}$, estimated by Equation 6 is plotted as curve 620 in FIG. 17 as a function of c*. Also plotted in FIG. 17 is the print drop volume, $V_{dm}$, that would result in the c* values on the abscissa when the drop separation (equal to the nozzle separation in this model calculation) is 42.3 μm, the appropriate nozzle separation for a 600 jet/inch printhead. The print drop volume relation 624 is plotted in picoLiter (pL) units. The pressure increase that occurs as a result of the gas flow crowding between drops in a drop line is the primary cause of y-direction splay error. The increased pressure, ΔP, while balanced for interior drops of a print drop line, is not fully balanced for the end drops, resulting in a net force on the drop outward, in the y-direction.

It may be appreciated from studying the c* terms in Equation 5, and curve 620 in FIG. 17, that the unbalanced pressure, $\sim\overline{\Delta P}$, that acts upon end drops, is very sensitive to c*, falling off two orders of magnitude over the range c*=0.1 to 2.1. For a selected nozzle spacing, for example, $S_n$=42.3 μm for 600 jets/inch, c* will have values over this range for drop volumes of 29.6 pL down to 1.3 pL. The experimental results depicted in FIGS. 8(*b*), 9(*b*), 10(*b*), 11, 12, 13 and 14 were for 11 pL drops, a c* value of 0.53, indicated by the arrow labeled "Exp" in FIG. 17.

The two-dimensional model calculations discussed above are rough approximations because of the two-dimensional assumption of cylinders instead of spherical drops, and because inviscid flow was assumed. Nonetheless, this straightforward model serves to show how sensitive splay errors are to the normalized inter-drop clearance length, c*. For the experiments reported above using 11 pL print drops spaced 42.3 μm apart along a drop line, adjacent drops in a print drop line have normalized separation clearance lengths, c*=0.53, and a corresponding normalized pressure change from Equation 6 of $\overline{\Delta P}$=7.33. For the printed grid drops in the experimental printed images, spaced four pixels apart, the normalized inter-drop clearance between adjacent print drops as they traverse to the receiver is $c^*=4\ S_n/D_{dm}-1=5.13$. The corresponding normalized pressure change from Equation 6 is $\overline{\Delta P}$=0.43, which is only 6% as large as the drops spaced a single pixel raster distance apart.

This result helps explain why the grid drops 314 bordering the sides of the test pattern void areas 360 in FIG. 10(*b*) or 11, for example, do not exhibit y-direction splay error, even though they are not "balanced" by equally spaced print drops on either side along the y-direction. This experimental result, qualitatively confirmed by the two-dimensional model results, discussed above, indicates that increasing c* can effectively reduce the aerodynamic forces driving splay error.

The inventor of the present invention has also carried out numerous three-dimensional calculations analyzing drop-to-drop aerodynamic interactions utilizing commercially available computational fluid dynamics (CFD) software tools. These calculations consume very significant amounts of computational resources; however, they provide a more realistic simulation and analysis of the effects observed in liquid drop printing experiments than do closed form mathematical techniques. The results described in the following paragraphs were obtained using the Flow-3D CFD modeling software (available from Flow Science Inc, 683 Harkle Road, Santa Fe, N. Mex. 87505), using the generalized moving object model to model the drops as rigid spheres embedded in a surrounding fluid of air. The spheres were modeled to have the same density as the print drops, and were free to move but coupled with the surrounding fluid. That is, the fluid exerted forces on the drops, causing them to accelerate, while the drops exerted a corresponding reaction force on the fluid, altering its momentum and flow pattern. The spheres displaced fluid volume commensurate with the drop size, which also altered the fluid flow patterns.

Figure 18C:
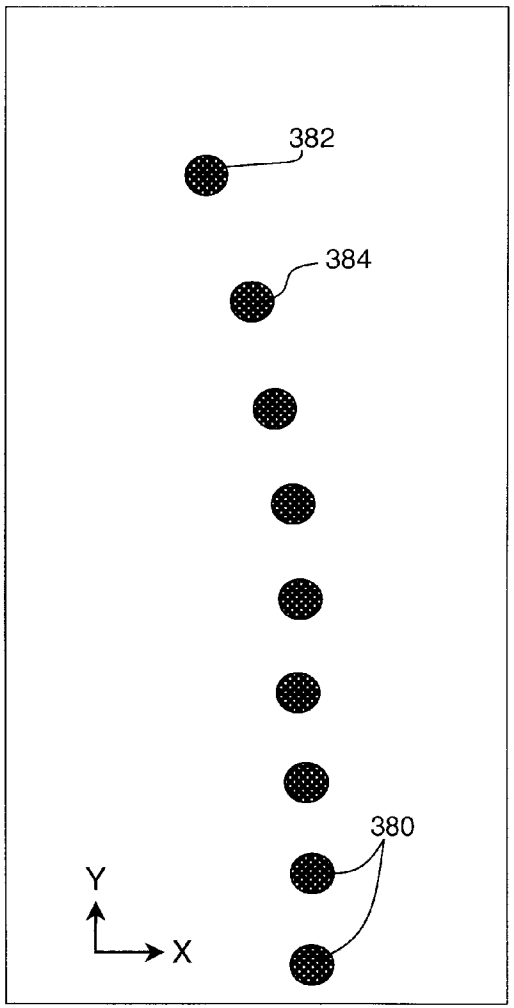
FIGS. 18(*a*), 18(*b*) and 18(*c*) illustrate the positions in the xy-plane of drops in a line of drops transiting to the receiving medium before entering the gas flow deflection zone, well within the gas flow deflection zone, and upon impact at the receiving medium, respectively based on computational fluid dynamic modeling.
Figure 18B:
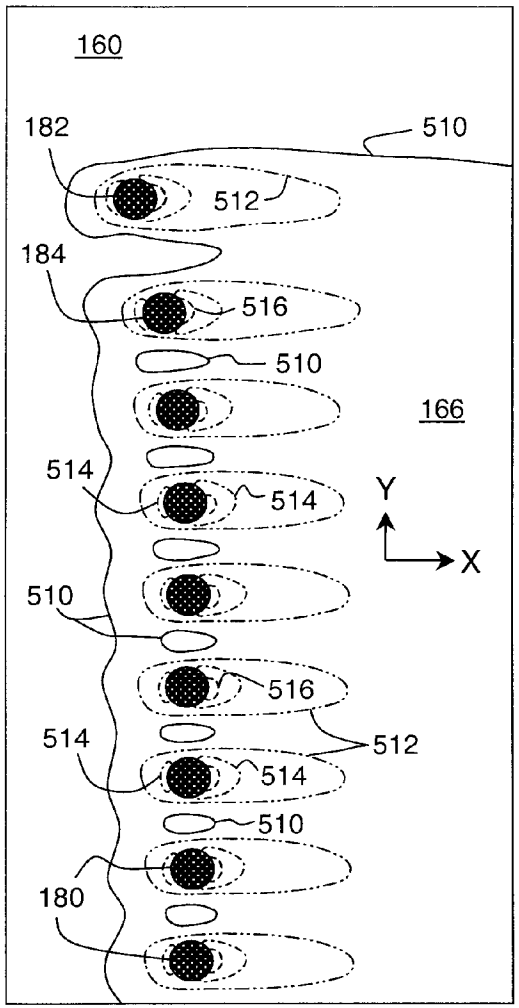
Figure 18A:
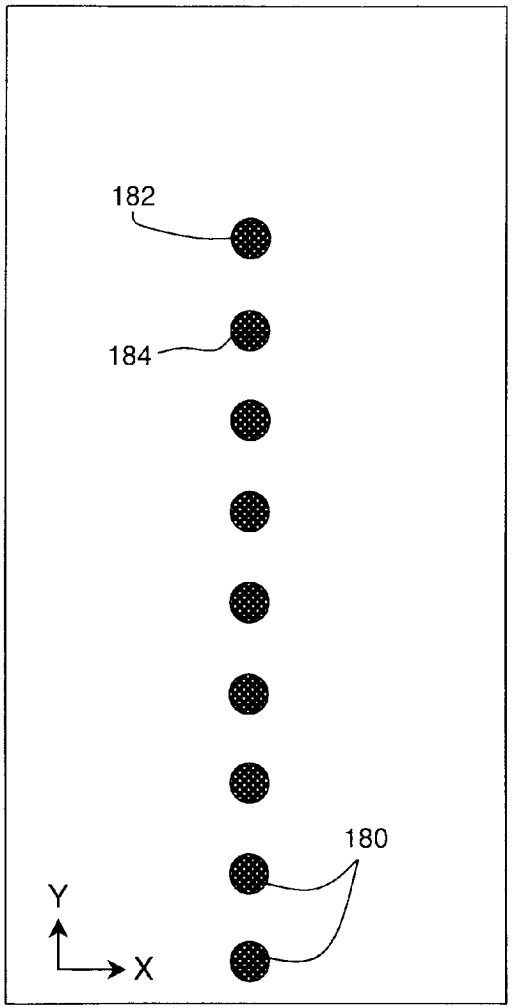

FIGS. 18(*a*), 18(*b*) and 18(*c*) illustrates results of CFD calculations for a similar print drop line configuration drawn in FIG. 15 and partially modeled using a two-dimensional approximation (Equations 1-6). In FIGS. 18(*a*)-18(*c*), the CFD model print drops are 4 pL, 19.7 μm in diameter, and are emitted with a center-to-center spacing of 42.3 μm along the y-direction. Therefore, the normalized drop separation clearances in the y-direction, $c_y^*$, are $c_y^*$=(42.3 μm/19.7 μm−1)=1.14. FIGS. 18(*a*) through 18(*c*) illustrate CFD calculated "snapshots" of a print drop line at three different times: 18(*a*) when the print drops are initially formed; 18(*b*) after the drop line has dwelled within the gas flow deflection zone for most of the length of the zone; 18(*c*) at the time of arrival at the receiver medium plane. The drop positions are illustrated in xy-planes at approximately the same scale and position relative to one another.

Note that in FIG. 18(*c*) interior drops 380, end drop 382 and next-to-the end drop 384 have not actually impacted a receiver medium, such as paper, and so have not spread in diameter as they have in the similar, actual printed drop line pattern depicted in FIG. 12. Also the print drops simulated in FIG. 18(*c*) are smaller than those used in the experiment depicted in FIG. 12. Consequently, for both reasons, the print drop line at the receiver medium plane depicted in FIG. 18(*a*) does not have the "filled-in" appearance of the similar line printed in FIG. 12. Nonetheless, comparing FIG. 18(*c*) and FIG. 12, it is readily apparent that the CFD calculation captures the primary splay error effects observed in print drop experiments.

FIG. 18(*b*) also illustrates contours of air flow velocity calculated by the CFD model. The initial deflection airflow 160, $v_x$, has a velocity magnitude of 20 m/sec. Contour 510 represents a slightly reduced air flow velocity, ~19 m/sec., illustrating where the initial velocity magnitude begins to be diminished by the flow obstacle presented by the drop line. Contour 510 is also found at locations between print drops in the drop line. Contours 512, 514 and 516 then represent contours of reduced air velocity, draw at approximately 15 m/sec, 10 m/sec, and 5 m/sec, respectively. The region downstream 166, behind the center of the drop line, has an air velocity value of ~17 m/sec., somewhat less than the initial velocity 160.

The shape of the airflow velocity contours around end print drop 182 and next-to-end print drop 184 show the asymmetries that lead to splay error, especially in the y-direction. The general curvature of the 510 air velocity contour toward the center of the print drop line shows the aerodynamic effect that leads to x-direction splay, drops in the center of the line are deflected farther in the x-direction than are drops on the ends of the print drop line.

Figure 19:
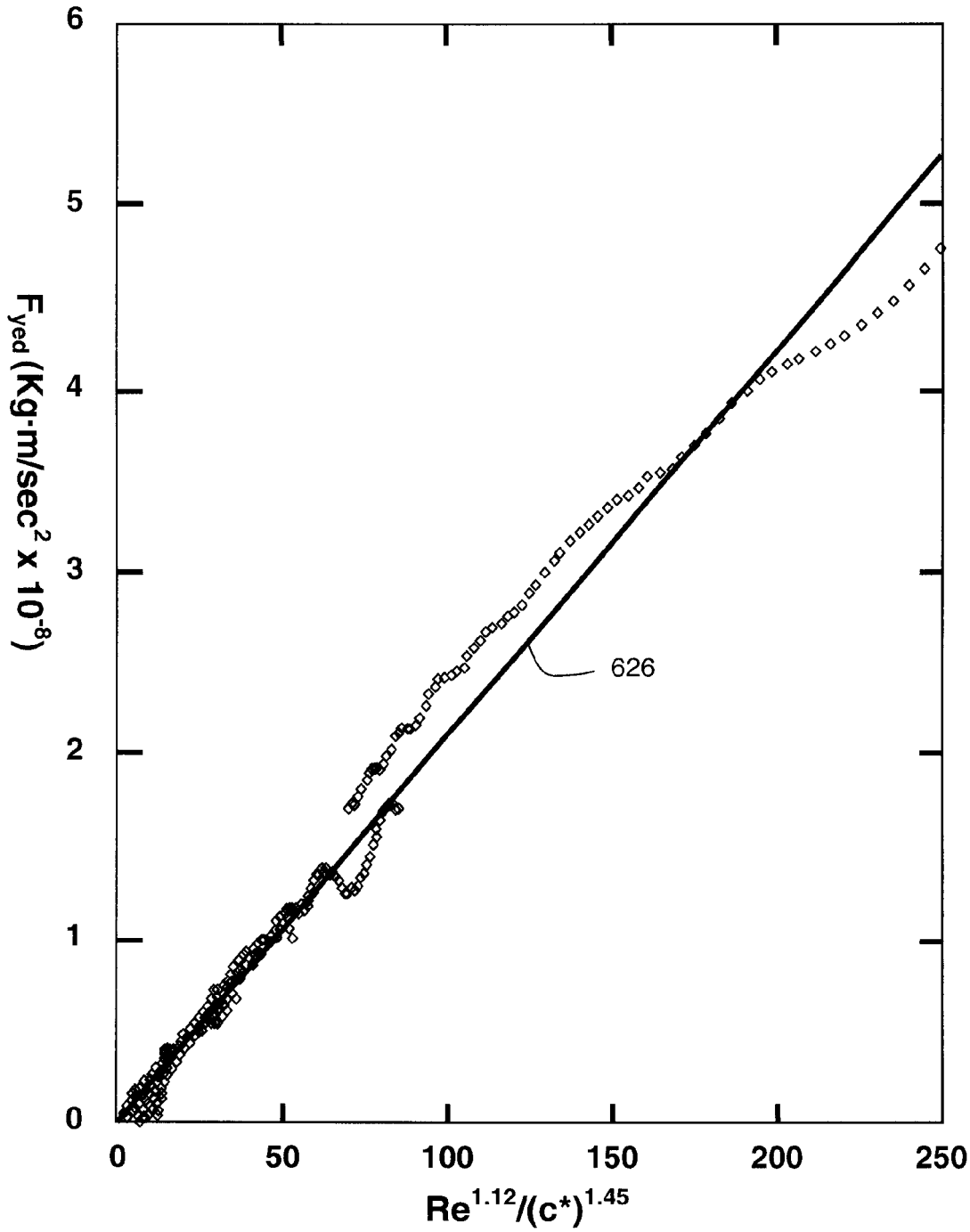
FIG. 19 shows a plot of the results of three-dimensional computational fluid dynamic modeling of the aerodynamic splay forces in the y-direction for many choices of the Reynolds number and normalized inter-drop spacing.

FIG. 19 summarizes the results of CFD calculations for many print drop line simulations involving different relative air flow velocities, $v_{relx}$, print drop diameters and values of the normalized inter-drop clearance, c*. The relative air flow velocity $v_{relx}$ is the difference between the overall deflection air flow velocity $v_x$ and a drop's lateral velocity $v_{dropx}$; $v_{relx}=v_x-v_{dropx}$. A Buckingham-Pi analysis of the many CFD calculation results was performed in order to identify sensitive controlling system parameters that might be adjusted to reduce splay errors. Details of how to perform a Buckingham-Pi analysis may be found in Fox, McDonald and Prichard, "Introduction to Fluid Mechanics," Wiley, 2004.

For the purpose of understanding the present invention, the result of a Buckingham-Pi analysis for the y-direction splay force on the end drop of a print drop line, $F_{yed}$, was performed. It was found that $F_{yed}$ is usefully described as a function of two dimensionless parameters, the Reynolds number, Re, and the normalized inter-drop clearance length, c*, previously described. That is, the following relationships were found to nearly capture the results of all of the CFD calculations in a single relationship for $F_{yed}$:

$$Re = \frac{\rho v_{relx} D_{dm}}{\mu}, \tag{7}$$

$$F_{yed} = (2.2\times10^{-10}N)\frac{Re^{1.12}}{c^{*1.45}}, \tag{8}$$

where μ is the deflection gas (air) viscosity and the other parameters have been previously defined. Equation 8 is plotted as the straight line 626 in FIG. 19. Individual calculations of $F_{yed}$ using CFD software tools are plotted as diamonds on FIG. 19.

The CFD modeling results and Buckingham-Pi parameter analysis results captured in FIG. 19 show that y-direction splay is primarily driven by the Reynolds number, Re, to the 1.12 power and by the normalized inter-drop clearance length c* to the inverse 1.45 power. Based on the analytical and computational understanding of splay-error forces described hereinabove, the inventor of the present inventions has realized that splay errors may be reduced, most significantly, by developing drop printing methods and apparatus that increase the normalized inter-drop clearance lengths among drops in the print drop curtain.

Figure 20A:
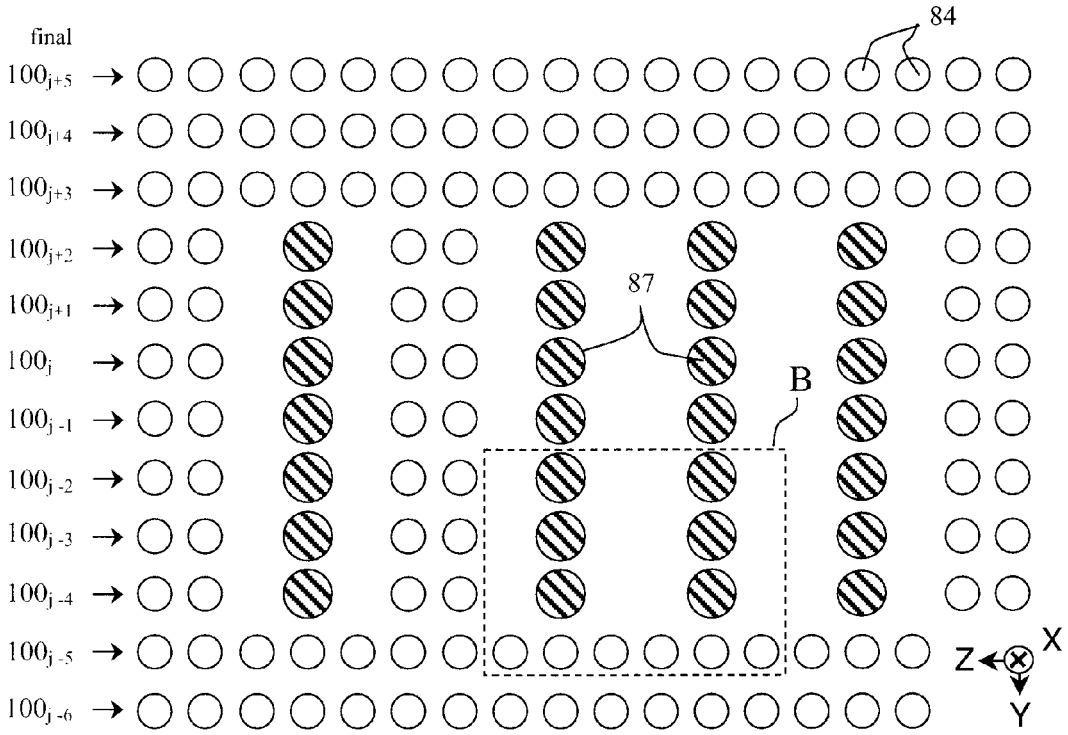
FIGS. 20(*a*) and 20(*b*) illustrate a pattern of print and non-print drops for twelve jets of an array of jets and the corresponding drop forming pulse sequences applied to the drop stimulators of those jets, respectively.
Figure 20B:
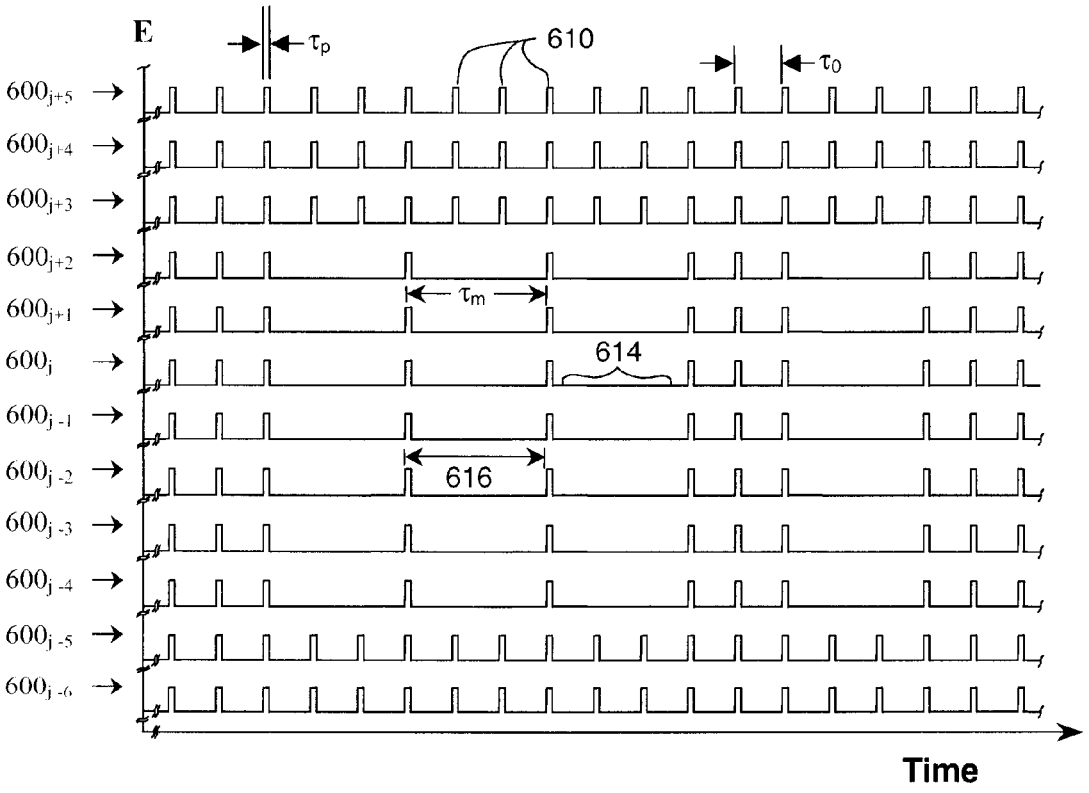

A portion of a drop curtain produced by a multi-jet continuous drop emitter is illustrated in FIG. 20(*a*). Twelve streams of drops of predetermined volumes 100 are illustrated. The twelve-jet or nozzle portion of the drop curtain is depicted in a yz-plane formed by the drop curtain before the gas flow deflection system has separated the non-print small drops 84 from the print drops 87. The print drops in this example illustration are formed to be three times the volume of the small print drops: m=3, $V_m$=3 $V_0$.

A representation of the drop forming pulse sequences 600 that were applied to the twelve drop forming transducers associated with the twelve jets to create the FIG. 20(*a*) drop curtain pattern is illustrated in FIG. 20(*b*). Drop forming energy pulses 610 of duration $\tau_p$ separated in time by a small drop forming periods of $\tau_0$ cause the formation of small drops of volume $V_0$. Drop forming pulses applied over a large drop forming time period 616, $\tau_m$, cause the break-up of a fluid stream into liquid elements that coalesce into a drop having the volume emitted during that period, $\tau_m$. The formation of drops of multiple predetermined volumes was discussed above with respect to FIGS. 5(*a*)-5(*c*). For the example in FIGS. 20(*a*) and 20(*b*), $\tau_m=3\ \tau_0$.

Figure 21A:
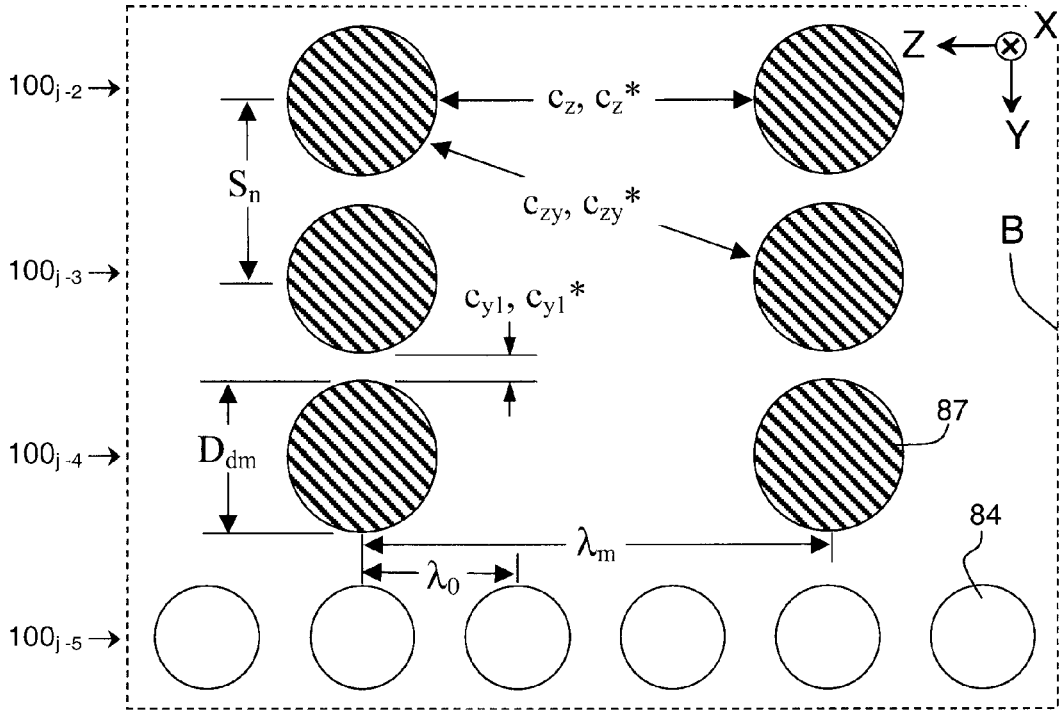
FIG. 21(*a*) illustrates an enlarged view of portion B of FIG. 20(*a*) and FIG. 21(*b*) illustrates an enlarged view of portion C of FIG. 22(*a*)
Figure 21B:
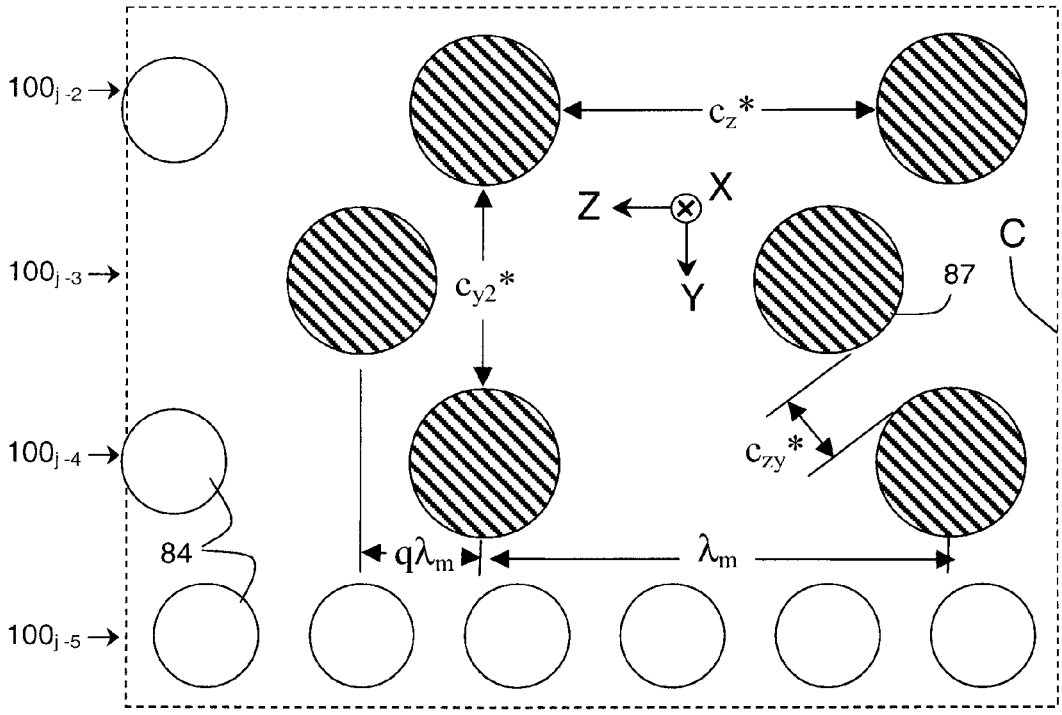

The portion of FIG. 20(*a*) labeled "B" has been enlarged and reproduced as FIG. 21(*a*). Several geometric parameters are delineated in FIG. 21(*a*) that will be discussed in the explanation of the present invention. Drops in the different streams 100 of the drop curtain are minimally separated in the y-direction by the printhead array nozzle separation distances, $S_n$. Print drops are minimally separated in the z-direction by the large drop separation distance $\lambda_m$. Non-print drops are minimally separated by the small drop separation distance, $\lambda_0$. For the example of FIG. 21(*a*), $\lambda_m=3\ \lambda_0$. Note also that the small drop separation is also frequently termed the "wavelength" of the fundamental continuous drop generation process, $\lambda_0=v_d\tau_0$, where $v_d$ is the fluid and drop stream velocity after emission from the nozzle. The large print drops have a diameter, $D_{dm}$.

Each print drop may be considered to be minimally separated from a nearest neighbor in the yz-plane by drop clearance separation distances: $c_y$, $c_z$ and $c_{zy}$. The normalized clearances, $c_y$*, $c_z$* and $c_{zy}$* are calculated by dividing the inter-drop clearances by the print drop diameter, $D_{dm}$. For the balance of the discussion of the present inventions herein, the normalized clearance lengths will be used, in concert with the above discussed analytical results.

From FIG. 21(*a*) it is apparent that the $c_y$* normalized clearance is the smallest of the three normalized inter-drop clearances for the drops within a print drop line. Consequently, the dominant aerodynamic interaction effects causing splay errors will arise from the airflow squeezing between the $c_y$ gaps. The inventor of the present invention has realized that, because the drop formation process is independently controlled for each jet in the printhead, the $c_y$* clearance may be immediately increased by more than double by shifting the drop formation process in adjacent streams in time relative to one another.

A preferred embodiment of the present invention is therefore illustrated in FIG. 21(*b*) wherein the drop streams $\mathbf{100}_{j-2}$ and $\mathbf{100}_{j-4}$ have been shifted in space along the z-direction relative to streams $\mathbf{100}_{j-3}$ and $\mathbf{100}_{j-5}$ by an amount $q\lambda_m$. The parameter "q" will be used to describe the shifting of drop formation as a fraction of the print drop separation distance, $q\lambda_m$, and, below, as a fraction of the print drop forming period, $q\tau_m$. The z-axis shifting of adjacent streams increases $c_y$ by another unit of the nozzle spacing, $S_n$, increasing $c_y$* by a factor of two, plus one. For example, for 11 pL drops ($D_{dm}$=27.6 μm) emitted from nozzles spaced apart by $S_n$=42.3 μm, shifting the drop formation processes as illustrated in FIG. 21(*b*) increases the y-direction inter-drop clearance from $c_{y1}$*=0.53 to $c_{y2}$*=2.06. It may be understood from the analysis above that such a large increase in $c_y$* will quickly reduce y-direction splay forces, i.e. by 86% according to Equation 8. The notation $c_{yn}$*, n=1, 2 or 3, is used herein to denote the normalized y-direction inter-drop separation distances, $c_{yn}$*, for the cases wherein the print drops in the print drop curtain are separated along the y-direction by a distance of $nS_n$. Of course, the drop formation shifting illustrated in FIG. 21(*b*), makes the normalized diagonal clearance gap, $c_{zy}$*, now the "tightest" clearance for airflow. As a result, splay forces in the zy-direction will now be the dominant source of aerodynamic interaction errors. Nonetheless, for large drop printing configurations, there will be a net reduction in splay error forces that is gained by the shifting of adjacent stream drop forming processes because the new value for $c_{zy}$* will always be larger than the "old", unshifted, value of $c_y$*, i.e., $c_{zy}$*>$c_{y1}$*.

Figure 22A:
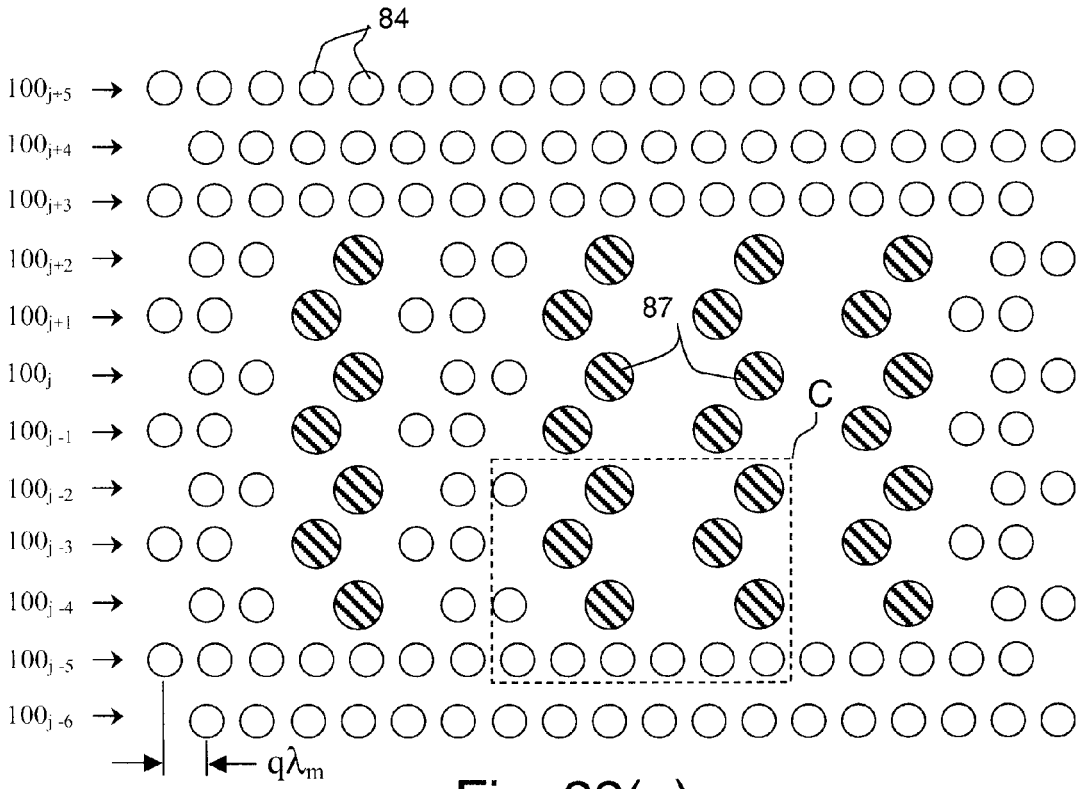
FIGS. 22(*a*) and 22(*b*) illustrate a pattern of print and non-print drops for twelve jets of an array of jets and the corresponding drop forming pulse sequences applied to the drop stimulators of those jets, respectively.
Figure 22B:
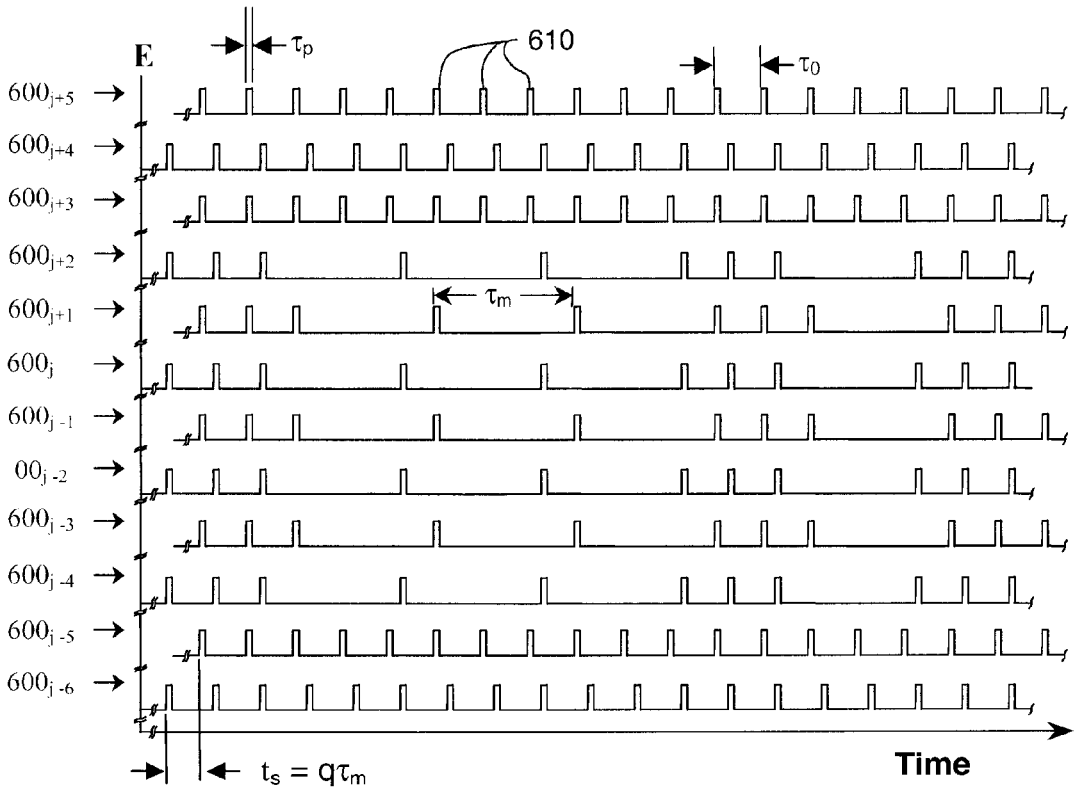

FIGS. 22(*a*) and 22(*b*) further illustrates a preferred embodiment of the present invention, adjacent stream drop formation shifting, by showing the drop curtain pattern and the associated drop formation pulse sequences in similar fashion to FIGS. 21(*a*) and 21(*b*). FIG. 22(*b*) makes clear that the methods of the present invention are implemented by shifting the timing of the drop formation pulse sequences between adjacent streams by a time shift amount, $t_s$, wherein $t_s=q\,\tau_m$, and q is a time shift fraction. As a practical matter, the present inventions are most preferably implemented for values of q that cause a substantial relative shift in the drop formation sequences. For the purpose of the present inventions it will be understood that a substantial shift is one of 20% or more. Consequently, a preferred embodiment of the present invention is implemented using values of q in the range: $0.2 \leqq q \leqq 0.8$.

It should be noted that the maximum value for the diagonal inter-drop clearance $c_{zy}$ will be achieved for q=0.5. The preferred range of q values, $0.2 \leqq q \leqq 0.8$, includes values above 0.5 to remove the ambiguity of which drop stream is shifted relative to which. For example, examining the print drop curtain configuration in FIG. 21(*b*), drop stream $\mathbf{100}_{j-4}$ is shifted approximately $0.22\ \lambda_m$ relative to drop stream $\mathbf{100}_{j-3}$, i.e. q=0.22. Alternatively, the same drop curtain inter-drop clearances illustrated could have been created by shifting the drop streams by (q−1)=0.78. Both embodiments are within the metes and bounds of the present invention.

The embodiment of the present invention illustrated in FIGS. 22(*a*) and (*b*) was implemented by dividing the jets of the printhead into two, interdigitated groups. However it is not necessary to the practice of the present invention that the shifting of the drop formation sequences 600 between adjacent streams use the same repeating values of q and (q−1) between adjacent drop streams 100. Any number of values of the time shift fraction may be used to cause substantial increases in the minimum inter-drop clearances, c*, that are desired. However, for other reasons of system simplicity, organizing the jets into one or more interdigitated blocks that are shifted by a same amount in time relative to each other may be preferred.

Figure 23A:
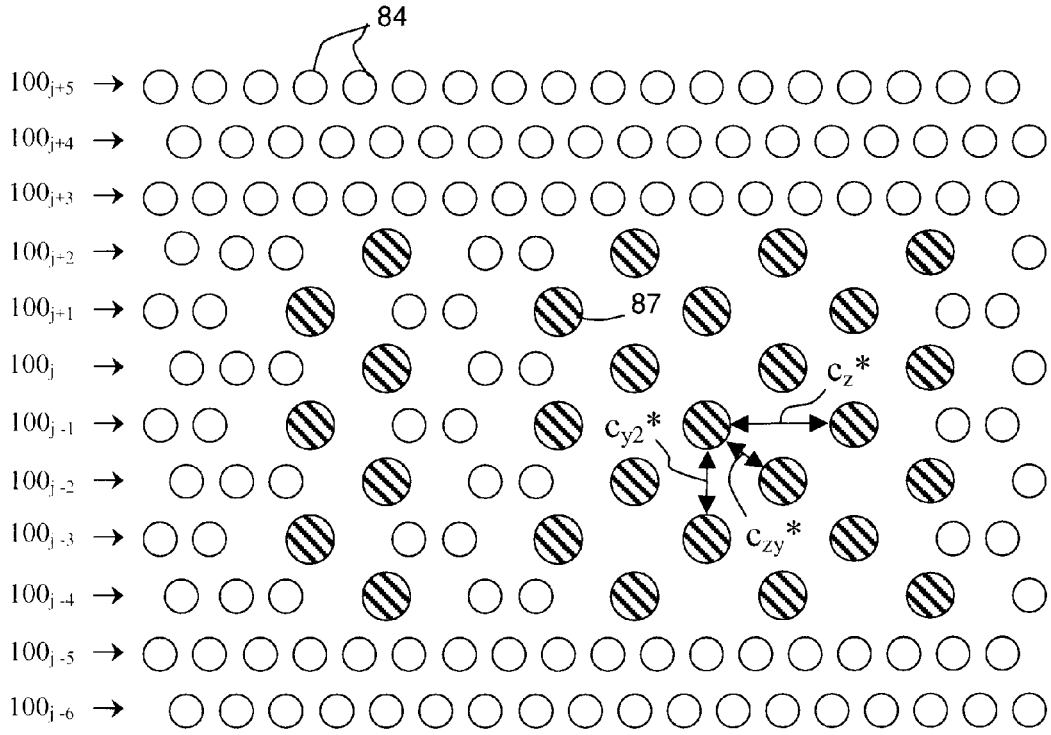
FIGS. 23(*a*) and 22(*b*) illustrate a pattern of print and non-print drops for twelve jets of an array of jets and the corresponding drop forming pulse sequences applied to the drop stimulators of those jets, respectively.
Figure 23B:
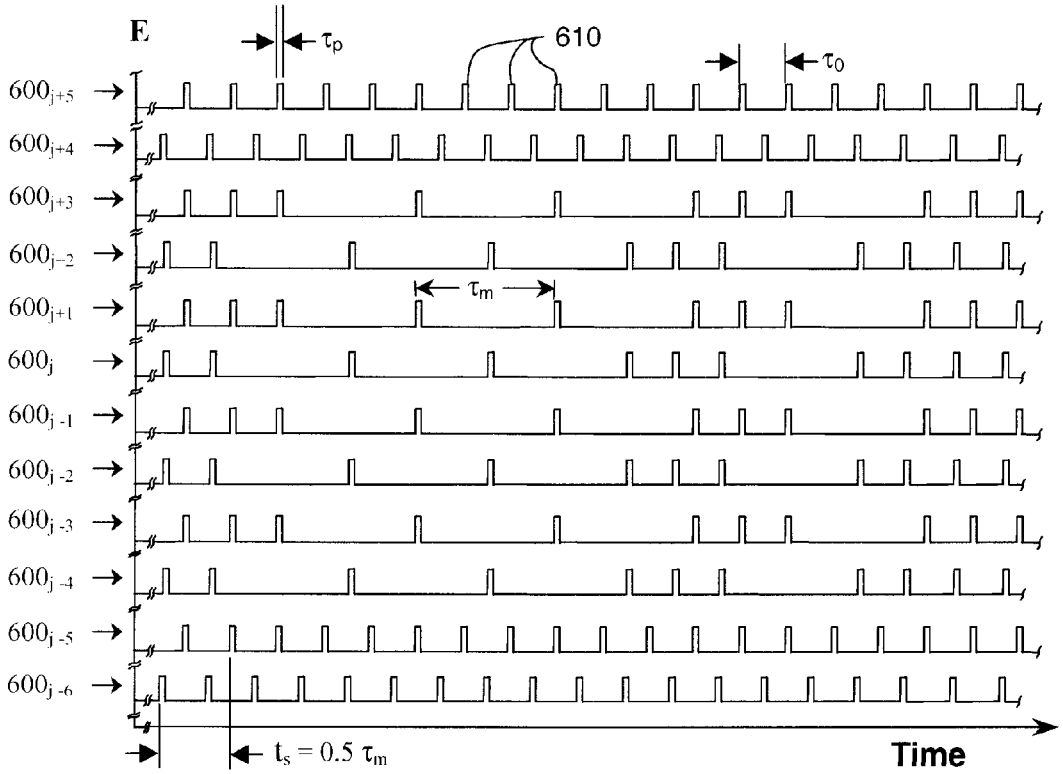

FIGS. 23(*a*) and (*b*) illustrate an embodiment of the present inventions wherein adjacent streams of drops 100 are organized into two interdigitated blocks and then one block of drop forming pulse sequences 600 is time-shifted by approximately q=0.5, i.e., $t_s=0.5\ \tau_m$. It may be appreciated by studying FIG. 23(*a*) that time-shifting interdigitated blocks of drop forming pulse sequences by q=0.5 provides the largest increase in the minimum print drop clearance value that can be accomplished by time shifting alone. Therefore, it may be preferred that q be selected to be substantially (½), that is, $0.4 \leqq q \leqq 0.6$ when using an organization of two interdigitated blocks whose drop forming pulse sequences are time shifted by $qt_s$.

Figure 24A:
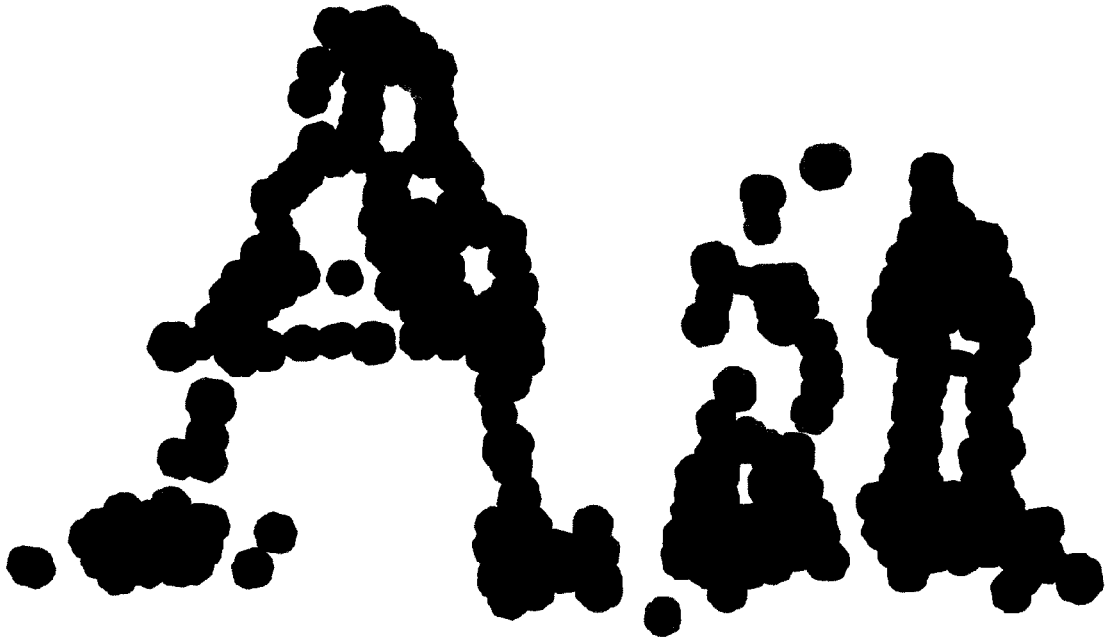
FIGS. 24(*a*) and 24(*b*) illustrate printed liquid patterns for the letters "A a" wherein adjacent stream drop forming pulse sequences were not time-shifted and were time-shifted by 0.5 $\tau_m$, respectively.
Figure 24B:
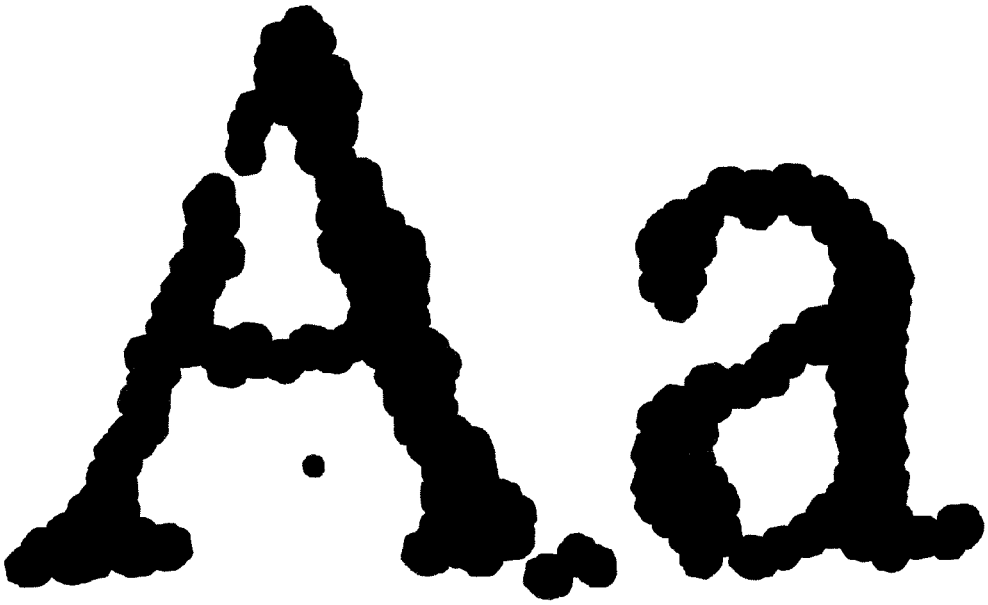

The improvement in drop placement, hence image or pattern quality, which may be achieved by applying the methods of the present invention is demonstrated in FIGS. 24(*a*) and 24(*b*). These Figures replicate a portion of an image, the letters "Aa" in 3-point typeface, printed without time-shifting the drop formation processes of adjacent streams in FIG. 24(*a*) and, in FIG. 24(*b*), the same input liquid pattern data file printed with a time shift of q=0.5 applied to the drop forming pulse sequences of two interdigitated blocks of adjacent drop streams. The experimental conditions used to create the images replicated in FIGS. 24(*a*) and 24(*b*) were similar to those given in Table 1 used to create the above discussed test images of drop lines of various lengths and widths.

The magnitude of the increase in minimum inter-drop clearance that is accomplished by time-shifting adjacent stream drop formation processes depends importantly on the spacing of print drops along the z-direction since shifting may make a normalized diagonal clearance, $c_{zy}$*, the smallest clearance, hence, the most important determiner of splay errors. Splay errors may be thus be further reduced by lengthening the print drop separation distance, $\lambda_m$, along the z-direction, which is also the direction of initial fluid emission, and of $v_d$. The print drop separation distance, $\lambda_m = m\lambda_0$, may be lengthened in one of two ways: (a) increasing the drop period multiplier, m, and (b) increasing the fundamental drop separation distance, $\lambda_0$. Either or both mechanisms may be permissible within other system design constraints.

Typically the volume of a print drop, $V_m$, is determined by print or pattern quality considerations and must be maintained at the chosen value when altering the design to increase normalized drop clearance values according to the present inventions. However, a target value of the print drop volume may be maintained while increasing the m value by reducing the fundamental, small drop volume appropriately. The fundamental drop separation distance, $\lambda_0$, may be increased while maintaining the same fundamental drop volume by, for example, increasing the stream velocity or fundamental drop forming periods while slightly reducing the nozzle diameter, $D_n$.

Some useful relationships among some of the large and small drop generation variables are as follows:

$$\lambda_0 = LD_n, \tag{9}$$

$$D_n = \sqrt[3]{\frac{4V_0}{\pi L}}, \tag{10}$$

$$\lambda_m = m\lambda_0 = D_{dm}\sqrt[3]{\frac{2m^2L^2}{3}}, \text{ and} \tag{11}$$

$$D_{dm} = \sqrt[3]{\frac{6V_m}{\pi}}, \tag{12}$$

where L is the small drop generation ratio, also known in the continuous inkjet field as the Rayleigh excitation wavelength ratio, and the other variables have been previously defined.

Using the above relationships we may express the minimum normalized print drop clearance quantities for adjacent streams with a time shift of their respective drop forming pulse sequences of $\tau_s = q\tau_m$, wherein $q \leqq 0.5$ (see FIG. 23(*a*)), as follows:

$$c^*_{y2} = \frac{2S_n}{D_{dm}} - 1 = \sqrt[3]{\frac{4\pi S_n^3}{3V_m}} - 1, \tag{13}$$

$$c^*_z = \frac{\lambda_m}{D_{dm}} - 1 = \sqrt[3]{\frac{2m^2L^2}{3}} - 1, \text{ and} \tag{14}$$

-continued $$c^*_{zy} = \sqrt[2]{\left[\left(\frac{q\lambda_m}{D_{dm}}\right)^2 + \left(\frac{S_n}{D_{dm}}\right)^2\right]} - 1, \tag{15}$$

$$c^*_{zy} = \sqrt[2]{\left[\left(\frac{2q^3m^2L^2}{3}\right)^{2/3} + \left(\frac{\pi S_n^3}{6V_m}\right)^{2/3}\right]} - 1.$$

The restriction of $q \leqq 0.5$ is merely to be assured that the smallest value of $c_{zy}$* is calculated in Equation 15. All of the parameters in Equations 13 through 15 have been previously defined.

Figure 25:
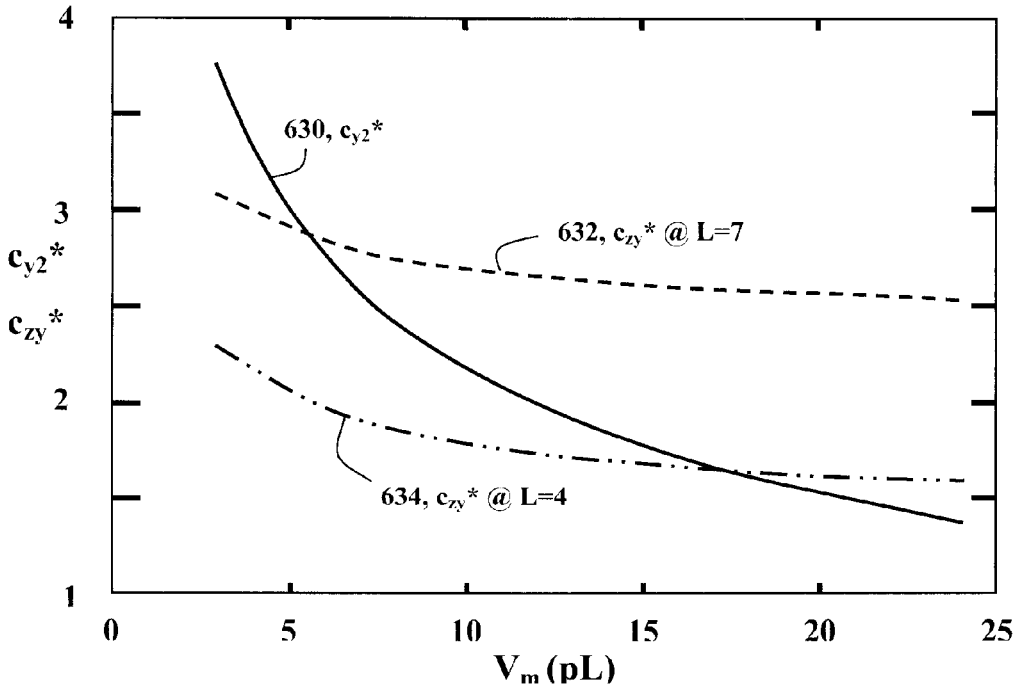
FIG. 25 shows plots of values of $c_{zy}$* and $c_{y2}$* versus large drop volume, $V_{dm}$.

Values for $c_{y2}$* and $c_{zy}$* versus large drop volume, $V_m$, are plotted in FIG. 25. Curve 630 plots $c_{y2}$* based on Equation 13 with $S_n$=42.3 μm. The print drop volume abscissa is expressed in picoLiters (pL). Curves 632 and 634 plot values for $c_{zy}$* with q=0.5, m=3, $S_n$=42.3 μm, and L=4 (curve 634) or L=7 (curve 632). The values of L=4 and L=7 are chosen to bracket the most typical operational space for the small drop generation ratio. Operation above and below these two L values is feasible, however substantially increased drop forming pulse energy would be required.

It may be understood from the $c_{y2}$* and $c_{zy}$* values plotted in FIG. 25, and from Equations 13 and 15, that for a selected print drop volume, $V_m$, there may be values of q, m and L for which the $c_{zy}$* normalized clearance exceeds the y-direction clearance, $c_{y2}$*. For example, $c_{zy}$* curve 632 (L=7) crosses $c_{y2}$* curve 630 at $V_m$ ~5 pL. Thus for all print drop volume selections larger than ~5 pL, $c_{zy}$*>$c_{y2}$* for m=3, $S_n$=42.3 μm, L=7, and using a time shift fraction of q=0.5 between adjacent drop streams. The cross over of $c_{zy}$* and $c_{y2}$* for L=4 occurs at a higher print drop volume, $V_m$ ~17.5 pL. The $c_{zy}$*=$c_{y2}$* crossover point will occur for volumes between ~5 and 17.5 pL for L values between 4 and 7.

Figure 26:
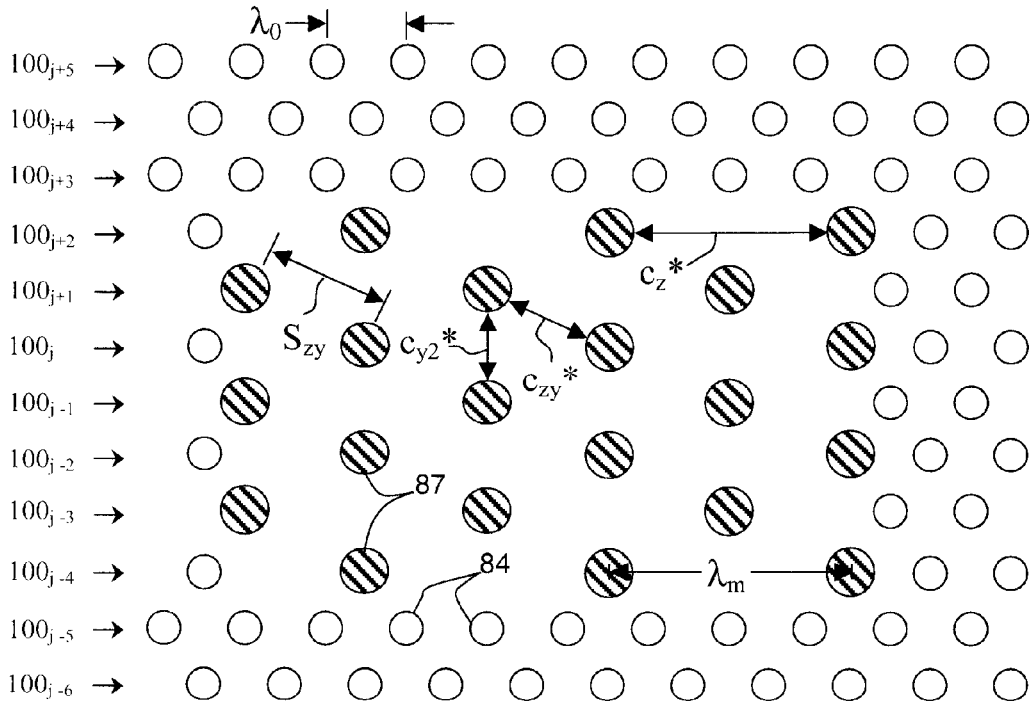
FIG. 26 illustrates a pattern of print and non-print drops for twelve jets of an array of jets wherein the small drop separation distance has been increased so that $c_{zy}^* > c_{y2}^*$.

In order to reduce aerodynamic induced splay factors to a maximum extent, it is beneficial to both time shift the drop formation sequences and to lengthen the "mL" factor, by increasing m, by increasing L, or by increasing both. FIG. 26 illustrates the same drop curtain pattern depicted in FIG. 23(*a*) with the additional affect of lengthening the small drop separation distance, $\lambda_0$, until the normalized diagonal inter-drop clearance, $c_{zy}$*, is greater than the normalized drop clearance along the y-direction, $c_{y2}$*. $S_{zy}$ is a drop center-to-center separation distance along a zy-direction. It may be appreciated from the analysis previously discussed, that configuring the print drop curtain so as to maximize the minimum drop separation clearance, especially when such actions move the minimum values so that c*>2, aerodynamic splay forces and print drop placement errors will be greatly reduced.

Figure 27A:
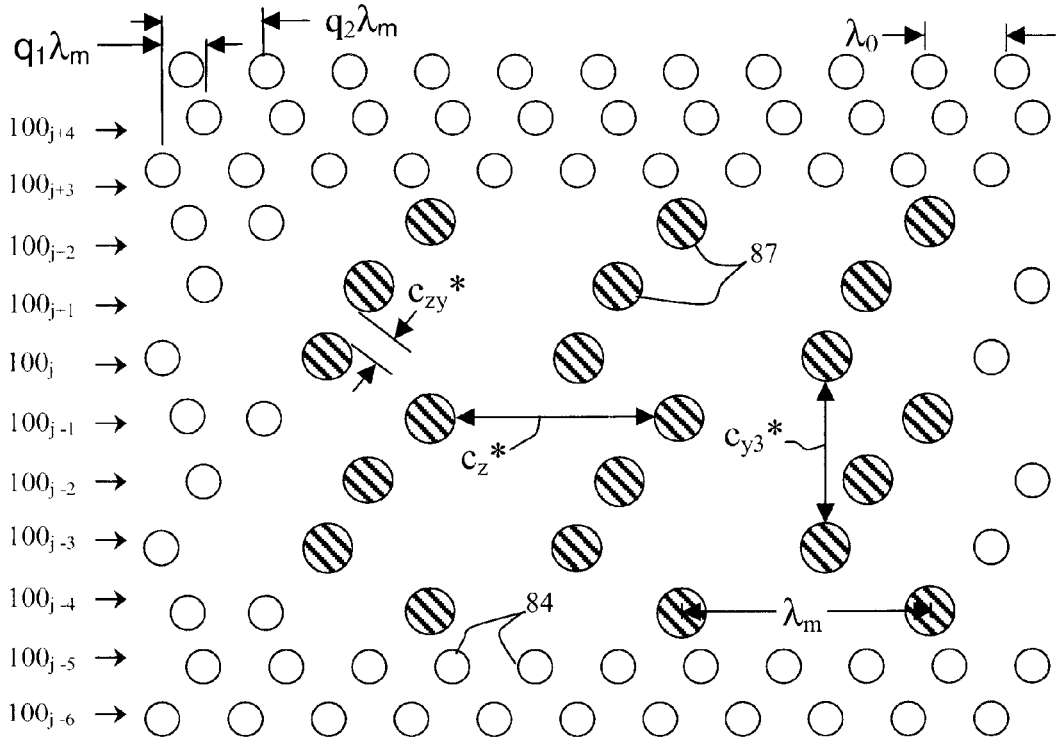
FIGS. 27(*a*) and 27(*b*) illustrate a pattern of print and non-print drops for twelve jets of an array of jets and the corresponding drop forming pulse sequences applied to the drop stimulators of those jets, respectively, wherein drop forming pulse sequences are shifted for adjacent and next-to-adjacent streams.
Figure 27B:
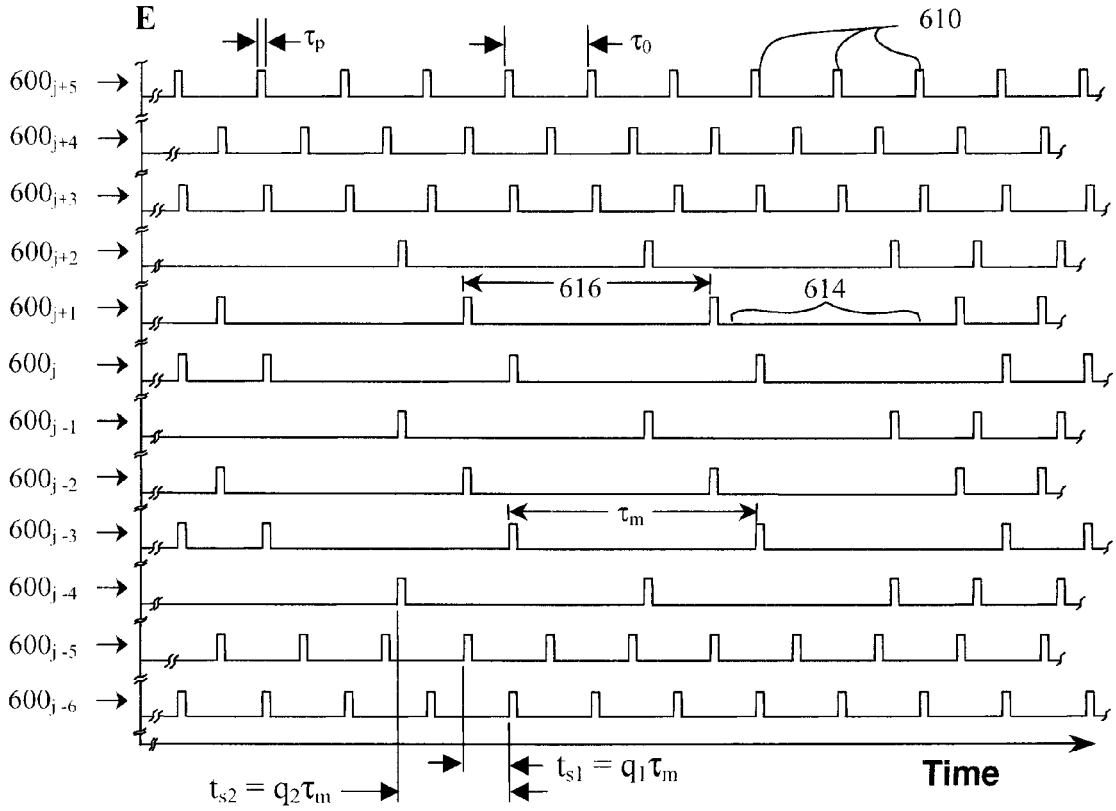

If the overall system design is compatible with continued expansion of the drop curtain in the z-direction, i.e. with expanding the "mL" factor, then it may be beneficial to time shift not only adjacent drops stream drop formation pulse sequences but also next-to-adjacent stream drop formation pulse sequences. For example, the nozzles and drop streams may be organized into three interdigitated groups shifted relative to one another by first and second time shift factors $q_1$ and $q_2$. This embodiment of the present invention is illustrated in FIGS. 27(*a*) and 27(*b*). In FIG. 27(*a*) the twelve drop streams 100 are organized into three interdigitated groups: group 1 (100$_{j-6}$, 100$_{j-3}$, 100$_j$, 100$_{j+3}$); group 2 (100$_{j-5}$, 100$_{j-2}$, 100$_{j+1}$, 100$_{j+4}$); group 3 (100$_{j-4}$, 100$_{j+1}$, 100$_{j+2}$, 100$_{j+5}$). The drop streams of group 2 are shifted by $q_1\lambda_m$ relative to group 1 and the drop streams of group 3 are shifted by $q_2\lambda_m$ relative to group 1.

FIG. 27(*b*) illustrates the time shifting of the drop formation pulse sequences that generates the drop curtain configuration illustrated in FIG. 27(*a*). The twelve drop forming pulse sequences 600 are organized into three interdigitated groups: group 1 ($\mathbf{600}_{j-6}$, $\mathbf{600}_{j-3}$, $\mathbf{600}_{j}$, $\mathbf{600}_{j+3}$); group 2 ($\mathbf{600}_{j-5}$, $\mathbf{600}_{j-2}$, $\mathbf{600}_{j+1}$, $\mathbf{600}_{j+4}$); group 3 ($\mathbf{600}_{j-4}$, $\mathbf{600}_{j-1}$, $\mathbf{600}_{j+2}$, $\mathbf{600}_{j+5}$). The drop streams of group 2 are shifted by $q_1\tau_m$ relative to group 1 and the drop streams of group 3 are shifted by $q_2\tau_m$ relative to group 1. As before, the practice of the present invention requires that the shifting of drop streams be substantial, so that $0.2 \leqq q_1 \leqq 0.8$ and $0.2 \leqq q_2 \leqq 0.8$.

It is apparent from FIG. 27(*a*) that for this embodiment of the present inventions, the normalized inter-drop clearance length along the y-direction again jumps significantly in magnitude by the addition of another unit of the nozzle spacing to the separation distance. For the example previously calculated, $V_m$=11 pL, $D_{dm}$=27.6 μm and $S_n$=42.3 μm, $c_y$* becomes $c_{y3}$*=3 $S_n/D_{dm}-1$=3.60. Shifting the drop formation processes as illustrated in FIGS. 27(*a*) and 27(*b*) reduces y-direction splay force on end drops relative to an unshifted print drop line pattern (see FIGS. 20(*a*) and 20(*b*)), by 94% according to Equation 8.

The drop formation shifting illustrated in FIG. 27(*b*), makes the normalized diagonal clearance gap, $c_{zy}$* once more, the "tightest" clearance for airflow. As a result, splay forces in the zy-direction will now be the dominant source of aerodynamic interaction errors. However, the approach of shifting three interdigitated groups of drop streams offers a net reduction of aerodynamic splay forces and errors if the normalized diagonal clearance gap, $c_{zy}$* is larger than the normalized y-direction clearance gap, designated herein, $c_{y2}$*, for the two interdigitated group shifting embodiments of the present invention previously described. That is, further reduction in aerodynamic splay errors may be achieved by organizing the drop steams into three interdigitated groups time-shifted relative to one another so that the smallest diagonal inter drop clearance, $c_{zy}$*, is greater than $c_{y2}$*, i. e., $c_{zy}$*>2 $S_n/D_{dm}-1$.

Figure 28A:
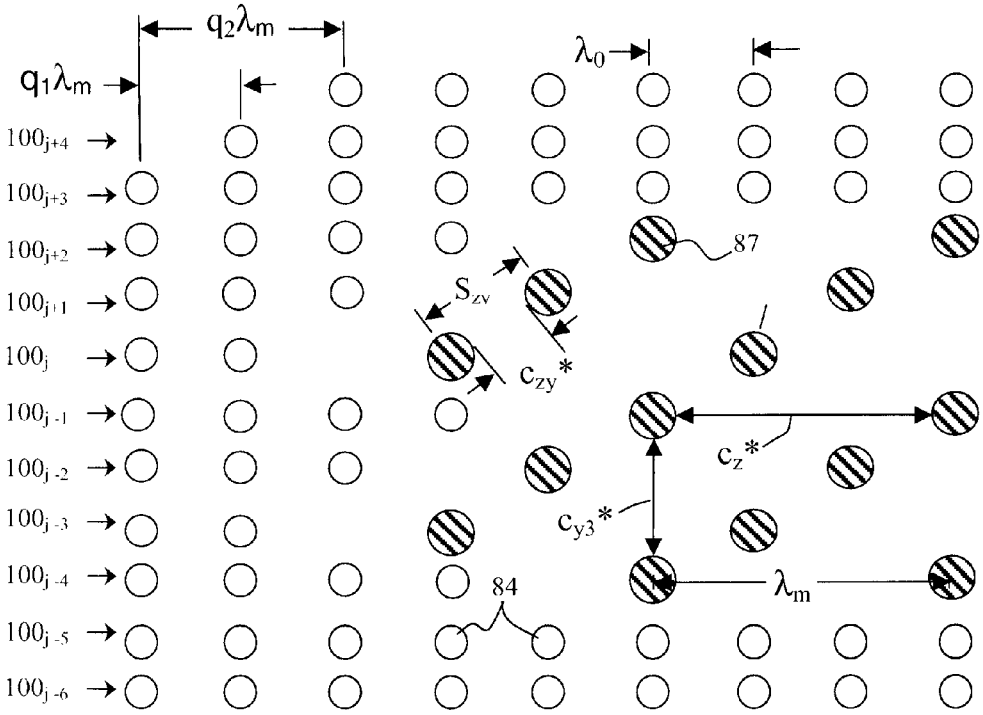
FIGS. 28(*a*) and 28(*b*) illustrate a pattern of print and non-print drops for twelve jets of an array of jets and the corresponding drop forming pulse sequences applied to the drop stimulators of those jets, respectively, wherein drop forming pulse sequences are shifted equally for adjacent and next-to-adjacent streams.
Figure 28B:
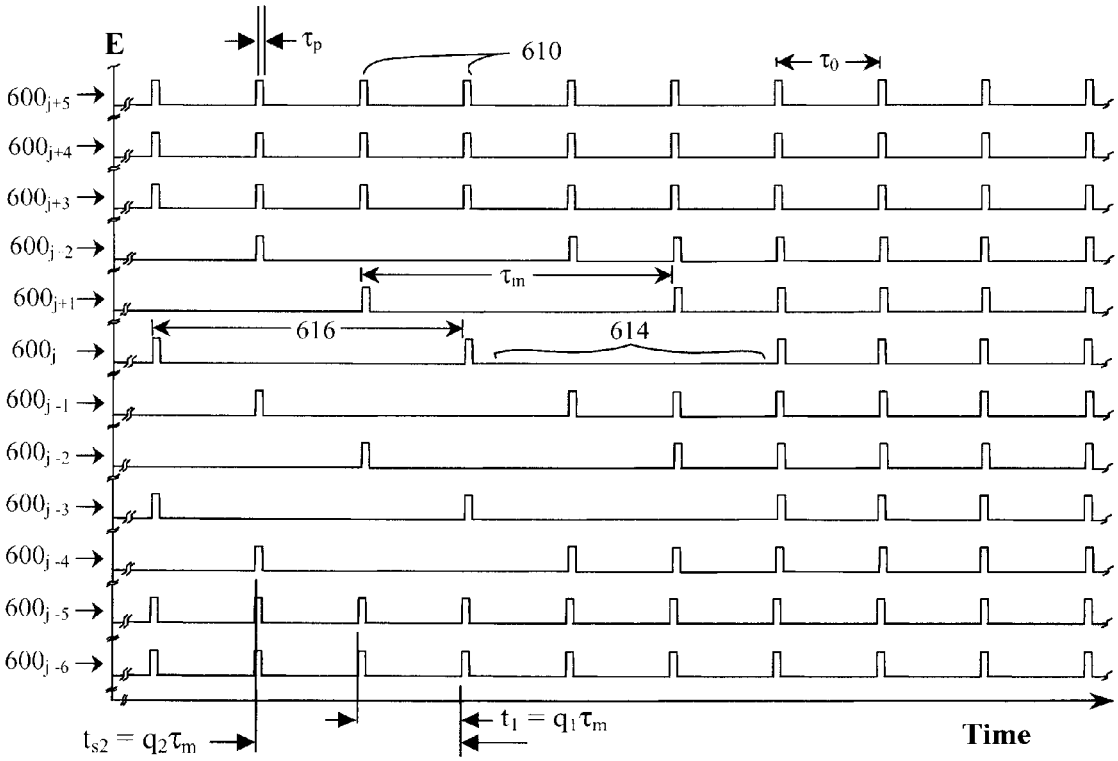

FIGS. 28(*a*) and 28(*b*) illustrate a print drop curtain design that achieves the further increase in minimum inter-drop clearances sought by shifting three groups of interdigitated drop streams relative to one another. The same grouping of drop streams 100 and drop formation pulse sequences 600 described with respect to FIGS. 27(*a*) and 27(*b*) were used to construct the configuration depicted in FIGS. 28(*a*) and 28(*b*). While the relative shift fractions $q_1$ and $q_2$ may be chosen to be different, the maximum separation of drops in the drop curtain, for a specific choice of the mL factor, occurs when $q_1$=(⅓) and $q_2$=(⅔), or vice versa. Therefore, it may be preferred that $q_1$ and $q_2$ are selected to be substantially (⅓) and (⅔), that is, $0.26 \leqq q_1 \leqq 0.4$ and $0.6 \leqq q_2 \leqq 0.74$, when using an organization of three interdigitated blocks whose drop forming pulse sequences are time shifted by $q_1 t_s$ and $q_2 t_s$. The print drop curtain design illustrated in FIG. 28(*a*) is constructed by time shifting group 2 relative to group 1 by $q_1$=⅓ and by time shifting group 3 relative to group 1 by $q_2$=⅔. As noted before, a further increase in the smallest inter-drop clearance may be achieved using the three stream group embodiment illustrated in FIGS. 27 and 28, if $c_{zy}$*>2 $S_n/D_{dm}-1$. $c_{zy}$* may be calculated from Equation 15. $S_{zy}$ is a drop center-to-center separation distance along a zy-direction. For a given selection of the other parameters, $c_{zy}$* will be maximized by choosing the values of $q_1$ and $q_2$ that provide the most separation among the print drops, i.e. $q_1$=(⅓) and $q_2$=(⅔), or vice versa. Thus, the "crossover" values of the mL factor may be determined from Equations 9-15 using q=(⅓) and forming the "crossover" test, $c_{zy}$*=$c_{y2}$*. The value of L for which this equality is true will be designated $L_1$, a first crossover L value.

$$\sqrt[2]{\left[\left(\frac{q\lambda_m}{D_{\mathrm{dm}}}\right)^2+\left(\frac{S_n}{D_{\mathrm{dm}}}\right)^2\right]}-1=\frac{2S_n}{D_{\mathrm{dm}}}-1, \tag{16}$$

$$\lambda_m^2=3\frac{S_n^2}{q^2}=27S_n^2,\ \text{for } q=1/3, \tag{17}$$

$$mL_1=\sqrt{27}\,\frac{S_n}{D_n}=(27)^{3/4}\sqrt[2]{\frac{\pi S_n^3}{4V_m}}.$$

Figure 29:
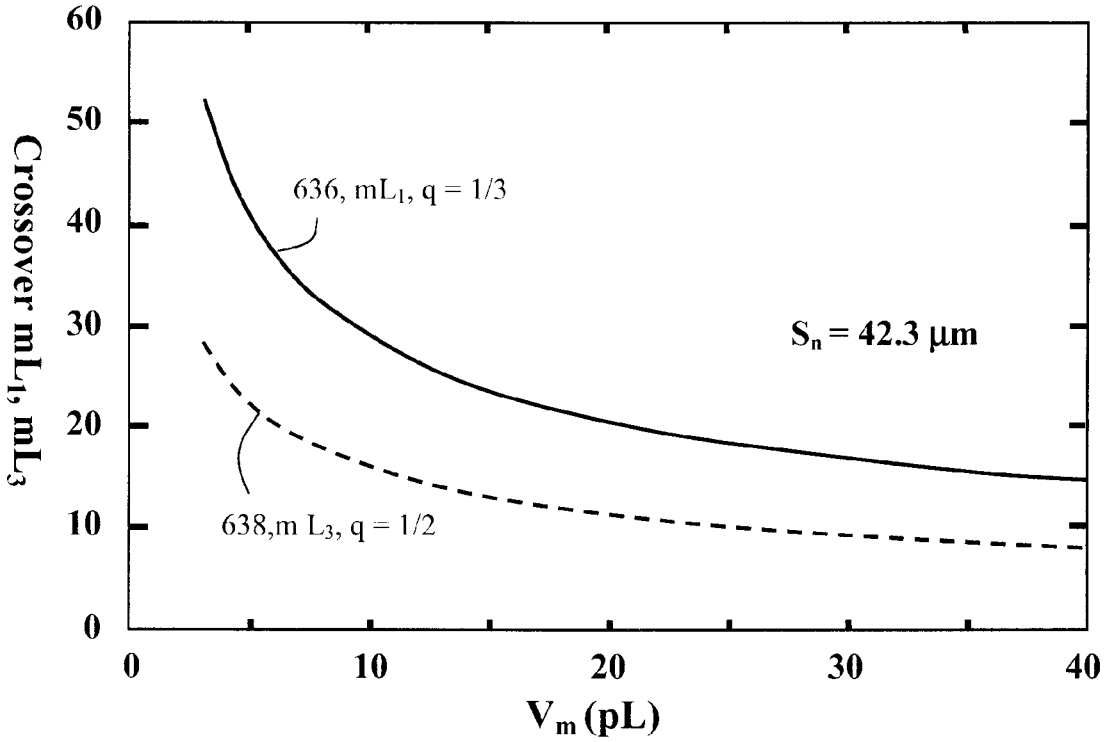
FIG. 29 shows plots of the mL value required for $c_{zy}$*=$c_{y2}$* versus large drop volume, $V_{dm}$, for q=0.5 and q=0.333.

Equation 17 for $mL_1$ is plotted for $S_n$=42.3 μm versus print drop volume, $V_m$, in FIG. 29 as curve 636. Also plotted in FIG. 29 as curve 638 are the mL values, $mL_3$, versus print drop volume, for Equation 16 when q=½. This latter curve is equivalent to the crossover points for $c_{y2}$*=$c_{zy}$* noted in FIG. 25. The two curves in FIG. 29 may be viewed as dividing "mL" space into three regimes. Choosing an mL value below lower curve 638 for a selected value of the print drop volume will have the result that $c_{zy}$* will be the smallest inter-drop clearance value when two interdigitated groups of drop streams are shifted with respect to one another. Choosing an mL value above lower curve will result in the y-direction normalized clearance, $c_{y2}$*, being the smallest, if the q value is chosen large enough.

Choosing a value of mL above the upper curve, and shifting both adjacent and next-to-adjacent drop formation pulse sequences with large enough values for q1 and q2 will result in the zy-direction clearance being the smallest for three interdigitated groups of drop streams, but still larger than the y-direction clearance would be if only two interdigitated groups are shifted. In other words, operating in the mL space above curve 636, $mL_1$, offers additional reduction in aerodynamic interaction effects by utilizing three shifted groups of drop formation instead of two shifted groups.

The explanations of the present invention above have been related to the system choice of using the large drops in the streams of drops of predetermined volumes for forming the liquid pattern on the receiver medium. The small drops of unit volume, $V_0$, were differentially deflected by the deflection gas flow and captured at the drop capture lip 152 illustrated in FIG. 2. An alternative system choice for which the present invention is useful and effective is a "small drop" printing configuration. This alternative configuration may be implemented in nearly analogous fashion to the large drop system choice discussed above by reversing the deflection gas flow in the drop deflection gas manifold 150 so that small drops are deflected upward in the negative x-direction (in FIG. 6) and the drop capture lip is raised enough to capture only the large, non-print drop curtain. In the terminology of this disclosure of the present inventions, when using a large drop print mode, the print drop forming time period, $\tau_p=\tau_m$ and the non-print drop time forming period $\tau_{np}=\tau_0$. When using a small drop print mode, the reverse is the case: $\tau_p=\tau_0$, $\tau_{np}=\tau_m$.

Large and small drop printing modes are described in further detail in previous disclosures assigned to the assignee of the present invention. For example, small drop print modes are disclosed in Jeanmaire '888 or Jeanmaire '566 and large drop print modes are disclosed also in Jeanmaire '566 or in Jeanmaire '410. Splay forces and drop placement errors occur in small drop printing for the same reasons that were described and analyzed above for the large drop print configuration. The small drop print mode creates a print drop curtain composed of drops of small drop volume $V_0$ having inter-drop clearance values in the zy-plane that are also described by Equation 9-15 wherein m=1 and the print drop forming time period is $\tau_0$. Time-shifting adjacent drop streams by an amount, $t_s=q\tau_0$, wherein $0.2 \leqq q \leqq 0.8$, similarly provides an increase in inter-drop clearance along the y-direction. A value of q=0.5 provides the greatest inter-drop clearance values for a given choice of L.

Small drop printing may also benefit significantly by the combined effect of time-shifting adjacent drop formation sequences and stretching the drop streams in the z-direction by increasing L. In fact, because the print drops are separated in the z-direction by only $\lambda_0$, rather than by the $m\lambda_0$ length applicable to the large drop print mode, the normalized z-direction inter-drop clearance, $c_z^*$, may be the "tightest" inter-drop clearance in the small print drop curtain. Thus it is beneficial to stretch $\lambda_0$ until the normalized z-direction inter-drop clearance is at least as large as the nominal normalized y-direction clearance, $c_{y1}^*$. The value of L for which $c_z^*=c_{y1}^*$ will be termed, herein, the second crossover L value, $L_2$. Equation 9, 13 and 14 are used to determine $L_2$:

$$c_{y1}^* = \frac{S_n}{D_{d0}} - 1 = c_z^* = \frac{\lambda_0}{D_{d0}} - 1, \tag{18}$$

$$L_2 = \frac{S_n}{D_n}, \tag{19}$$

where $D_n$ is the nozzle diameter and $S_n$ is the nozzle spacing.

There are practical limits to operating continuous drop emitters at large values of L, especially for values of L greater than ~10. As the L value is increased, the drop forming pulse energy must be increased to cause sufficient stimulation to synchronize drop formation, raising difficulties of stimulation transducer reliability and waste energy dissipation. Future developments in drop formation transducers, however, may extend the practical range of L operation. Nonetheless, when using a small drop print mode, operating a continuous drop emission apparatus at L values above $L=L_2$ as defined by Equation 19 is beneficial in reducing inter-drop aerodynamic interactions, and, hence reducing splay errors in the printed liquid pattern.

Printing with time shifted drop streams will necessarily result in the shifting of the scanlines printed by each stream. Since the printhead and receiver medium are moving with respect to one another at a velocity of $v_{PM}$, print drops that have been shifted by time of $t_s$ relative to adjacent print drops, will impact the receiver medium a shifted print distance, $S_{ps}$, of $S_{ps}=t_s\, v_{PM}$. Since, according to the present invention, $t_s$ is a fraction, q, of the print drop formation time, $\tau_0$ or $\tau_m$, depending on the print drop mode, the shifted print distance will be a same fraction of the liquid pattern pixel spacing in the x-direction, that is $S_{ps}=qP_{px}$. The inventor of the present invention anticipates that this amount of shift in the printing of adjacent scanlines may be acceptable in view of the significant reduction in aerodynamic splay errors that are more than a full liquid pattern pixel spacing.

Figure 30A:
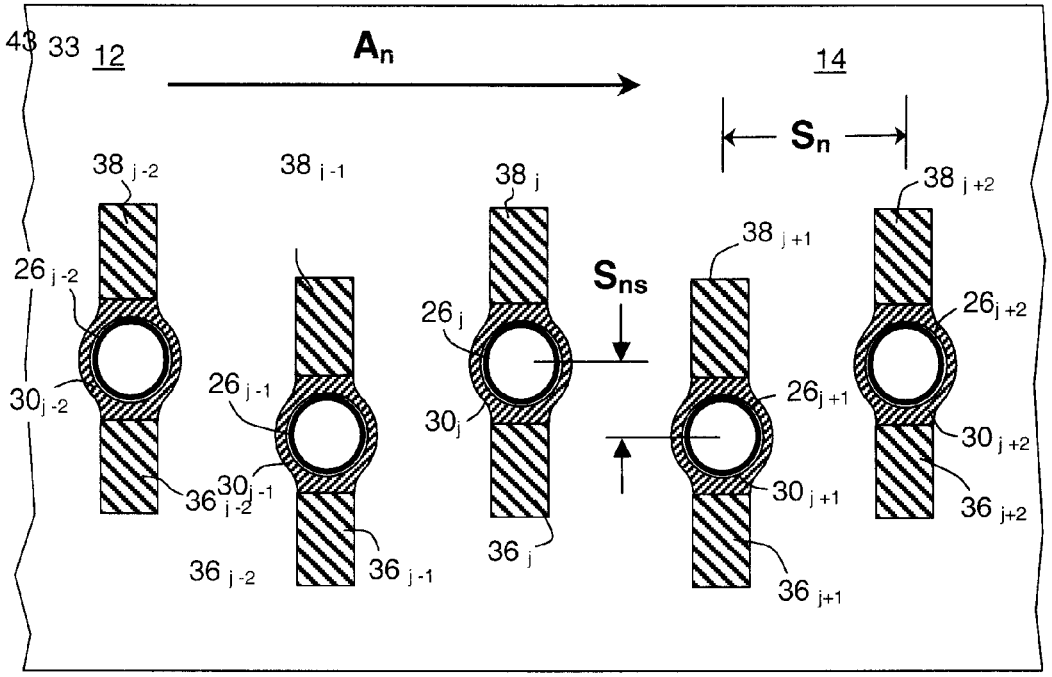
FIGS. 30(*a*) and 30(*b*) illustrate in front plan view a portion of liquid drop emitter arrays in which the nozzles are shifted with respect to adjacent nozzles and next to adjacent nozzles as well, respectively.
Figure 30B:
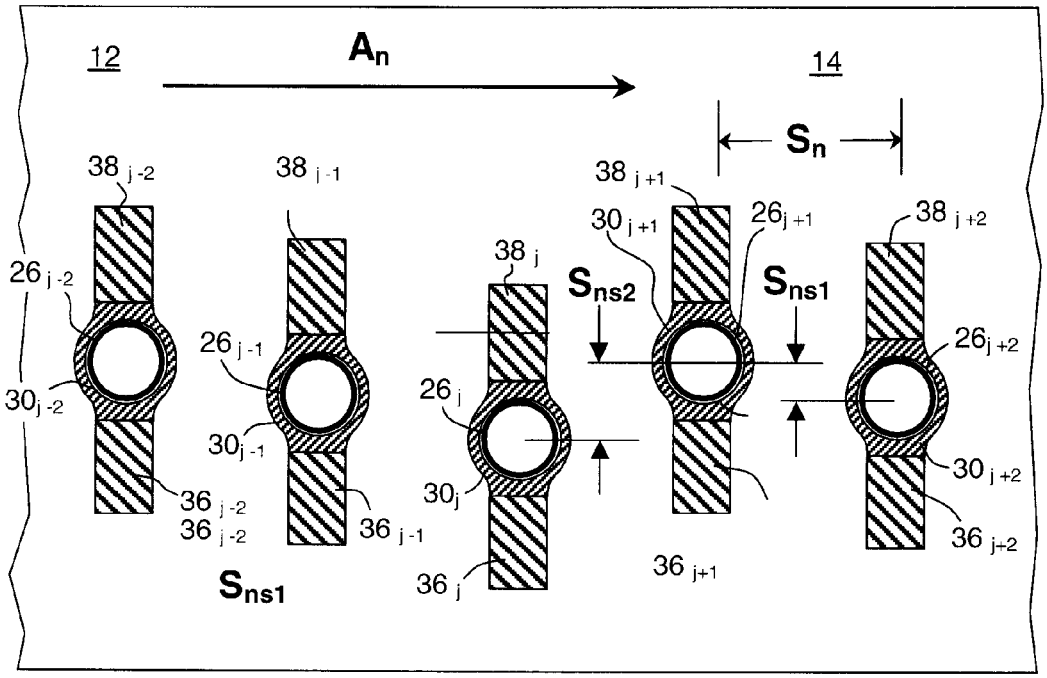

However, in concert with a particular print drop curtain design according to the present invention, it may be also beneficial to design the multi-jet drop emitter in such a manner as to physically offset some portion, or all, of the x-direction shift caused by drop stream timing shifts. FIGS. 30(*a*) and 30(*b*) illustrate drop emitter front faces similar to that shown in FIG. 3(*b*) except that the nozzles have been grouped into two or three interdigitated groups and physically shifted in the x-direction with respect to one another. FIG. 30(*a*) illustrates a single nozzle shift amount, $S_{ns}$, applied to all of the nozzles of one interdigitated nozzle group relative to the other. FIG. 30(*b*) illustrates a case wherein the nozzles are grouped into three interdigitated groups and shifted relative to each other by two nozzle shift amounts, $S_{ns1}$ and $S_{ns2}$.

The amount of nozzle shift, $S_{ns}$, that is incorporated into a multi-jet liquid drop emitter, according to the present invention, may be chosen to be exactly the amount, $qP_{px}$, some substantial portion of this amount, or, perhaps somewhat more than this amount.

The relative velocity between the printhead and the receiver medium, $v_{PM}$, may be changed according to various system considerations, such as print quality modes, image drying, energy limitations, heat build-up and the like. Consequently, fixed nozzle shift amounts may provide varying amounts of compensation for the time shifting of drop formation pulse sequences according to the present invention. In a preferred embodiment of the present invention, the nozzle shift amount may be selected to mostly compensate for time shifted drop forming pulse sequences in the highest quality mode of the system, based on the printhead and media relative velocity for that mode, $v_{PMHQ}$. That is, the nozzle shift, $S_{ns}$ would be selected as $S_{ns}=q_3 t_s v_{PMHQ}$, $0.8 \leqq q_3 \leqq 1.2$, where $q_3$ is the nozzle shift fraction. For other modes of the same liquid pattern deposition system that operate at different speeds, the nozzle shift compensation will be less than full or may even over compensate.

However, according to the present invention, many other balancing selections for fixed nozzle shift distances, $S_{ns}$, might be beneficially chosen for a system having multiple print speed modes. For the purposes of the present invention, the nozzle shift fraction, $q_3$, of the x-direction drop stream shift, may be selected over a range $0.2 \leqq q_3 \leqq 1.2$ where $S_{ns}=q_3 t_s v_{PM}$, and $v_{PM}$ may be any of the relative printhead to receiver medium velocities employed by the system during liquid pattern deposition. Therefore, the same fixed value of nozzle shift, $S_{ns}$, may represent different values for $q_3$, according to the different values of relative printhead velocity, $v_{PM}$, supported by the drop deposition apparatus.

The invention has been described in detail with particular reference to certain preferred embodiments thereof, but it will be understood that variations and modifications can be effected within the spirit and scope of the invention.

PARTS AND PARAMETER LIST

10 continuous drop deposition apparatus
11 continuous liquid drop emission printhead
12 drop generator body
14 drop nozzle front face layer
16 passivation layer
18 drop generator device substrate
19 internal drop generator device liquid supply chamber
20 multi-jet drop generator device
22 printhead flexible circuit electrical connection member
24 individual transistor per jet to power heat energy pulses
25 contact to drive transistor
26 nozzle exit opening with effective diameter $D_n$
28 drop generator device interconnect protective encapsulant
30 thermal stimulation heater resistor surrounding nozzle
36 address lead to heater resistor
38 address lead to heater resistor
40 pressurized liquid supply inlet
41 common liquid supply pathway
42 inlet filter
44 inlet seal

46 drop generator common supply reservoir
48 liquid recovery outlet and negative pressure supply inlet for air deflection
60 positively pressurized liquid
62 continuous stream of liquid
70 stimulated sinuate surface necking on the continuous stream of liquid
74 operating break-off length due to controlled stimulation
80 stream of drops of uniform predetermined small or unit volume, $V_0$
84 drops of uniform small volume, ~$V_0$, unitary volume drop
85 large volume drops having volume ~$5V_0$
86 large volume drops having volume ~$4V_0$
87 large volume drops having volume ~$3V_0$
88 large volume drops having volume ~$8V_0$
90 airflow plenum for drop deflection (towards the negative X-direction)
100 stream of drops of multiple predetermined volumes
150 drop deflection gas and liquid recovery manifold
152 deflected drop capture lip
154 deflection air flow and captured liquid return plenum
156 captured liquid for recycling
160 drop deflection air flow
162 deflection airflow crowding between flying print drops
164 deflection airflow around outer drop of a line of flying print drops
166 deflection air flow downstream of a line of flying print drops
170 two-dimensional airflow around print drops in flight
172 cylinder representing a print drop in a two-dimensional airflow model
174 two-dimensional airflow model computational area
180 interior drop in flight line of many print drops
182 end drop in a flight line of many print drops
184 next to the end drop in a flight line of many print drops
190 net airflow deflection force vector with drop-to-drop interaction affects
210 media support drum
212 media transport input/output drive means
213 media transport input/output drive means
245 connection to liquid recycling unit
290 print or liquid pattern receiving media
300 print or deposition plane
302 pixel position in liquid pattern data (input image)
304 pixel to be printed in the liquid pattern data
306 pixel not to be printed in the liquid pattern data
310 input image or liquid pattern plane
312 pixel position in the output liquid pattern or image
314 pixel printed in the liquid pattern or image
316 pixel not printed in the liquid pattern or image
330 input data test pattern grid of every fourth pixel printed in two dimensions
332 input data of a single isolated print pixel within void area of test pattern grid
334 input data of a three-pixel row within void area of test pattern grid
336 input data of a seventeen-pixel row within void area of test pattern grid
338 input data of a 4×17 pixel bar within void area of test pattern grid
340 void area in test pattern grid input image or liquid pattern
342 intended print pixel positions for 4×4 grid drops
344 intended print pixel locations for input data pattern
350 output print test pattern grid of every fourth pixel printed in two dimensions
352 output printed single isolated print pixel within void area of test pattern grid
354 output printed three-pixel row within void area of test pattern grid
356 output printed seventeen-pixel row within void area of test pattern grid
358 output printed 4×17 pixel bar within void area of test pattern grid
360 void area in test pattern grid output image or liquid pattern
380 media landing point of interior drop in flight line of many print drops
382 media landing point of end drop in a flight line of many print drops
384 media landing point of next to the end drop in a flight line of many print drops
400 controller
410 input data source
412 printhead transducer drive circuitry
414 media transport control circuitry
416 liquid recycling subsystem
418 liquid supply reservoir
420 negative pressure source
422 air subsystem control circuitry
424 liquid supply subsystem control circuitry
426 printhead control circuitry
510 CFD calculated airflow velocity contour, $v_x$ ~19 m/sec.
512 CFD calculated airflow velocity contour, $v_x$ ~15 m/sec.
514 CFD calculated airflow velocity contour, $v_x$ ~10 m/sec.
516 CFD calculated airflow velocity contour, $v_x$ ~5 m/sec.
600 drop forming pulse sequence
610 unit period, $\tau_0$, pulses
612 a $4\tau_0$ time period sequence producing drops of volume ~$4V_0$
614 deleted drop forming pulses
615 an $8\tau_0$ time period sequence producing drops of volume ~$8V_0$
616 a $3\tau_0$ time period sequence producing drops of volume ~$3V_0$
620 plot of $(2c^{*-1}+c^{*-2})$ vs. c*
624 plot of $V_{dm}$ vs. c* for $S_n$=42.3 μm
626 plot of $F_{yed}$ from CFD and Buckingham-Pi analysis, Equation 8
630 plot of $c_{y2}$* versus $V_{dm}$ for $S_n$=42.3 μm
632 plot of $c_{zy}$* versus $V_{dm}$ for q=0.5, $S_n$=42.3 μm, m=3, L=7
634 plot of $c_{zy}$* versus $V_{dm}$ for q=0.5, $S_n$=42.3 μm, m=3, L=4
636 plot of mL values for which $c_{zy}^*=c_{y2}^*$, with y-spacing=2 $S_n$ and q=0.333
638 plot of $mL_1$ values for which $c_{zy}^*=c_{y2}^*$, with y-spacing=2 $S_n$ and q=0.5
A area of test print pattern enlargement from FIG. 10(*b*) to FIG. 11
B area of drop curtain enlargement from FIG. 20(*a*) to FIG. 21(*a*)
C area of drop curtain enlargement from FIG. 22(*a*) to FIG. 21(*b*)
c length of an open space between adjacent drops
c* normalized length of an open space between adjacent drops, $c^*=c/D_{dm}$
$c_y$ nearest inter-drop-separation along the y-direction
$c_y$* normalized nearest inter-drop-separation along the y-direction, $c_y^*=c_y/D_{dm}$
$c_{y1}$* $c_{y1}^*=S_n/D_{dm}-1$
$c_{y2}$* $c_{y2}^*=2\ S_n/D_{dm}-1$
$c_{y3}$* $c_{y3}^*=3\ S_n/D_{dm}-1$
$c_{yz}$ nearest inter-drop-separation along the yz-direction
$c_{yz}$* normalized nearest inter-drop-separation along the yz-direction, $c_{yz}^*=c_{yz}/D_{dm}$
$c_z$ nearest inter-drop-separation along the z-direction $c_z$* normalized nearest inter-drop-separation along the z-direction, $c_z^*=c_y/D_{dm}$
$D_{d0}$ small drop diameter
$D_{dm}$ print (large) drop diameter (large drop print mode)
$D_n$ nozzle diameter
E drop forming pulse energy
Exp value of minimum c* in drop line printing experiments
$F_{xy}$ net airflow force in the xy-plane
$f_0$ small drop, $V_0$, formation frequency
$f_p$ print drop frequency
h width of test line pattern in pixels
L small drop generation ratio, $L=\lambda_0/D_n$
$L_2$ small drop generation ratio wherein $c_z^*=c_y^*$, $L_2=S_n/D_n$
$L_1$ small drop generation ratio wherein $c_{yz}^*=c_{y2}^*$, $L_1=27^{(1/2)}S_n/mD_n$
$\lambda_0$ small drop separation distance, $\lambda_0=LD_n$
$\lambda_m$ large drop separation distance, $\lambda_m=m\lambda_0$
m number of small drops in a print drop, $V_m=mV_0$
μ viscosity of the deflection gas
ΔP pressure drop through gap between cylinders in 2-D model
$\overline{\Delta P}$ normalized pressure drop through gap between cylinders in 2-D model
$P_{in}$ upstream pressure in 2-D model
$P_{out}$ downstream pressure in 2-D model
$P_r$ fluid supply reservoir pressure
ρ mass density of deflection gas
q time shift fraction
$q_1$ first time shift fraction
$q_2$ second time shift fraction
$q_3$ nozzle shift fraction
Re Reynolds number
$S_{px}$ liquid pattern pixel spacing in the x-direction
$S_{py}$ liquid pattern pixel spacing in the y-direction
$S_n$ nozzle spacing
$S_{ns}$ nozzle shift to compensate for time shifted drop forming pulse sequences
$S_{ns1}$ nozzle shift to compensate for time shifted drop forming pulse sequences
$S_{ns2}$ nozzle shift to compensate for time shifted drop forming pulse sequences
$\tau_0$ small drop, or fundamental, drop forming period
$\tau_m$ large drop forming period
$\tau_p$ drop forming energy pulse width
$\tau_{npd}$ non-print drop forming time period, $\tau_m/\tau_0$ for small/large drop printing
$\tau_{pd}$ print drop forming time period, $\tau_0/\tau_m$ for small/large drop printing
$\tau_s$ time shift of drop forming pulse sequence
$\tau_{s1}$ first time shift of drop forming pulse sequence
$\tau_{s2}$ second time shift of drop forming pulse sequence
$V_0$ volume of a small non-print drop
$v_d$ drop and liquid stream velocity
$v_{dropx}$ drop velocity in the lateral, x-direction
$v_{in}$ initial deflection gas velocity used in the 2-D model
$v_{out}$ deflection gas flow velocity in between cylinders in the 2-D model
$v_{rel}$ net relative velocity of deflecting airflow
$v_{relx}$ net relative x-direction velocity of deflecting airflow
$v_x$ x-direction velocity of deflecting airflow
$V_m$ volume of a large print drop
$v_{PM}$ media transport velocity
$v_{PMHQ}$ printhead/media relative velocity for a system's highest quality print mode
w length of test line pattern in pixels

The invention claimed is:

1. A method of forming a liquid pattern of print drops impinging a receiving medium according to liquid pattern data using a liquid drop emitter that emits a plurality of continuous streams of liquid at a stream velocity, $v_d$, from a plurality of nozzles having effective diameters, $D_n$, arrayed at a nozzle spacing, $S_n$, along a nozzle array direction that are broken into a plurality of streams of print and non-print drops by a corresponding plurality of drop forming transducers to which a corresponding plurality of drop forming energy pulse sequences are applied, the method comprising:

forming non-print drops by applying non-print drop forming energy pulses during a unit time period, $\tau_0$, and forming print drops by applying print drop forming energy pulses during a large drop time period, $\tau_m$, wherein the large drop time period is a multiple, m, of the unit time period, $\tau_m=m\tau_0$, and $m\geqq 2$;

forming the corresponding plurality of drop forming energy pulses sequences so as to form non-print drops and print drops according to the liquid pattern data; and substantially shifting in time the corresponding drop forming energy pulse sequences applied to adjacent drop forming transducers so that the print drops formed in adjacent streams of drops are not aligned along the nozzle array direction.

2. The method of claim 1 wherein the drop forming energy pulse sequences applied to any pair of adjacent drop forming transducers are shifted in time by a time shift amount, $t_s$, wherein the time shift amount is a portion, q, of the large drop time period, $\tau_m$, such that $t_s=q\tau_m$, and $0.2\leqq q\leqq 0.8$.

3. The method of claim 2 wherein the multiple, m, is an integer equal to 2, 3, 4 or 5.

4. The method of claim 2 wherein the liquid emitted from a nozzle during the unit drop period, has a small drop generation ratio, L, equal to the stream velocity, $v_d$, multiplied by the unit time period, $\tau_0$, divided by the effective nozzle diameter, $D_n$, $L=\tau_0 v_d/D_n$, and wherein there is a first crossover small drop generation ratio, $L_1$, defined as the value of the small drop generation ratio for which a minimum diagonal print drop separation distance, $S_{zy}$, between print drops formed in adjacent streams, when q is approximately equal to one-third, is equal to twice the nozzle separation distance, $S_n$, $L_1=27^{(1/2)}S_n/mD_n$, and the small drop generation ratio is selected to be equal to or less than the first crossover small drop generation ratio, $L\leqq L_1$.

5. The method of claim 1 wherein the drop forming energy pulse sequences applied to any pair of adjacent drop forming transducers are shifted in time by a time shift amount that is approximately one-half the large drop time period, $t_s=0.5\,\tau_m$.

6. The method of claim 1 wherein the corresponding pluralities of continuous streams of liquid, nozzles and drop forming transducers to which a corresponding plurality of drop forming energy pulse sequences are applied are divided into first and second interdigitated groups, and the drop forming energy pulse sequences applied to the first group are shifted in time relative to the second group by a time shift amount, $t_s$, wherein the time shift amount is a portion, q, of the large drop time period, $\tau_m$, such that $t_s=q\tau_m$, and $0.2\leqq q\leqq 0.8$.

7. The method of claim 1 further comprising substantially shifting in time the corresponding drop forming energy pulse sequences applied to next to adjacent drop forming transducers so that the print drops formed in adjacent and next to adjacent streams of drops are not aligned along the nozzle array direction.

8. The method of claim 7 wherein the drop forming energy pulse sequences applied to any three adjacent drop forming transducers are shifted in time with respect to one another by first and second time shift amounts $t_{s1}$ and $t_{s2}$, wherein the first and second time shift amounts are first and second portions, $q_1$ and $q_2$, of the large drop time period, $\tau_m$, such that $t_{s1}=q_1\tau_m$, $t_{s2}=q_2\tau_m$ wherein $0.2 \leqq q_1 \leqq 0.8$ and $0.2 \leqq q_2 \leqq 0.8$.

9. The method of claim 7 wherein the corresponding pluralities of continuous streams of liquid, nozzles and drop forming transducers to which a corresponding plurality of drop forming energy pulse sequences are applied are divided into first, second and third interdigitated groups, and the drop forming energy pulse sequences applied to the second group are shifted in time relative to the first group by a first time shift amount, $t_{s1}$; the drop forming energy pulse sequences applied to the third group are shifted in time relative to the first group by a second time shift amount, $t_{s2}$; wherein the first and second time shift amounts are first and second portions, $q_1$ and $q_2$, of the large drop time period, $\tau_m$, such that $t_{s1}=q_1\tau_m$, $t_{s2}=q_2\tau_m$ wherein $0.2 \leqq q_1 \leqq 0.8$ and $0.2 \leqq q_2 \leqq 0.8$.

10. The method of claim 8 wherein the multiple, m, is an integer equal to 2, 3, 4 or 5.

11. The method of claim 8 wherein the liquid emitted from a nozzle during the unit drop period, has a small drop generation ratio, L, equal to the stream velocity, $v_d$, multiplied by the unit time period, $\tau_0$, divided by the effective nozzle diameter, $D_n$, $L=\tau_0 v_d/D_n$, and wherein there is a first crossover small drop generation ratio, $L_1$, defined as the value of the small drop generation ratio for which a minimum diagonal print drop separation distance, $S_{zy}$, between print drops formed in adjacent streams, when $q_1$ is approximately equal to one-third and $q_2$ is approximately equal to two-thirds, is equal to twice the nozzle separation distance, $S_n$, $L_1=27^{(1/2)} S_n/mD_n$, and the small drop generation ratio is selected to be equal to or greater than the first crossover small drop generation ratio, $L \geqq L_1$.

12. A method of forming a liquid pattern of print drops impinging a receiving medium according to liquid pattern data using a liquid drop emitter that emits a plurality of continuous streams of liquid in a stream direction at a stream velocity, $v_d$, from a plurality of nozzles having effective diameters, $D_n$, arrayed at a nozzle spacing, $S_n$, along a nozzle array direction that are broken into a plurality of streams of print and non-print drops by a corresponding plurality of drop forming transducers to which a corresponding plurality of drop forming energy pulse sequences are applied, the method comprising:

forming print drops by applying print drop forming energy pulses during a unit time period, $\tau_0$, and forming non-print drops by applying non-print drop forming energy pulses during a large drop time period, $\tau_m$, wherein the large drop time period is a multiple, m, of the unit time period, $\tau_m=m\tau_0$, and $m \geqq 2$;

forming the corresponding plurality of drop forming energy pulses sequences so as to form non-print drops and print drops according to the liquid pattern data; and substantially shifting in time the corresponding drop forming energy pulse sequences applied to adjacent drop forming transducers by a time shift amount, $t_s$, wherein the time shift amount is a portion, q, of the unit drop time period, $\tau_0$, such that $t_s=q\tau_0$, and $0.2 \leqq q \leqq 0.8$.

13. The method of claim 12 wherein the drop forming energy pulse sequences applied to any pair of adjacent drop forming transducers are shifted in time by a time shift amount that is approximately one-half the unit time period, $t_s=0.5\,\tau_0$.

14. The method of claim 12 wherein the corresponding pluralities of continuous streams of liquid, nozzles and drop forming transducers to which a corresponding plurality of drop forming energy pulse sequences are applied are divided into first and second interdigitated groups, and the drop forming energy pulse sequences applied to the first group are shifted in time relative to the second group by a time shift, $t_s$, wherein the time shift amount is a portion, q, of the unit drop time period, $\tau_0$, such that $t_s=q\tau_0$, and $0.2 \leqq q \leqq 0.8$.

15. The method of claim 12 wherein the multiple, m, is an integer equal to 2, 3, 4 or 5.

16. The method of claim 12 wherein the liquid emitted from a nozzle during the unit drop period, has a unit stream length, $\lambda_0$, equal to the stream velocity, $v_d$, multiplied by the unit time period, $\lambda_0=v_d\tau_0$, and a small drop generation ratio, L, equal to the unit stream length divided by the effective nozzle diameter, $D_n$, $L=\lambda_0/D_n$, and wherein there is a second crossover small drop generation ratio, $L_2$, defined as the value of the small drop generation ratio for which the unit stream length is equal to the nozzle spacing, $L_2=S_n/D_n$, and the small drop generation ratio is selected to be equal to or greater than the second crossover small drop generation ratio, $L \geqq L_2$.

17. A drop deposition apparatus for laying down a patterned liquid layer on a receiver substrate comprising:

a liquid drop emitter that emits a plurality of continuous streams of liquid in a stream direction at a stream velocity, $v_s$, from a plurality of nozzles having effective diameters, $D_n$, arrayed at a nozzle spacing, $S_n$, along a nozzle array direction;

a corresponding plurality of drop forming transducers to which a corresponding plurality of drop forming energy pulse sequences are applied to generate non-print drops and print drops having substantially different volumes;

relative motion apparatus adapted to move the liquid drop emitter relative to the receiver substrate in a printing direction at a printing velocity, $v_{PM}$;

a controller adapted to generate drop forming energy pulse sequences comprised of non-print drop forming energy pulses within non-print drop time periods, $\tau_{np}$, and print drop forming energy pulses within print drop time periods, $\tau_p$, according to the liquid pattern data and wherein the non-print drop time periods are substantially different from the print drop time periods causing non-print drop volumes to be substantially different from print drop volumes; and drop deflection apparatus adapted to deflect print and non-print drops to follow different flight paths according to the substantially different volumes of the print and non-print drops;

wherein the controller is further adapted to substantially shift in time the corresponding drop forming energy pulse sequences applied to adjacent drop forming transducers so that the print drops formed in adjacent streams of drops are not aligned along the nozzle array direction.

18. The drop deposition apparatus of claim 17 wherein the drop forming energy pulse sequences applied to any pair of adjacent drop forming transducers are shifted in time by a time shift amount, $t_s$, wherein the time shift amount is a portion, q, of the print drop time period, $\tau_p$, such that $t_s=q\tau_p$, and $0.2 \leqq q \leqq 0.8$; and wherein the corresponding pair of nozzles are displaced with respect to each other along the printing direction by a nozzle shift distance, $S_{ns}$, which is a substantial portion, $q_3$, of the time shift, $t_s$, multiplied by the printing velocity, $v_{PM}$, $S_{ns}=q_3 t_s v_{PM}$, $0.2 \leqq q_3 \leqq 1.2$.

19. The drop deposition apparatus of claim 17 wherein the corresponding pluralities of continuous streams of liquid, nozzles and drop forming transducers to which a corresponding plurality of drop forming energy pulse sequences are applied are divided into first and second interdigitated groups, and the drop forming energy pulse sequences applied to the first group are shifted in time relative to the second group by a time shift amount, $t_s$, wherein the time shift amount is a portion, q, of the print drop time period, $\tau_p$, such that $t_s=q\tau_p$, and $0.2 \leqq q \leqq 0.8$; and wherein the first and second interdigitated groups are displaced with respect to each other along the printing direction by a nozzle shift distance, $S_{ns}$, which is a substantial portion, $q_3$, of the time shift, $t_s$, multiplied by the printing velocity, $v_{PM}$, $S_{ns}=q_3 t_s v_{PM}$, $0.2 \leqq q_3 \leqq 1.2$.

20. The drop deposition apparatus of claim 17 wherein the drop deflection apparatus generates an airflow having a component that is perpendicular to the stream direction and the drop forming transducers are comprised of resistive heaters that impart heat energy to a corresponding stream of liquid.

* * * * *